US006625417B1

(12) United States Patent
Terada et al.

(10) Patent No.: US 6,625,417 B1
(45) Date of Patent: Sep. 23, 2003

(54) IMAGE HEATING DEVICE AND IMAGE FORMING APPARATUS USING THE SAME

(75) Inventors: Hiroshi Terada, Nara (JP); Masaru Imai, Osaka (JP); Hideki Tatematsu, Osaka (JP); Akinori Toyoda, Osaka (JP); Kenji Asakura, Osaka (JP); Syuichi Watanabe, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/914,690

(22) PCT Filed: Feb. 29, 2000

(86) PCT No.: PCT/JP00/01179

§ 371 (c)(1),
(2), (4) Date: Aug. 31, 2001

(87) PCT Pub. No.: WO00/52534

PCT Pub. Date: Sep. 8, 2000

(30) Foreign Application Priority Data

Mar. 2, 1999 (JP) ..... 11-054080
Oct. 20, 1999 (JP) ..... 11-297760

(51) Int. Cl.[7] ..... G03G 15/20
(52) U.S. Cl. ..... 399/328; 399/329; 219/216
(58) Field of Search ..... 399/44, 67, 69, 399/328, 329, 330; 219/216, 618, 619; 347/156

(56) References Cited

U.S. PATENT DOCUMENTS

| | | | |
|---|---|---|---|
| 5,506,666 A | 4/1996 | Masuda et al. | 399/335 |
| 5,666,627 A | 9/1997 | Yamaguchi | 399/330 |
| 5,745,833 A | 4/1998 | Abe et al. | 399/330 |

(List continued on next page.)

FOREIGN PATENT DOCUMENTS

| | | |
|---|---|---|
| EP | 0 816 942 | 1/1998 |
| EP | 1 026 556 | 8/2000 |
| EP | 1 174 774 | 1/2002 |
| JP | 54-131141 | 10/1979 |
| JP | 6-318001 | 11/1994 |
| JP | 7-295414 | 11/1995 |
| JP | 8-129313 | 5/1996 |
| JP | 9-171889 | 6/1997 |
| JP | 9-197863 | 7/1997 |
| JP | 9-319243 | 12/1997 |
| JP | 10-74007 | 3/1998 |
| JP | 10-106739 | 4/1998 |
| JP | 10-184662 | 7/1998 |
| JP | 11-297462 | 10/1999 |
| JP | 11-297463 | 10/1999 |
| JP | 2000-181258 | 6/2000 |
| JP | 2000-206813 | 7/2000 |
| JP | 2000-250338 | 9/2000 |
| JP | 2000-310914 | 11/2000 |

*Primary Examiner*—Hoan Tran
(74) *Attorney, Agent, or Firm*—Merchant & Gould, P.C.

(57) ABSTRACT

An image heating device having a predetermined amount of heat generation with a small electric current. The device has a heat-generating roller having magnetism and conductivity, and an exciting coil opposed to the peripheral face of the heat-generating roller and adapted for allowing the heat-generating roller to generate heat with electromagnetic induction. The exciting coil is composed of a bundle of copper wires extended in the direction of the rotation axis of the heat generating roller. The wires are circumferentially wound along the circumferential direction of the heat-generating roller. The bundled wires are arranged in close contact with each other in the circumferential direction of the heat-generating roller so as to cover the upper half of the heat-generating roller.

58 Claims, 37 Drawing Sheets

U.S. PATENT DOCUMENTS

| | | | | | |
|---|---|---|---|---|---|
| 5,752,148 | A | | 5/1998 | Yoneda et al. | 399/329 |
| 5,819,150 | A | | 10/1998 | Hayasaki et al. | 399/330 |
| 5,951,903 | A | | 9/1999 | Isoyama et al. | 219/603 |
| 6,031,215 | A | * | 2/2000 | Nanataki et al. | 219/619 |
| 6,037,576 | A | | 3/2000 | Okabayashi et al. | 219/619 |
| 6,049,691 | A | * | 4/2000 | Abe et al. | 399/330 |
| 6,137,983 | A | * | 10/2000 | Okabayashi et al. | 399/329 |
| RE36,962 | E | | 11/2000 | Higashi et al. | 399/328 |
| 6,181,905 | B1 | * | 1/2001 | Ohta et al. | 399/328 |
| 6,195,525 | B1 | * | 2/2001 | Maeyama | 399/328 |
| 6,246,843 | B1 | | 6/2001 | Nanataki et al. | 399/45 |
| 6,255,632 | B1 | * | 7/2001 | Yokoyama et al. | 219/619 |
| 6,377,775 | B1 | * | 4/2002 | Nakayama et al. | 399/328 |

* cited by examiner

IMAGE HEATING DEVICE AND IMAGE FORMING APPARATUS USING THE SAME

TECHNICAL FIELD

The present invention relates to an image heating device for use in image forming apparatus, such as electrophotographical apparatus, electrostatic recording apparatus or the like and suitable as a fixing device for fixing unfixed images, and to an image forming apparatus using this.

BACKGROUND ART

As this kind of image heating device, an image heating device using electromagnetic induction is disclosed in JP 10(1998)-74007 A, JP7 (1995)-295414 A, etc, and is well known.

JP 10(1998)-74007A describes an exciting coil in which a coil is wound around a core, as an exciting means applicable for electromagnetic induction. FIG. 34 is a cross-sectional view showing an image heating device disclosed in JP 10 (1998)-74007 A.

In FIG. 34, reference numeral 310 denotes a coil for generating a high-frequency magnetic field, and 311 denotes a rotatable metal sleeve that generates heat by induction heating. Reference numeral 312 denotes an internal pressure member provided inside the metal sleeve 311, and reference numeral 313 denotes an external pressure member provided outside the metal sleeve 311. This external pressure member 313 is pressed against the internal pressure member 312 via the metal sleeve 311 so as to form a nip portion. The external pressure member 313 is rotated in the direction of the arrow a shown in FIG. 34. The metal sleeve 311 is rotated following the rotation of the external pressure member 313.

A recording paper 314, as a member to be recorded, carrying an unfixed toner image thereon is fed to the nip portion in the arrow direction shown in FIG. 34. Then, the unfixed toner image on the recording paper 314 is fixed by the heat from the metal sleeve 311 and the pressure from both pressure members 312 and 313.

The coil 310 is provided with a plurality of separated winding portions 310*a* and 310*b*. These winding portions 310*a* and 310*b* are formed by winding a conductive wire around leg portions 315*b* and 315*d* of the core 315 extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place.

Furthermore, an image heating device according to a tenth configuration of the present invention includes: a heat-generating member comprising a rotatable body having conductivity, and an exciting coil arranged in opposition to the outer peripheral surface of the heat-generating member and adapted for allowing the heat-generating member to generate heat with electromagnetic induction; wherein the exciting coil composed of a bundle of wires having an insulated surface, which are extended in the direction of the rotation axis of the heat-generating member and circumferentially wound along the circumferential direction of the heat-generating member, and a larger number of bundled wires are superimposed at both ends than at the central portion in the direction of the rotation axis of the heat-generating member.

Furthermore, an image heating device according to an eleventh configuration of the present invention includes: a heat-generating member comprising a rotatable body having conductivity, and an exciting coil arranged in opposition to the outer peripheral surface of the heat-generating member and adapted for allowing the heat-generating member to generate heat with electromagnetic induction; further comprising a core made of magnetic material arranged outside the exciting coil, and the length of the core along the direction of the rotation axis of the heat-generating member is not shorter than the width of a recording material having the maximum width of all the recording materials to be used."the heating roller 201, Joule heat is generated in the heating roller 201, so that the heating roller 201 generates heat.

According to the configuration of the exciting means described in JP 7 (1995)-295414 A, as compared with the configuration of the exciting means described in JP10 (1998)-74007 A, the degree of freedom of design in placing the conductive wire is less limited, and it is possible to place the conductive wire over a broader range along the circumferential surface in the circumferential direction of the heating roller 201.

However, the image heating device disclosed in JP 7(1995)-295414 A has the following problems.

Since the heating coil 204 is formed of a conductive film arranged in a curled form, there is space in which no electric current flows between the circumferentially flowing current. Therefore, as shown by a broken line S in FIG. 35, the magnetic flux passes between the coils to form small loops. In this case, it is not possible to lead the magnetic flux to the heating roller 201 efficiently, thus increasing the magnetic flux that does not penetrate the heating roller 201. Therefore, in order to obtain the electric power necessary for allowing the heating roller 201 to generate heat, a large amount of electric current is required to flow to the heating coil 204. In order to carry a large amount of electric current to the heating coil 204, a component having a large breakdown current is required to be used for the electric power source for induction heating, causing the electric power source for induction heating to be expensive.

Furthermore, conventionally, as image heating devices, for which fixing devices are typical example, contact-heating type devices such as heat roller type devices and belt type devices, generally have been used.

In recent years, due to the demand for shorter warm-up time and reduced energy consumption, the belt type image heating devices capable of reducing the thermal capacity are attracting great attention (see JP 6 (1994)-318001 A).

FIG. 37 shows a cross-sectional view of a belt type image heating device, which is disclosed in JP 6 (1994)-318001 A. As shown in FIG. 37, an endless rotatable fixing belt 401 is suspended between a fixing roller 402 and a heating roller 403. By heating the heating roller 403 by the use of the heating source H1 located inside the heating roller 403, the fixing belt 401 is heated to a predetermined temperature.

By using the fixing belt 401 having a small thermal capacity, this image heating device is designed to achieve a fixing without offset with less oil applied.

The belt type image heating device including the above-mentioned prior art has advantages of being able to set the thermal capacity of the fixing belt small for shortening the warm-up time, which makes it possible to heat up the fixing belt itself to the predetermined temperature in a short time. However, on the other hand, as the thermal capacity is reduced, the trend for the temperature of the fixing belt to be easily reduced due to the heat removed by the recording paper, etc. when a toner image is fixed becomes larger.

Therefore, in order to obtain a reliable fixing, the lowered temperature of the fixing belt should be recovered uniformly to the necessary temperature until the fixing belt arrives again to the fixing portion.

Furthermore, there is another problem in that how the temperature of the fixing belt decreases when the fixing belt passes though the fixing portion varies dependent greatly upon the temperature conditions of the recording paper, the members to be used for pressure means, or the like. Therefore, in order to obtain the stable fixing, regardless of the temperature conditions of the recording paper, the member to be used for pressure means, or the like, that is, even if the manner in which the temperature of the fixing belt decreases changes greatly after the fixing belt passes through the fixing portion, it is necessary to restore the temperature of the fixing belt to the optimum constant temperature when the fixing belt comes again to the fixing portion.

In order to restore the fixing belt to a predetermined temperature stably and uniformly, a configuration of transferring heat from the heat-generating portion to the fixing belt and a configuration of the heat generating portion itself are important. However, in the conventional belt type image heating device, this point was not particularly taken into account.

In the belt type image heating device including the above-mentioned prior art, the thermal capacity of the fixing belt is set to be small in order to shorten the warm-up time, which causes inconsistency in temperature or partially excessive rise in temperature. This is a significant problem in the case of continuously using the recording paper having a smaller width as compared with the size of the depth direction (the direction of the rotation axis of the heating roller 403) of the image heating device shown in FIG. 37. That is, in the portion where the recording paper passes through, the heat is removed increasingly by the recording paper, and therefore the portion must be heated accordingly. However, if the portion where the recording paper does not pass through is heated similarly, the temperature of the portion is raised because the thermal capacity of the heating body (heat-generating roller) is small. Thus, if a large size recording paper (broad-width recording paper) is used in a state in which the temperature is increased abnormally, hot offset may occur.

On the contrary, if the heat generation is limited in order to prevent the hot offset, the temperature of the portion where the heat is removed by the recording paper becomes low, which may lead to the cold offset or an unfixed state.

DISCLOSURE OF INVENTION

The present invention has been made to overcome the above-mentioned problems of the prior art. It is an object of the present invention to provide an image heating device capable of obtaining a predetermined amount of heat generation with a small electric current, and an image forming apparatus using the same. Furthermore, it is an object of the present invention to provide a image heating device using a fixing belt and capable of shortening the warm-up time and stably controlling temperatures of the belt, and an image forming apparatus using the same.

In order to achieve the above objects, an image heating device according to a first configuration of the present invention includes a heat-generating member comprising a rotatable body having conductivity, and an exciting coil arranged in opposition to the peripheral surface of the heat-generating member and adapted for allowing the heat-generating member to generate heat with electromagnetic induction, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place. According to the first configuration of the image heating device, magnetic fluxes, which are generated due to alternating current flowing in the exciting coil, do not pass through between the bundled wires in the area in which the bundled wires are arranged in close contact with each other. Therefore, it is possible to allow the magnetic fluxes to penetrate the heat-generating member efficiently as compared with the prior art. Accordingly, in order to obtain the electric power necessary for allowing the heat-generating member to generate heat, a large amount of electric current is not required to be applied to the exciting coil.

Furthermore, in the first configuration of the image heating device according to the present invention, it is preferable that a larger number of the bundled wires are superimposed at both ends than at the central portion in the direction of the rotation axis of the heat-generating member. With such a preferred configuration, it is possible to heat uniformly a wide range of the heat-generating member in the direction of the rotation axis thereof. Moreover, since the bundled wires superimposed at both ends in the direction of the rotation axis of the heat-generating member are distant from the heat-generating member, an eddy current is not concentrated on this portion and the temperature of this portion is not excessively increased.

Furthermore, in the first configuration of the image heating device according to the present invention, it is preferable that the diameter of the wire is 0.1 mm or more and 0.3 mm or less and the diameter of the bundled wire is 5 mm or less. With such a preferred configuration, since the electric resistance of the bundled wire is small with respect to the high frequency alternating current, the heat generation of the exciting coil can be suppressed. Furthermore, since it is possible to provide the bundled wire with an appropriate thickness, rigidity and durability, the exciting coil can be formed easily.

Furthermore, in the first configuration of the image heating device according to the present invention, it is preferable that the exciting coil has an inductance of 10 $\mu$H or more and 50 $\mu$H or less and an electric resistance of 0.5 Ω or more and 5 Ω or less in a state in which the exciting coil is opposed to the heat-generating member. With such a preferred configuration, an exciting circuit can be configured by a circuit element having not so high breakdown current and breakdown voltage, and thus sufficient electric power applied to the heat-generating member and sufficient amount of heat generation can be obtained.

Furthermore, in the first configuration of the image heating device according to the present invention, it is preferable that the image heating device further includes a core made of magnetic material arranged outside the exciting coil. With such a preferred configuration, since all of the magnetic flux at the rear face side of the exciting coil penetrate the inside of the core, it is possible to prevent the magnetic fluxes from leaking out backward. As a result, it is possible to prevent the heat generation due to the electromagnetic induction of the peripheral conductivity material and at the same time to prevent the unnecessary radiation of electromagnetic wave. Furthermore, since the inductance of the exciting coil is increased and the electromagnetic coupling between the exciting coil and the heat-generating member becomes excellent, it is possible to apply larger amount of elastic power to the heat-generating member with same coil current. Furthermore, in this case, it is preferable that the length of the core along the direction of the rotation axis of the heat-generating member is shorter than the length of the heat-generating member in the direction of the rotation axis thereof. With such a preferred configuration, it is possible to prevent the eddy current density at the end face of the heat-generating member from being increased and the heat generation at the end face of the heat-generating member from being excessively increased. Furthermore, in this case, the length of the exciting coil at the outer peripheral portion in the direction of the rotation axis of the heat-generating member is not shorter than the width of a recording material having the maximum width in all the recording materials to be used; and the length of the core in the direction of the rotation axis of the heat-generating member is not shorter than the width of the recording material having the maximum width of all the recording materials to be used. With such a preferred configuration, even if the exciting coil is wound somewhat nonuniformly, it is possible to make the magnetic field reaching from the exciting coil to the heat-generating member to be uniform in the direction of the rotation axis of the heat-generating member. Therefore, it is possible to make the distribution of heat generation of the heat-generating member to be uniform in the portion where the recording material passes through. Thereby, it is possible to make the temperature distribution at the fixing portion uniform, and thus a stable fixing operation can be obtained. Furthermore, it is possible to shorten the length of the heat-generating member in the direction of the rotation axis thereof and the length of the exciting coil in the direction of the rotation axis of the heat-generating member while making the distribution of heat generation of the heat-generating member uniform. As a result, it is possible to realize a miniaturization of the device and at the same time to reduce the cost. Furthermore, in this case, it is preferable that the distance between the end face of the core and the end face of the heat-generating member in the direction of the rotation axis of the heat-generating member is longer than the facing space between the core and the heat-generating member. With such a preferred configuration, since lines of magnetic force radiated from the core toward the end portion of the heat-generating member are not concentrated on the narrow range, it is possible to prevent the induced current from concentrating on the end face and the vicinity of the heat-generating member and to prevent the end portion of the heat-generating member from being excessively heated. Furthermore, in this case, it is preferable that the core has opposing portions opposed to the heat-generating member without sandwiching the exciting coil between the opposing portion and the heat-generating member, and magnetic permeable portions opposed to the heat-generating member via the exciting coil. With such a preferred configuration, since the magnetic fluxes generated by alternating current (coil current) flowing in the exciting coil pass through between the opposing portion and the heat-generating member, most of the magnetic path can be composed of a material having a high magnetic permeability. Therefore, an air portion having a low magnetic permeability in which the magnetic fluxes generated by the coil current passes through is limited to the narrow gap portion between the heat-generating member and the core. Accordingly, the inductance of the exciting coil is increased, and almost all of the magnetic fluxes generated by the coil current can be led to the heat-generating member. As a result, it is possible to obtain an excellent electromagnetic coupling between the heat-generating member and the exciting coil. Thereby, more electric power can be applied to the heat-generating member even with the same coil current. In addition, since the magnetic path is defined by the opposing portion and the heat-generating member, the magnetic circuit can be designed freely. In this case, it is further preferable that the heat-generating member is supported by the support member made of magnetic material, and a space between the support member and the core is twice or more the facing space between the core and the heat-generating member. With such a preferred configuration, most of the magnetic fluxes penetrating the core penetrate the heat-generating member without being led to the support member. Thereby, an electromagnetic energy provided to the exciting coil can be transmitted to the heat-generating member efficiently. At the same time, it is possible to prevent the support member from being heated. Furthermore, in this case, it is preferable that the length between the outermost ends of the magnetic permeable portion along the direction of the rotation axis of the heat-generating member is not longer than the length between the outermost ends of the opposing portion along the direction of the rotation axis of the heat-generating member. With such a preferred configuration, since it is possible to reduce the amount of material for the magnetic permeable portion to be used with the range of the opposing portion defining the range of the heat-generating portion in the direction of the rotation axis of the heat-generating member secured, it can be to make the distribution of heat generation to be uniform with lower cost. Furthermore, in this case, it is preferable that at least a part of the opposing portion is arranged in closer contact with the heat-generating member than the magnetic permeable portion, thereby forming an adjacent portion. With such a preferred configuration, a much greater electric power can be applied to the heat-generating member. Furthermore, in this case, it is preferable that a plurality of adjacent portions are provided and one of the plurality of adjacent portions is located in the center of the winding of the exciting coil. Since a magnetic flux generated by the coil current passes through the center of winding of the exciting coil without fail, by locating the adjacent portion in the center of winding of the exciting coil, the magnetic fluxes generated by the coil current can be led to the heat-generating member efficiently. Furthermore, in this case, it is preferable that at least a part of the core has gaps in the direction of the rotation axis of the heat-generating member. With such a preferred configuration, by changing the arrangement of the core, the distribution of heat generation can be designed freely. Furthermore, even if a cheap and small volume core is used, uniform temperature distribution can be obtained. Furthermore, since heat can be radiated from the gap of the core, and at the same time, the surface area of the core itself becomes large, the radiation of heat can be promoted. Furthermore, in this case, it is preferable that the core has opposing portions opposed to the heat-generating member without sandwiching the exciting coil between the opposing portion and the heat-generating member, and magnetic permeable portions opposed to the heat-generating member via the exciting coil, and the gaps in the magnetic permeable portion of the core are distributed nonuniformly in the direction of the rotation axis of the heat-generating member. Furthermore, in this case, it is preferable that the gap in the magnetic permeable portion of the core is smaller in the end portion than in the central portion in the direction of the rotation axis of the heat-generating member. With such a preferred configuration, it is possible to prevent the deficiency in fixing by making the temperature distribution of the heat-generating member to be uniform. Furthermore, in this case, it is preferable that the core has opposing portions opposed to the heat-generating member without sandwiching the exciting coil between the opposing portion and the heat-generating member, and magnetic permeable portions opposed to the heat-generating member via the exciting coil, and the opposing portions of the core arranged asymmetrically with respect to a center line of the exciting coil in the direction of the rotation axis of the heat-generating member. With such a preferred configuration, it is possible to make the distribution of heat generation in the direction of the rotation axis of the heat-generating member to be uniform with a smaller amount of core. On the contrary, if the amount of core is the same, the distribution of heat generation can be made still more uniform. Furthermore, in this case, it is preferable that the core has opposing portions opposed to the heat-generating member without sandwiching the exciting coil between the opposing portion and the heat-generating member, and magnetic permeable portions opposed to the heat-generating member via the exciting coil, with the gap in the opposing portion of the core smaller than the gap in the magnetic permeable portion of the core in the direction of the rotation axis of the heat-generating member. With such a preferred configuration, since it is possible to reduce the amount of material for the magnetic permeable portion to be used with the length of the core of opposing portion defining the range of the heat-generating portion secured, it can be to make the distribution of heat generation to be uniform with a smaller amount of core material and with lower cost. Furthermore, in this case, it is preferable that the core has opposing portions opposed to the heat-generating member without sandwiching the exciting coil between the opposing portion and the heat-generating member, and magnetic permeable portions opposed to the heat-generating member via the exciting coil, with the opposing portions of the core provided continuously in the direction of the rotation axis of the heat-generating member. With such a preferred configuration, even if gaps are provided in the core of the magnetic permeable portion and are unevenly distributed, the magnetic field reaching from the opposing portion to the heat-generating member can be made uniform in the direction of the rotation axis. Thereby, while the core in the magnetic permeable portion is reduced, the distribution of the heat generation in the heat-generating member in a portion where the recording material passes through can be made uniform, and thus the temperature distribution in the fixing portion can be made uniform. Therefore, a stable fixing operation can be obtained. Furthermore, since the core of the magnetic permeable portion can be reduced while the distribution of heat generation in the heat-generating member uniform, it is possible to achieve the miniaturization of the device and the reduction of the cost. Furthermore, in this case, it is preferable that the heat-generating member is formed in the shape of pipe, and the cross-sectional area of the surface of the inside of the heat-generating member perpendicular to the rotation axis thereof is smaller than the maximum cross sectional area of the core and exciting coil. With such a preferred configuration, it is possible to use the heat-generating member having a small thermal capacity, the exciting coil having a large winding number, and the appropriate amount of ferrite (core) in combination. Therefore, it is possible to apply a larger amount of electric power to the heat-generating member with a predetermined coil current. Furthermore, in this case, it is preferable that a part of the core is divided, thereby forming a movable portion and the movable portion is held movably with respect to the rest portion of the core. Furthermore, in this case, it is preferable that the movable portion arranged outside the region in which a recording material to be used passes through and is allowed to be movable with respect to the remaining portion of the core. With such a preferred configuration, it is possible to prevent the temperature of the member such as a fixing belt, bearing and the like on the end portion from being increased beyond the withstanding temperature due to the excessive increase of the temperature of the region in which the recording material do not pass through. Furthermore, even if a large size recording material is used after small size recording materials are used continuously, since the temperature of the fixing portion is proper, the occurrence of hot offset can be prevented. Therefore, just after the small size recording materials are used, the large size recording material can be used.

Furthermore, in the first configuration of the image heating device according to the present invention, it is preferable that the image heating device further includes a shielding member made of conductive material covering at least a part of a rear face of the exciting coil. With such a preferred configuration, it is possible to prevent a high frequency electromagnetic wave generated from the exciting coil from transmitting to the inside and outside of the apparatus. Thereby, it is possible to prevent electric circuits located at the inside and outside of the apparatus from wrongly operating due to electromagnetic noise.

Furthermore, in the first configuration of the image heating device according to the present invention, it is preferable that the image heating device further includes a cooling means for cooling the exciting coil by air flow.

Furthermore, in the first configuration of the image heating device according to the present invention, it is preferable that the image heating device further includes a heat insulating member for shielding a thermal conduction between the exciting coil and the heat-generating member. With such a preferred configuration, it is possible to cool the exciting coil without cooling the heat-generating member. Furthermore, in this case, it is preferable that the image heating device further includes a core made of magnetic material arranged outside the exiting coil, wherein the length of the exciting coil along the direction of the rotation axis of the heat-generating member is shorter than the length of the heat insulating member along the direction of the rotation axis of the heat-generating member and is longer than the length of the core along the direction of the rotation axis of the heat-generating member. With such a preferred configuration, even in the case where the core is arranged in close to the heat-generating member, the temperature rise of the core can be prevented.

Furthermore, in the first configuration of the image heating device according to the present invention, it is preferable that the image heating device further includes a fixing roller and a fixing belt suspended between the fixing roller and the heat-generating member. Furthermore, in this case, it is preferable that the image heating device further includes a core made of magnetic material arranged outside the exiting coil, wherein the core has opposing portions opposed to the heat-generating member without sandwiching the exciting coil between the opposing portion and the heat-generating member, and magnetic permeable portions opposed to the heat-generating member via the exciting coil, and the length between the outermost ends of the opposing portion along the direction of the rotation axis of the heat-generating member is not longer than the width of the fixing belt. With such a preferred configuration, since the heat-generating member in the portion where heat is not removed by the fixing belt is not heated excessively, the end portion of the heat-generating member can be prevented from being heated excessively.

Furthermore, an image heating device according to a second configuration of the present invention includes a heat-generating member comprising a rotatable body having magnetism and conductivity, and an exciting coil arranged in opposition to the peripheral surface of the heat-generating member and adapted for allowing the heat-generating member to generate heat with electromagnetic induction; wherein the exciting coil composed of a bundle of wires having an insulated surface, which are extended in the direction of the rotation axis of the heat-generating member and circumferentially wound along the circumferential direction of the heat-generating member, and a larger number of bundled wires are superimposed at both ends than at the central portion in the direction of the rotation axis of the heat-generating member.

Furthermore, an image heating device according to a third configuration of the present invention includes a heat-generating member comprising a rotatable body having conductivity; and an exciting coil arranged in opposition to the peripheral surface of the heat-generating member and adapted for allowing the heat-generating member to generate heat with electromagnetic induction; wherein the image heating device further includes a core made of magnetic material arranged outside the exciting coil, and the length of the core along the direction of the rotation axis of the heat-generating member is not shorter than the width of a recording material having the maximum width in all the recording materials to be used.

Furthermore, an image heating device according to a fourth configuration of the present invention includes a heat-generating member comprising a rotatable body having conductivity; and an exciting coil arranged in opposition to the peripheral surface of the heat-generating member and adapted for allowing the heat-generating member to generate heat with electromagnetic induction; the image heating device further includes a core made of magnetic material arranged in a state in which the exciting coil is sandwiched between the core and the heat-generating member, the core has opposing portions opposed to the heat-generating member without sandwiching the exciting coil between the opposing portion and the heat-generating member, and magnetic permeable portions opposed to the heat-generating member via the exciting coil, wherein at least a part of the opposing portion is arranged in closer contact with the heat-generating member than the magnetic permeable portion, thereby forming an adjacent portion, and at least a part of the core has gaps in the direction of the rotation axis of the heat-generating member.

Furthermore, an image heating device according to a fifth configuration of the present invention includes a heat-generating member comprising a rotatable body having conductivity; and an exciting coil arranged in opposition to the peripheral surface of the heat-generating member and adapted for allowing the heat-generating member to generate heat with electromagnetic induction; the image heating device further includes a core made of magnetic material arranged in a state in which the exciting coil is sandwiched between the core and the heat-generating member, the core has opposing portions opposed to the heat-generating member without sandwiching the exciting coil between the opposing portion and the heat-generating member, and magnetic permeable portions opposed to the heat-generating member via the exciting coil, wherein the area of the portion where the opposing portion is opposed to the heat-generating member is larger than the cross sectional area of the magnetic permeable portion perpendicular to the circumferential direction of the heat-generation member. According to the fifth configuration of the image heating device, the electromagnetic coupling between the exciting coil and the heat-generating member becomes excellent, thus improving the efficiency of the heat generation. Furthermore, since magnetic fluxes generated by the coil current are concentrated on the opposing portion of the core, by making the area of the portion where the opposing portion is opposed to the heat-generating member larger than the cross sectional area of the magnetic permeable portion perpendicular to the circumferential direction of the heat-generation member, the amount of heat generation of the heat-generating member in the direction of the rotation axis can be made uniform. Furthermore, it is possible to provide the core with gaps so that the exciting coil has a portion that is not opposed to the core while securing the cross-sectional area where the magnetic fluxes penetrate. Therefore, it is possible to promote the heat radiation from the exciting coil portion and to prevent the magnetic fluxes from leaking outward.

Furthermore, an image heating device according to a sixth configuration of the present invention includes a heat-generating member comprising a rotatable body having conductivity; and an exciting coil arranged in opposition to the peripheral surface of the heat-generating member and adapted for allowing the heat-generating member to generate heat with electromagnetic induction; the image heating device further includes a core made of magnetic material arranged in a state in which the exciting coil is sandwiched between the core and the heat-generating member, wherein a part of the core is divided, thereby forming a movable portion and the movable portion is held movably with respect to the remaining portion of the core.

Furthermore, an image heating device according to a seventh configuration of the present invention includes a fixing belt; a pressure means that is pressed against the fixing belt to form a nip portion on the right side of the fixing belt: a heat-generating roller having at least a part composed of a conductive member and movably suspending the fixing belt; and an exciting coil arranged in opposition to the peripheral surface of the heat-generating roller via the fixing belt and adapted for allowing the heat-generating roller to generate heat by exciting the portion where the heat-generating roller is in contact with the fixing belt. According to the seventh configuration of the image heating device, heat is generated at the portion where the heat-generating roller is in contact with the fixing belt, and the heat is conducted to the fixing belt immediately. Thus, it is not necessary to raise the temperature of the heat-generating roller more than necessary. Consequently, the warm-up time can be shortened.

Furthermore, in the seventh configuration of the image heating device according to the present invention, it is preferable that the width of excitation in the direction in which the fixing belt moves is substantially the same as or not more than the width of the portion where the fixing belt is in contact with the heat-generating roller. With such a preferred configuration, since only the portion that is in contact with the fixing belt is heated in the heat-generating roller, and it is possible to prevent the temperature of the heat-generating roller from being raised abnormally.

Furthermore, in the seventh configuration of the image heating device according to the present invention, it is preferable that the image heating device further includes a temperature detecting means for detecting the temperature, which is arranged in contact with the surface of the heat-generating roller at a portion other than a portion where the heat-generating roller is in contact with the fixing belt; and a control means for controlling an output from the exciting coil in accordance with an output from the temperature detecting means. With such a preferred configuration, it is possible to maintain the temperature of the fixing belt at an optimum temperature.

Furthermore, in the seventh configuration of the image heating device according to the present invention, it is preferable that an exciting current having a predetermined frequency is applied to the exciting coil, and the conductive member of the heat-generating roller has a thickness equal to or larger than the skin depth defined by the material thereof and the predetermined frequency. With such a preferred configuration, at a low temperature, almost all of the induced current can be generated inside the heat-generating roller.

Furthermore, an image heating device according to an eighth configuration of the present invention includes a fixing belt; a pressure means that is pressed against the fixing belt to form a nip portion on the right side of the fixing belt; a heat-generating roller made of magnetic material whose Curie temperature is set to be a predetermined value and movably suspending the fixing belt; a conductive member provided inside the heat-generating roller; and an exciting coil arranged in opposition to the peripheral surface of the heat-generating roller via the fixing belt and adapted for allowing the heat-generating roller to generate heat by exciting the portion where the heat-generating roller is in contact with the fixing belt. According to the eight configuration of the image heating device, since heat is generated at the portion where the heat-generating roller is in contact with the fixing belt, and the heat is conducted to the fixing belt immediately, it is not necessary to raise the temperature of the heat-generating roller more than necessary. As a result, the warm-up time can be shortened.

Furthermore, in the eighth configuration of the image heating device according to the present invention, it is preferable that the conductive member is arranged adiabatically with respect to the heat-generating roller. With such a preferred configuration, heat generated at the heat-generating roller is not conducted to the conductive member easily.

Furthermore, in the eighth configuration of the image heating device according to the present invention, it is preferable that an exciting current having a predetermined frequency is applied to the exciting coil, and the heat-generating roller has a thickness equal to or larger than the skin depth defined by the material thereof and the predetermined frequency.

Furthermore, an image heating device according to a ninth configuration of the present invention includes a heat-generating member comprising a rotatable body having conductivity, and an exciting coil arranged in opposition to the outer peripheral surface of the heat-generating member and adapted for allowing the heat-generating member to generate heat with electromagnetic induction; wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place.

Furthermore, an image heating device according to a tenth configuration of the present invention includes: a heat-generating member comprising a rotatable body having conductivity, and an exciting coil arranged in opposition to the outer peripheral surface of the heat-generating member and adapted for allowing the heat-generating member to generate heat with electromagnetic induction; wherein the exciting coil composed of a bundle of wires having an insulated surface, which are extended in the direction of the rotation axis of the heat-generating member and circumferentially wound along the circumferential direction of the heat-generating member, and a larger number of bundled wires are superimposed at both ends than at the central portion in the direction of the rotation axis of the heat-generating member.

Furthermore, an image heating device according to an eleventh configuration of the present invention includes: a heat-generating member comprising a rotatable body having conductivity, and an exciting coil arranged in opposition to the outer peripheral surface of the heat-generating member and adapted for allowing the heat-generating member to generate heat with electromagnetic induction; further comprising a core made of magnetic material arranged outside the exciting coil, and the length of the core along the direction of the rotation axis of the heat-generating member is not shorter than the width of a recording material having the maximum width of all the recording materials to be used.

Furthermore, an image forming apparatus according to the present invention includes an image forming means for forming an unfixed image onto a recording material and having the unfixed image carried thereon; and a fixing device for fixing the unfixed image onto the recording material, wherein an image heating device according to the present invention is used as the fixing device.

BEST MODE FOR CARRYING OUT THE INVENTION

Hereinafter, the present invention will be described more specifically by way of embodiments.

First Embodiment

Figure 1:
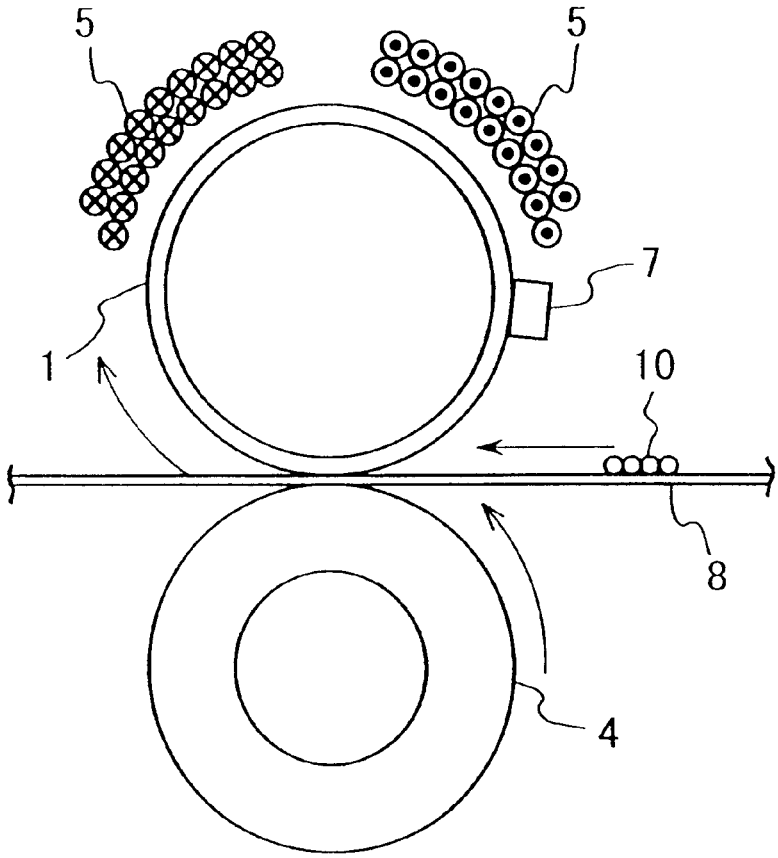
FIG. 1 is a cross-sectional view showing a fixing device as an image heating device according to a first embodiment of the present invention.
Figure 2:
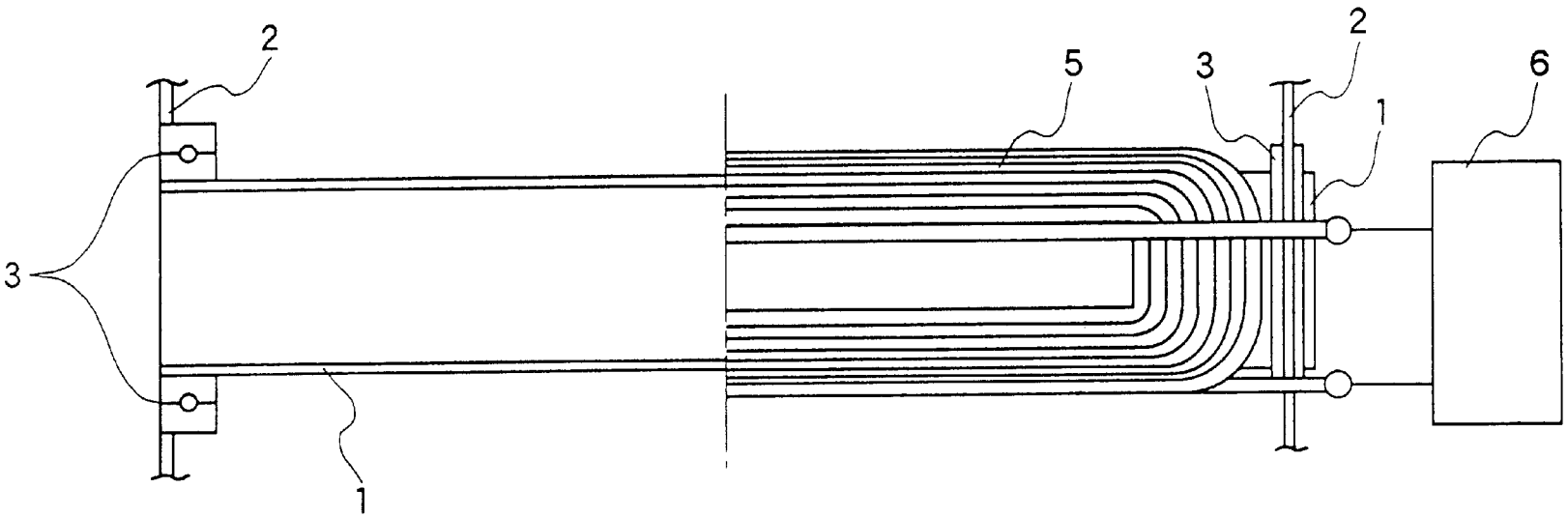
FIG. 2 is a partially cutaway plan view showing a heat-generating portion of a fixing device as an image heating device according to a first embodiment of the present invention.

FIG. 1 is a cross-sectional view showing a fixing device as an image heating device according to a first embodiment of the present invention; and FIG. 2 is a partially cutaway plan view showing a heat-generating portion of this fixing device.

In FIGS. 1 and 2, reference numeral 1 denotes a heat-generating roller as a heat-generating member, 2 denotes support side plates made of galvanized sheet iron, and 3 denotes a bearing fixed to the support side plates 2 and rotatably supporting the heat-generating roller 1 at both ends thereof. The heat-generating roller 1 is driven to be rotated by a driving means (not shown in the drawings) of the image forming apparatus main body. The heat-generating roller 1 is formed of a magnetic material, an iron—nickel—chromium alloy, and has a Curie point that is adjusted to be 300° C. or more. Furthermore, the heat-generating roller 1 is formed in a form of a pipe having a thickness of 0.3 mm.

The surface of the heat-generating roller 1 is coated with a lubricant layer (not shown in the drawings) made of fluorocarbon resin of 20 $\mu$m thickness for enhancing lubrication. For the lubricant layer, a resin or rubber having an excellent lubrication such as PTFE, PFA, FEP, a silicone rubber, a fluorocarbon rubber, etc. may be used alone or in combination. If the heat-generating roller 1 is used to fix monochrome images, it is sufficient that only the lubrication is ensured. However, if the heat-generating roller 1 is used to fix color images, it is desirable that the heat-generating roller 1 is provided with elasticity. In this case, a thicker rubber layer is required to be formed.

Reference numeral 4 denotes a pressure roller as a pressure means. This pressure roller 4 is made of silicone rubber having a hardness of JIS A65 degrees and is pressed against the heat-generating roller 1 with a pressing power of 20 kgf so as to form a nip portion. Then, in this state, the pressure roller 4 is rotated following the rotation of the heat-generating roller 1. Moreover, for materials of the pressure roller 4, a heat resistant resin or rubber such as fluorocarbon rubber other than the silicone rubber, fluorocarbon resin, etc. may be used. Furthermore, in order to enhance abrasion resistance or lubrication of the pressure roller 4, it is desirable that the surface of the pressure roller 4 is coated with a resin or rubber such as PFA, PTFE, FEP, etc. alone or in combination. Furthermore, it is desirable that the pressure roller 4 is formed of a material having a low thermal conductivity in order to avoid heat radiation.

Reference numeral 5 denotes an exciting coil as an exciting means. This exciting coil 5 is composed of a bundle of 60 copper wires of 0.2 mm diameter having an insulating surface, which are extended in the direction of the rotation axis of the heat-generating roller 1 and circumferentially wound along the circumferential direction of the heat-generating roller 1. The cross-sectional area of the bundled wire including the insulating coating is about 7 $mm^2$.

On the cross section of the exciting coil 5 perpendicular to the rotation axis of the heat-generating roller 1, the bundled wires are arranged in close contact with each other in the circumferential direction of the heat-generating roller 1, which are superimposed with a two-layer, so as to cover the upper half of the heat-generating roller 1. In this case of configuration, the neighboring bundled wires among all the bundled wires headed from one end portion of the heat-generating roller 1 toward the other end portion are arranged in close contact with each other, and the neighboring bundled wires among all the bundled wires headed from the other end portion of the heat-generating roller 1 toward the one end portion are arranged in close contact with each other.

Moreover, the bundled wires extended in the direction of the rotation axis of the heat-generating roller 1 and circumferentially wound along the circumferential direction of the heat-generating roller 1 does not necessarily begin to be wound from the portion closer to the center of winding, but the order of winding may be changed on the way.

The winding number of the exciting coil 5 is 18 in total. The surfaces of the bundled wires are adhered to each other with adhesive, thereby the shape of the exciting coil 5 shown in FIGS. 1 and 2 is maintained. Moreover, the exciting coil 5 is arranged in opposition to an outer peripheral surface of the heat-generating roller 1 with a space of about 2 mm therebetween. The range in which the exciting coil 5 is faced to the outer peripheral surface of the heat-generating roller 1 is a wide range corresponding to a circular arc having an angle of about 180° around the rotation axis as a center.

An alternating current of 30 kHz is applied to the exciting coil 5 from an exciting circuit 6, which is an antiresonant inverter. The alternating current applied to the exciting coil 5 is controlled so that the surface of the heat-generating roller 1 becomes a predetermined fixing temperature of 170° C. by a temperature signal obtained by the temperature sensor 7 provided on the surface of the heat-generating roller 1. Hereinafter, the alternating current applied to the exciting coil 5 also is referred to as a "coil current."

In this embodiment, A4 size recording paper (width: 210 mm) is used as a maximum width recording paper. The length of the heat-generating roller 1 in the direction of the rotation axis is set to be 270 mm, the length of the exciting coil 5 at the outer peripheral portion along the direction of the rotation axis of the heat-generating roller 1 is set to be 230 mm, and the length of the exciting coil 5 at the inner peripheral portion along the direction of the rotation axis of the heat-generating roller 1 is set to be 200 mm.

A recording paper 8 as a recording material carrying toner 10 on the surface thereof is inserted into the fixing device having a configuration mentioned above in the direction of the arrow, as shown in FIG. 1, thereby fixing the toner 10 on the recording paper 8.

In this embodiment, the exciting coil 5 is allowed to heat the heat-generating roller 1 with electromagnetic induction. Hereinafter, the mechanism thereof will be described with reference to FIG. 3.

Figure 3:
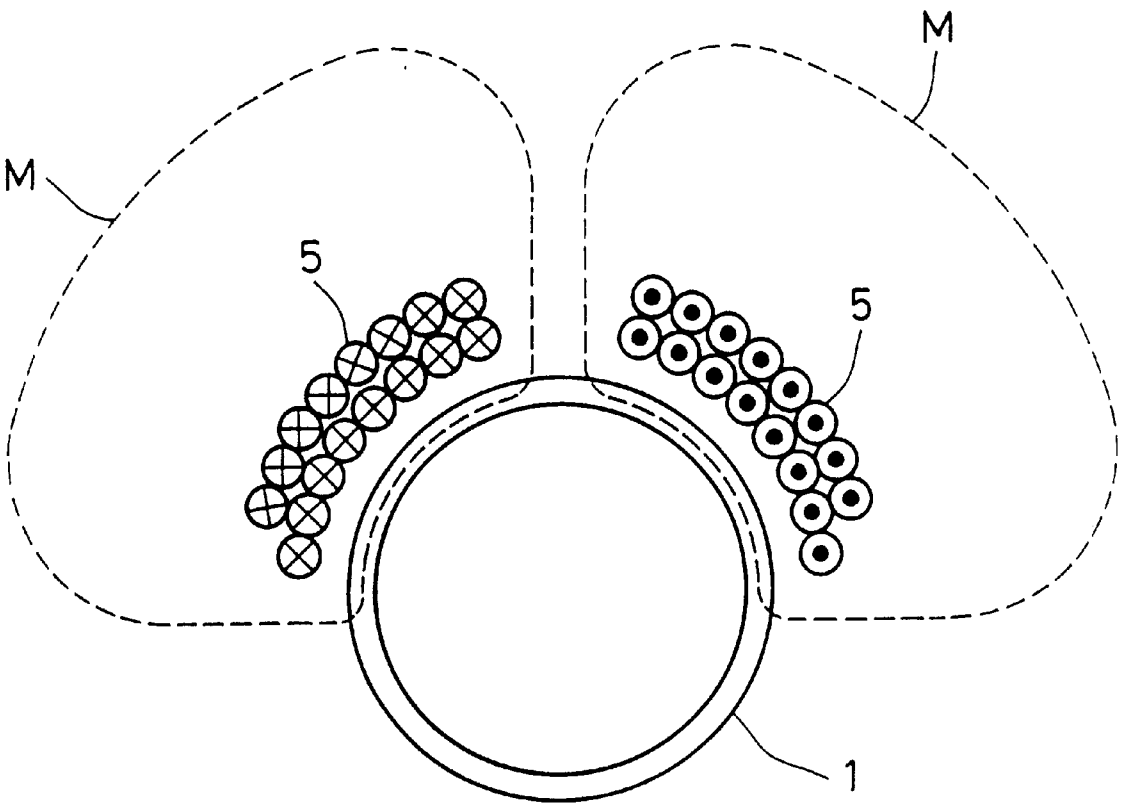
FIG. 3 is a cross-sectional view showing a heat-generating portion of a fixing device as an image heating device according to a first embodiment of the present invention.

Magnetic flux generated by the exciting coil 5 by an alternating current from the exciting circuit 6 (FIG. 2) penetrates the inside of the heat-generating roller 1 in the circumferential direction as indicated by a broken line M in FIG. 3 due to the magnetization of the heat-generating roller 1 and repeats generation and annihilation. Such changes in the state of the magnetic flux induce an induced current in the heat-generating roller 1, which mainly flows through the surface of the heat-generating roller 1 due to the skin effect, thereby causing Joule heat at the portion where it flows.

In this embodiment, the exciting coil 5 is configured so that the neighboring bundled wires among all the bundled wires headed from one end portion of the heat-generating roller 1 toward the other end portion are arranged in close contact with each other, and the neighboring bundled wires among all the bundled wires headed from the other end portion of the heat-generating roller 1 toward the one end portion are arranged in close contact with each other. Therefore, the magnetic flux does not pass through between the bundled wires. Furthermore, in the central portion of the exciting coil 5, no bundled wire is present and space is provided for magnetic flux to pass through. Therefore, as indicated by the broken line M in FIG. 3, the magnetic flux forms a large loop turning around the exciting coil 5. Furthermore, since the exciting coil 5 is provided facing to the heat-generating roller 1 in a wide range corresponding to a circular arc having an angle of about 180° around the rotation axis of the heat-generating roller 1 as a center in the circumferential direction of the heat-generating roller 1, the magnetic flux penetrates the wide range of the heat-generating roller 1. Thereby, the heat-generating roller 1 generates heat in the wide range. Thus, even if the coil current is small and the generated magnetic flux is small, it is possible to apply a predetermined electric power to the heat-generating roller 1.

As mentioned above, since there is no magnetic flux that does not penetrate the heat-generating roller 1 and passes through between the bundled wires, the electromagnetic energy provided to the exciting coil 5 is transmitted to the heat-generating roller 1 without leakage. Thus, even if the coil current is small, it is possible to apply a predetermined electric power to the heat-generating roller 1 efficiently. Furthermore, by arranging bundled wires in close contact with each other, it is also possible to miniaturize the exciting coil 5.

Furthermore, since the bundled wires of the exciting coil 5 are positioned in the vicinity of the heat-generating roller 1, the magnetic flux generated by a coil current can be transmitted to the heat-generating roller 1 efficiently. Then, the eddy current generated at the heat-generating roller 1 by this magnetic flux flows so that it cancels the change of the magnetic field due to the coil current. In this case, the coil current and the eddy current generated at the heat-generating roller 1 are close to each other, and the effect of canceling each other is great. As a result, magnetic field generated in the peripheral space by the entire current is suppressed.

Furthermore, since there is nothing to prevent heat from radiating from the outer periphery of the exciting coil 5, it is possible to prevent the insulating coating of the wires from melting due to the temperature rise by a heat storage, or the resistance value of the exciting coil 5 from rising.

Figure 4:
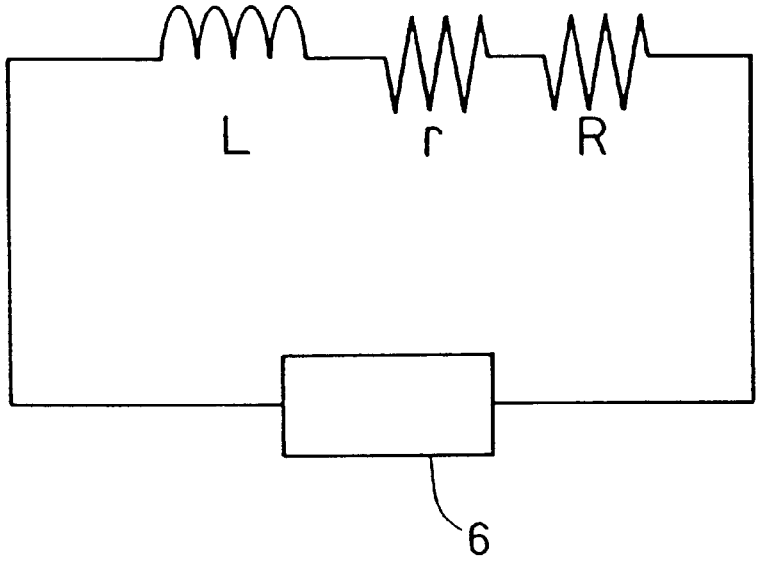
FIG. 4 is an equivalent circuit of a heat-generating portion of a fixing device as an image heating device according to a first embodiment of the present invention.

FIG. 4 shows an equivalent circuit of the exciting coil and the heat-generating roller in a state in which the exciting coil is opposed to the heat-generating roller. In FIG. 4, r denotes a resistance of the exciting coil 5 itself; R denotes a resistance due to electromagnetic coupling of the exciting coil 5 and the heat-generating roller 1 with both opposed to each other, and L denotes an impedance of the entire circuit. "r" is obtained by detaching the exciting coil 5 from the heat-generating roller 1 and measuring the electric resistance of the exciting coil 5 itself by the use of an LCR meter under the predetermined circular frequency ω. R is obtained as a value excluding r from the electric resistance in a state in which the exciting coil 5 is allowed to be opposed to the heat-generating roller 1. L is not so different from the inductance of the exciting coil 5 itself. When the current I flows in this circuit, the product of the square of the current I and the resistance value is consumed as an effective electric power so that heat is generated. The exciting coil 5 generates heat due to the electric power consumed by r; and the heat-generating roller 1 generates heat due to the electric power consumed by R. This relationship is expressed by the following formula (1) when W denotes an electric power applied to the heat-generating roller 1:

$$W=(R+r)\times I^2 \tag{1}$$

Furthermore, when V denotes a voltage applied to the exciting coil 5, the following formula (2) is satisfied:

$$I=V/\{(R+r)^2+(\omega L)^2\} \tag{2}$$

As is known from the above-mentioned formula (2), when L and R are too large, sufficient current I cannot be obtained under a constant voltage V. Therefore, as is known from the above-mentioned formula (1), the electric power applied to the heat generating roller 1 is lacking, so that a sufficient amount of heat generation cannot be obtained. On the contrary, if R is too small, even if the current I flows, the effective electric power is not consumed, and therefore, a sufficient amount of heat generation cannot be obtained. Furthermore, when L is too small, the exciting circuit 6 that is an antiresonant inverter does not operate satisfactorily. In the case where the frequency of the alternating current applied from the exciting circuit 6 to the exciting coil 5 is in the range from 25 kHz to 50 kHz, R may be not less than 0.5 Ω nor more than 5 Ω, and L may be not less that 10 μH nor more than 50 μH. In this case, the exciting circuit 6 can be configured by the circuit element having not such a high breakdown current and breakdown voltage, and a sufficient electric power applied to the heat-generating roller 1 and a sufficient amount of heat generation can be obtained. Furthermore, as long as the values R and L are within this range, the same effect can be obtained even if the specification of the exciting coil 5, for example, the winding number of the exciting coil 5, a space between the exciting coil 5 and the heat-generating roller 1, and the like, are changed.

Moreover, in this embodiment, as mentioned above, although the bundled wire of the exciting coil 5 is formed by bundling 60 wires each having 0.2 mm diameter, the configuration of the bundled wire is not limited to this alone. However, it is desirable that 50 to 200 wires each having 0.1 mm to 0.3 mm diameter are bundled to form a bundled wire. If the diameter of the wire is less than 0.1 mm, the wire may be broken due to the mechanical load. On the other hand, if the diameter of the wire is more than 0.3 mm, the electric resistance (r in FIG. 4) with respect to high frequency alternating current becomes large, and the amount of heat generation of the exciting coil 5 is excessively large. Furthermore, if the number of the wires constituting the bundled wire is less than 50, the cross sectional area becomes small, so that the electric resistance becomes large, and thus the exciting coil 5 generates excessive heat. On the other hand, if the number of the wires constituting a bundled wire is more than 200, the bundle becomes thick, which makes it difficult to wind the exciting coil 5 into an arbitrary shape, and also difficult to obtain a predetermined winding number in the predetermined space. By setting the diameter of the bundled wire at approximately 5 mm or less, the above-mentioned problems can be avoided. Thereby, since it is possible to increase the winding number of the exciting coil 5 in a small space, the necessary electric power can be applied to the heat-generating roller 1 with the exciting coil 5 miniaturized.

The circumferentially winding bundled wires of the exciting coil 5 may be partially spaced from each other. However, it is more efficient that most of the bundled wires are arranged in close contact with each other. Furthermore, the circumferentially winding bundled wires of the exciting coil 5 may be configured by partially varying the way of superimposing. However, when the exciting coil 5 is lower in height, more electric power can be applied to the heat-generating roller 1 with a smaller electric current. As the shape of the exciting coil 5, it is desirable that the width of the exciting coil 5 circumferentially wound along the circumferential direction of the heat-generating roller 1 (the length in the circumferential direction) is larger than the height of the exciting coil 5 (thickness of the superimposed bundled wires).

Furthermore, when the length of the exciting coil 5 in the direction of the rotation axis of the heat-generating roller 1 is longer than the length of the heat-generating roller 1, the magnetic flux penetrates the conductive member at the end portion of the heat-generating roller 1, for example, the side plate 2. Therefore, the surrounding constituent members generate heat, and the transmission rate of the electromagnetic energy to the heat-generating roller 1 is reduced. In this embodiment, the length of the heat-generating roller 1 is longer than the length of the exciting coil 5 in the direction of the rotation axis of the heat-generating roller 1. Therefore, the magnetic flux generated by the coil current does not reach the surrounding constituent member such as the side plate 2, and most of the magnetic fluxes reach the heat-generating roller 1. Thereby, electromagnetic energy provided to the exciting coil 5 can be transmitted to the heat-generating roller 1 efficiently. In particular, when the magnetic flux passes through from the end face of the heat-generating roller 1 in the direction of the rotation axis, the density of the eddy current at the end face of the heat-generating roller 1 is increased. In this case, the amount of heat generation at the end face of the heat-generating roller 1 becomes too large.

In this embodiment, as mentioned above, the length of each part in the direction of the rotation axis of the heat-generating roller 1 is increased in the following order; the internal periphery portion of the exciting coil 5, the maximum width recording paper, the outer periphery portion of the exciting coil 5, and the heat-generating roller 1. Furthermore, the bundled wires of the exciting coil 5 are extended in the direction of the rotation axis of the heat-generating roller 1 in parallel and uniformly at the portion where the recording paper 8 passes through. Therefore, it is possible to make the distribution of heat generation of the heat-generating roller 1 to be uniform in the portion where the recording paper 8 passes through. As a result, it is possible to make the temperature distribution at the fixing portion to be uniform, and thus the stable fixing operation can be obtained.

Second Embodiment

Figure 5:
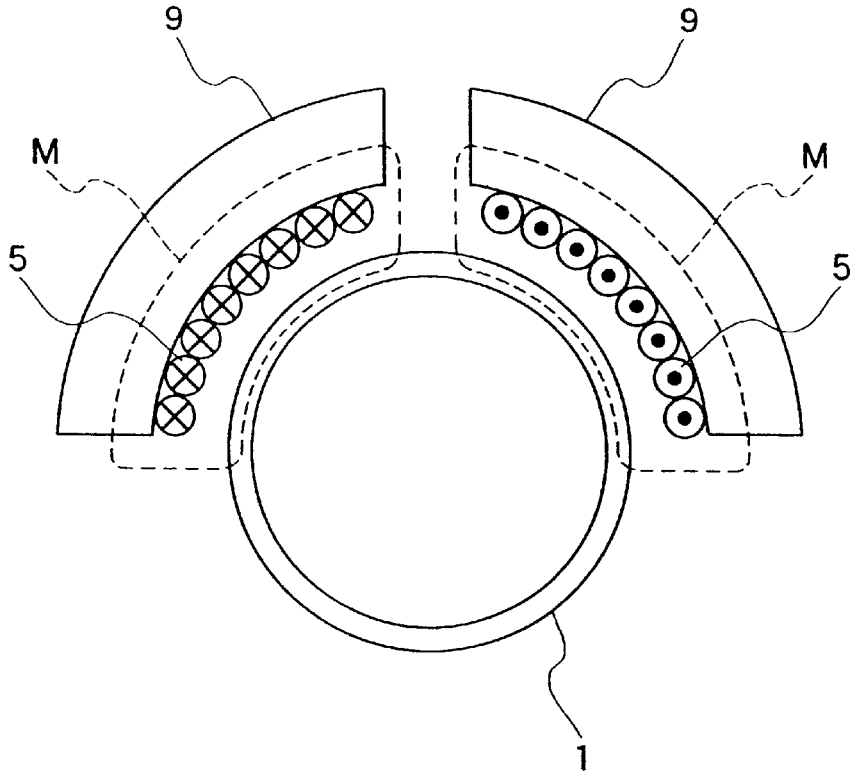
FIG. 5 is a cross-sectional view showing a heat-generating portion of a fixing device as an image heating device according to a second embodiment of the present invention.
Figure 6:
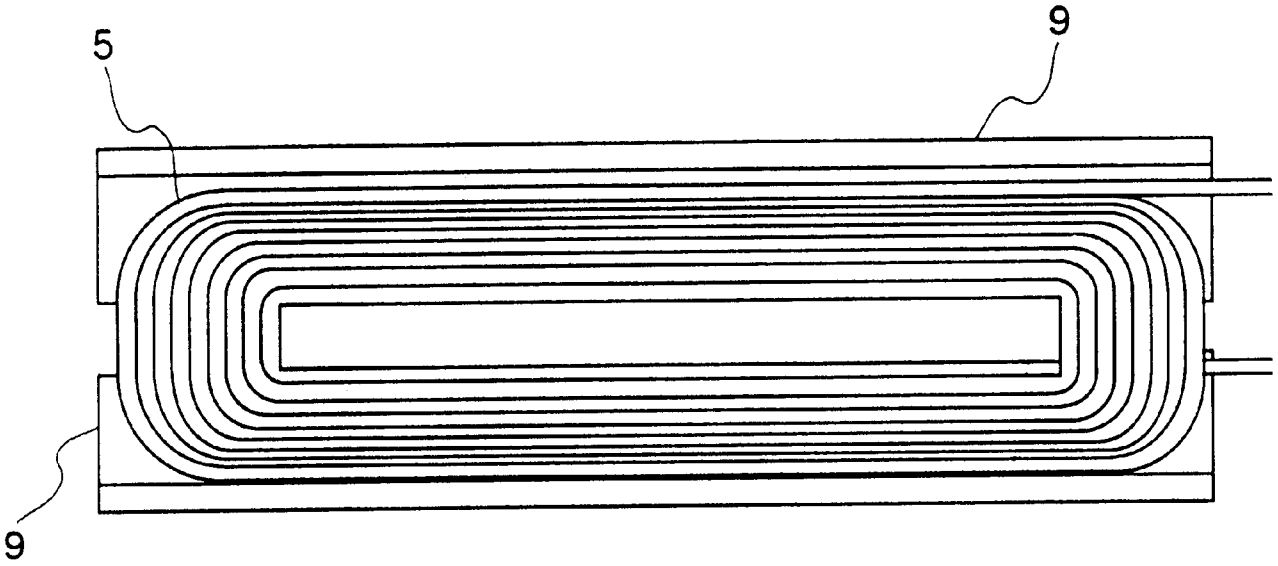
FIG. 6 is a bottom view showing a heat-generating portion excluding a heat-generating roller of a fixing device as an image heating device according to a second embodiment of the present invention.

FIG. 5 is a cross-sectional view showing a heat-generating portion of a fixing device as an image heating device according to a second embodiment of the present invention. FIG. 6 is a bottom view showing a heat-generating portion excluding a heat-generating roller in the fixing device according to a second embodiment of the present invention. In this embodiment, members having the same configuration and the same function as in the first embodiment are provided with the same numerals and the explanations therefor are omitted.

This embodiment is different from the first embodiment in that the bundles are circumferentially wound along the circumferential direction of the heat-generating roller 1 without superimposing bundles in the form of two layer and a pair of rear face cores 9 are provided on the rear side of the exciting coil 5.

As a material for the rear face core 9, ferrite having a relative permeability of 1000 to 3000, a saturation magnetic flux density of 200 mT to 300 mT, and a volume resistivity of 1 Ω·m to 10 Ω·m is used. As the material for the rear face core 9, in addition to ferrite, a material having a high magnetic permeability and high resistivity, for example, Permalloy, etc. can be used.

The cross section of the rear face core 9 has a shape obtained by cutting the cylinder having an outer diameter of 36 mm and thickness of 5 mm with an angle at about 90° in the direction of axis. Therefore, the cross sectional area of the rear face core 9 is 243 $mm^2$. Furthermore, the cross-sectional area of the exciting coil 5 is 7 $mm^2 \times 9$ windings$\times 2 = 126$ $mm^2$.

The heat-generating roller 1 is formed in a pipe form having an outer diameter of 20 mm and the thickness of the 0.3 mm. Therefore, the cross sectional area of the surface perpendicular to the rotation axis inside the heat-generating roller 1 is about 295 $mm^2$. Therefore, the cross sectional area of the exciting coil 5 including the rear face core 9 is larger than the cross-sectional area of the surface perpendicular to the rotational axis inside the heat-generating roller 1. The space between the rear face core 9 and the heat-generating roller 1 is 5.5 mm.

Furthermore, in this embodiment, as recording paper having a maximum width, A4 size recording paper (width: 210 mm) is used. The length of the heat-generating roller 1 in the direction of the rotation axis is set to be 240 mm, the length of the outer periphery portion of the exciting coil 5 along the direction of the rotation axis of the heat-generating roller 1 is set to be 200 mm, the length of the inner peripherial portion of the exciting coil 5 along the direction of the rotation axis of the heat-generating roller 1 is set to be 170 mm, and the length of the rear face core 9 along the direction of the rotation axis of the heat-generating roller 1 is set to be 220 mm. A bearing 3 (see FIG. 2) serving as a support member of the heat-generating roller 1 is made of steel that is a magnetic material. The space between the bearing 3 and the rear face core 9 is 10 mm, which is larger than the space between the rear face core 9 and the heat-generating roller 1.

Other configurations are the same as in the first embodiment.

Hereinafter, an operation of the fixing device configured as mentioned above will be described.

By providing the rear face core 9, the inductance of the exciting coil 5 is increased and the electromagnetic coupling between the exciting coil 5 and the heat-generating roller 1 becomes excellent. Consequently, R in the equivalent circuit of FIG. 4 becomes large. Therefore, it is possible to apply a larger amount of electric power to the heat-generating roller 1 with the same coil current. Therefore, by the use of an inexpensive exciting circuit 6 having low breakdown current and breakdown voltage (see FIG. 2), it is possible to provide a fixing device with a short warm-up time.

Furthermore, as shown by a broken line M in FIG. 5, all of the magnetic flux at the rear face side of the exciting coil 5 penetrates the inside of the rear face core 9, and it is possible to prevent the magnetic flux from leaking out backward. As a result, it is possible to prevent the heat generation due to the electromagnetic induction of the peripheral conductivity material and at the same time to prevent the unnecessary radiation of electromagnetic wave.

Furthermore, since the circumferentially wound bundled wires are not superimposed onto each other, all of the bundled wires of the exciting coil 5 are located in the vicinity of the heat-generating roller 1. Therefore, a magnetic flux generated by the coil current can be transmitted to the heat-generating roller 1 further efficiently.

In this embodiment, since the exciting coil 5 and the rear face core 9 are provided outside the heat-generating roller 1 (heat-generating portion), it is possible to prevent the temperature of the exciting coil 5, etc. from being increased due to the temperature of the heat-generating portion. Therefore, it is possible to maintain the amount of the heat generation stably. In particular, since the exciting coil 5 and the rear face core 9 having a larger cross sectional area than that of the surface perpendicular to the rotational axis inside the heat-generating roller 1 are used, it is possible to use a combination of the heat-generating roller 1 having a small thermal capacity, the exciting coil 5 whose winding number is many, and an appropriate amount of ferrite (the rear face core 9). Therefore, it is possible to apply much more electric power to the heat-generating roller 1 with a predetermined coil current while suppressing the thermal capacity of the fixing device.

In this embodiment, as mentioned above, the length of each part in the direction of the rotation axis of the heat-generating roller 1 is increased in the following order; the internal peripheral portion of the exciting coil 5, the outer peripheral portion of the exciting coil 5, the maximum width recording paper, the rear face core 9, and the heat-generating roller 1. Like this, the length of the outer peripheral portion of the exciting coil 5 along the direction of the rotation axis of the heat-generating roller 1 is set to be smaller than the width of the maximum width recording paper, while the length of the rear face core 9 along the direction of the rotation axis of the heat-generating roller 1 is set to be larger than the width of the maximum width recording paper. Therefore, even if the exciting coil 5 is wound somewhat nonuniformly, it is possible to make the magnetic field reaching from the exciting coil 5 to the heat-generating roller 1 to be uniform in the direction of the rotation axis of the heat-generating roller 1. Therefore, it is possible to make the distribution of heat generation of the heat-generating roller 1 to be uniform in the portion where the recording paper passes through. Thereby, it is possible to make the temperature distribution at the fixing portion to be uniform, and thus the stable fixing operation can be obtained. Furthermore, it is possible to shorten the length of the heat-generating roller 1 in the direction of the rotation axis thereof and the length of the exciting coil 5 along the direction of the rotation axis of heat-generating roller 1 while making the distribution of heat generation of the heat-generating roller 1 to be uniform, it is possible to realize a miniaturization of the device and at the same time to reduce the cost. Furthermore, since the length of the rear face core 9 along the direction of the rotation axis of the heat-generating roller 1 is shorter than the length of the heat-generating roller 1 in the direction of the rotation axis thereof, it is possible to prevent the eddy current density at the end face of the heat-generating roller 1 from being increased and the heat generation at the end face of the heat-generating roller 1 from being excessively increased.

Furthermore, as mentioned above, as the bearing 3 (see FIG. 2) that is a support member of the heat-generating roller 1, in order to secure the mechanical strength, steel having a magnetism generally is used. Therefore, the magnetic flux generated by the coil current is attracted by the bearing 3 easily. Thus, heat is generated when the magnetic flux penetrates the bearing 3. Therefore, the rate of transmitting the electromagnetic energy to the heat-generating roller 1 is reduced, and at the same time, the temperature of the bearing 3 is increased, to thus shorten the life of the bearing 3. In this embodiment, as mentioned above, since the space between the bearing 3 and the end face of the rear face core 9 is set to be larger than the facing space between the rear face core 9 and the heat-generating roller 1, the magnetic flux penetrating the rear face core 9 is not led to the bearing 3. Most of them penetrate the heat-generating roller 1. Thereby, it is possible to transmit the electromagnetic energy provided to the exciting coil 5 to the heat-generating roller 1 efficiently and at the same time to prevent heat from radiating to from the bearing 3.

It is satisfactory that the space between the bearing 3 and the rear face core 9 (in this embodiment 10 mm) is larger than the facing space between the rear face core 9 and the heat-generating roller 1 (in this embodiment 5.5 mm). It is desirable that the former space is two times larger than the latter space.

Furthermore, since the thickness of the rear face core 9 is uniform, the heat is not stored locally inside the rear face core 9. Furthermore, since there is nothing to prevent heat from radiating from the outer peripheral portion of the rear face core 9, it is possible to prevent the entire magnetic permeability from rapidly reducing due to the reduction of the saturation magnetic flux density of the rear face core 9 by temperature rise by the heat storage. Thereby, the temperature of the heat-generating roller 1 can be maintained stably at the predetermined temperature for a long time.

Third Embodiment

Figure 7:
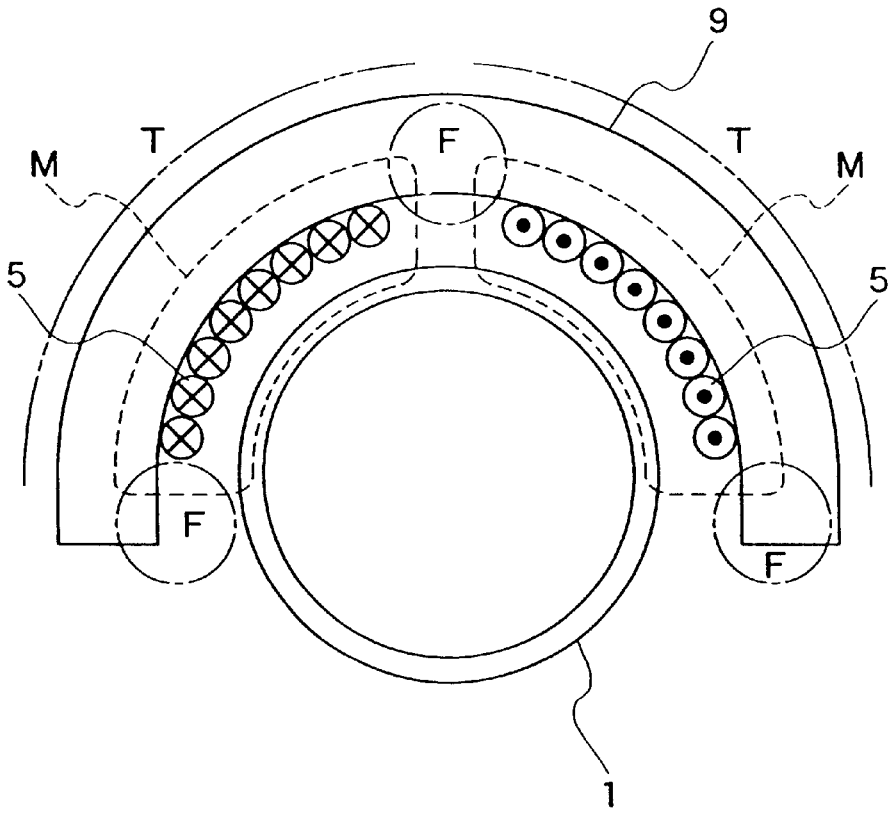
FIG. 7 is a cross-sectional view showing a heat-generating portion of a fixing device as an image heating device according to a third embodiment of the present invention.

FIG. 7 is a cross-sectional view showing a heat-generating portion of a fixing device as an image heating device according to a third embodiment of the present invention. In this embodiment, members having the same configuration and the same function as in the second embodiment are provided with the same numerals and the explanations therefor are omitted.

This embodiment is different from the second embodiment in that, as shown in FIG. 7, the rear face core 9 is extended to the range in which the exciting coil 5 is not present and an "opposing portion F" is opposed to the heat-generating roller 1 without sandwiching the exciting coil 5 between the rear face core 9 and the heat-generating roller 1. Hereinafter, the portion that is opposed to the heat-generating roller 1 via the exciting coil 5 in the rear face core 9 will be referred to as a "magnetic permeable portion T". Moreover, the cross section of the rear face core 9 has a shape in which the cylinder is cut off in the axis direction with an angle of 180°.

In this case, the magnetic path can be composed of more ferrite (rear face core 9). Therefore, an air portion having a low magnetic permeability in which the magnetic flux generated by the coil current passes through is limited to the narrow gap portion between the heat-generating roller 1 and the rear face core 9. Accordingly, the inductance of the exciting coil 5 is increased, and almost all of the magnetic fluxes generated by the coil current can be led to the heat-generating roller 1. As a result, it is possible to obtain an excellent electromagnetic coupling between the heat-generating roller 1 and the exciting coil 5, and R in the equivalent circuit of FIG. 4 is larger. Thereby, more electric power can be applied to the heat-generating roller 1 even with the same coil current.

Furthermore, as shown by a broken line M in FIG. 7, the magnetic flux led from the rear face core 9 to the heat-generating roller 1 passes through the opposing portion F. The length of the opposing portion F along the direction of the rotation axis of the heat-generating roller 1 is the same as the length of the rear face core 9 along the direction of the rotation axis of the heat-generating roller 1, and is longer than the width of the recording paper. Therefore, in the portion where the recording paper passes, the magnetic flux enters uniformly from the opposing portion F. Therefore, it is possible to heat uniformly the range necessary to fixation of the heat-generating roller 1.

Figure 8:
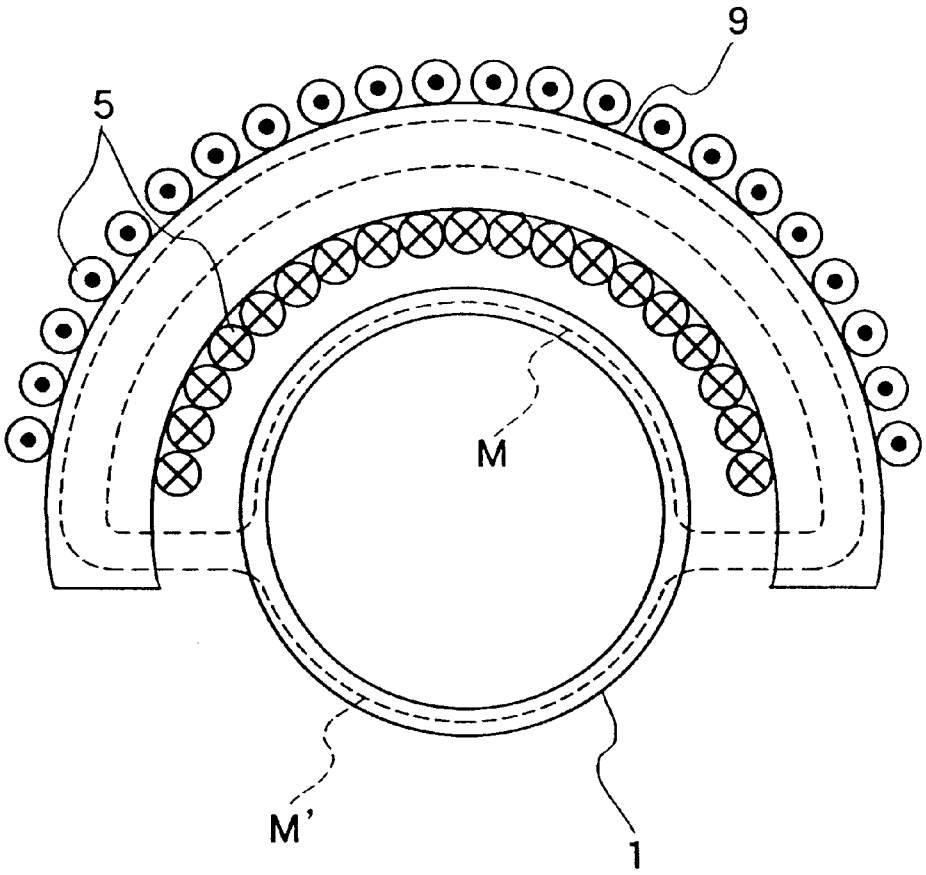
FIG. 8 is a cross-sectional view showing another example of a heat-generating portion of a fixing device as an image heating device according to a third embodiment of the present invention.

In this embodiment, the exciting coil 5 is arranged at the opposite side to the heat-generating roller 1 of the rear face core 9. However, as shown in FIG. 8, the exciting coil 5 may be configured by extending and circumferentially winding the bundled wires in the axis direction of the semicylindrical rear face core 9 and winding the bundled wires along the circumferential direction of the rear face core 9. In this case, the magnetic flux generated by the coil current permeates not only the side of the exciting coil 5 of the heat-generating roller 1 but also the side of the pressure roller of the heat-generating roller 1 (see a broken line M' in FIG. 8). As a result, the entire generating roller 1 is heated. Therefore, it is possible to increase the entire amount of heat generation with the same coil current. Furthermore, since the cross sectional area where the magnetic flux penetrates is increased, even if more magnetic flux is allowed to penetrate the heat-generating roller 1, the magnetic flux is not beyond the saturation magnetic flux density of the heat-generating roller 1. Therefore, since it is possible to prevent the magnetic flux from passing through a space other than the heat-generating roller 1, the heat-generating roller 1 is heated efficiently with electromagnetic induction.

Fourth Embodiment

Figure 9:
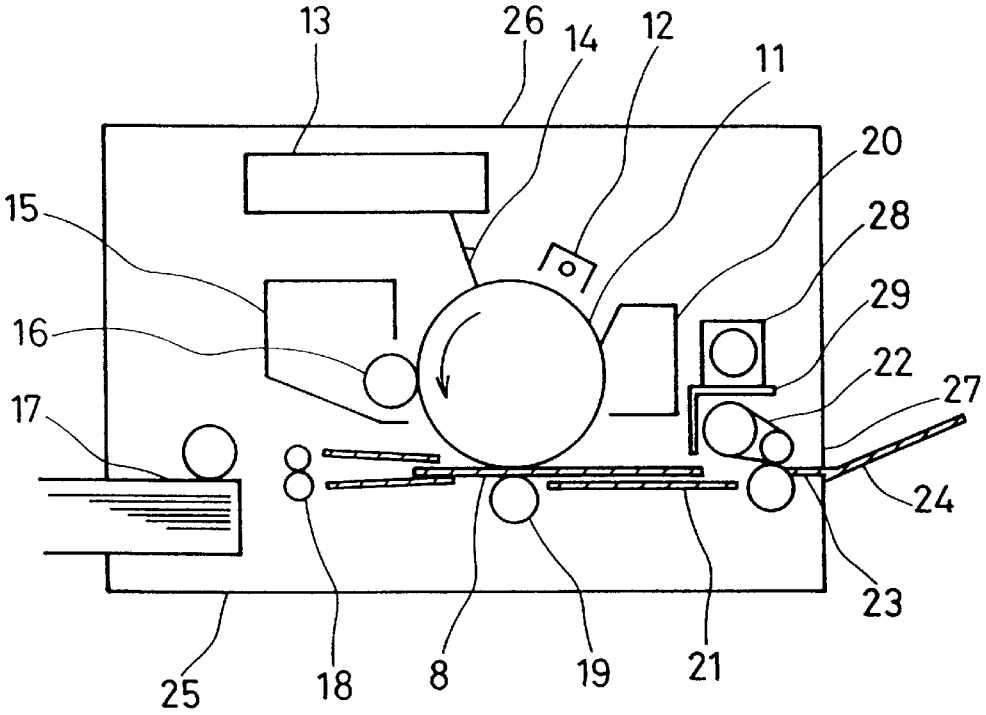
FIG. 9 is a cross-sectional view showing an image forming apparatus using an image heating device as a fixing device according to a fourth embodiment of the present invention.
Figure 10B:
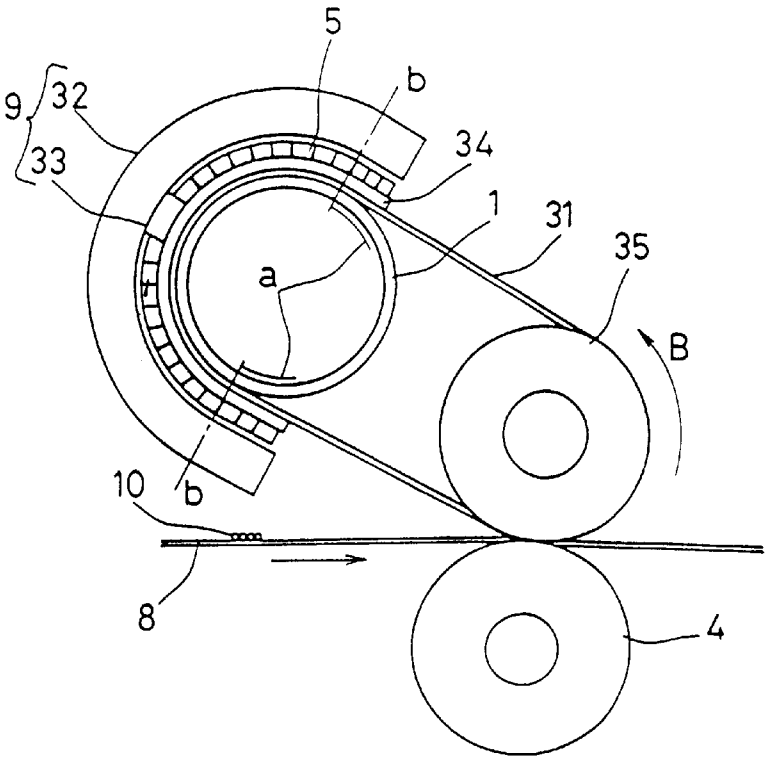
FIG. 10B is a cross-sectional view showing another example of a fixing device as an image heating device according to a fourth embodiment of the present invention.
Figure 10A:
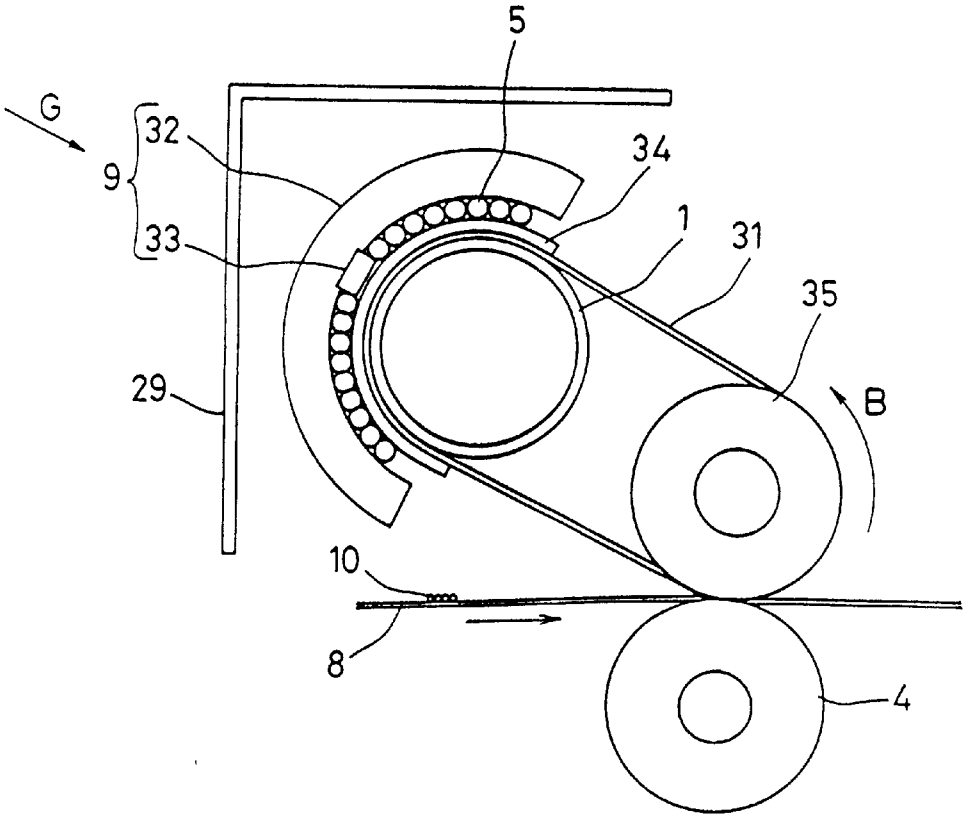
FIG. 10A is a cross-sectional view showing a fixing device as an image heating device according to a fourth embodiment of the present invention.
Figure 11:
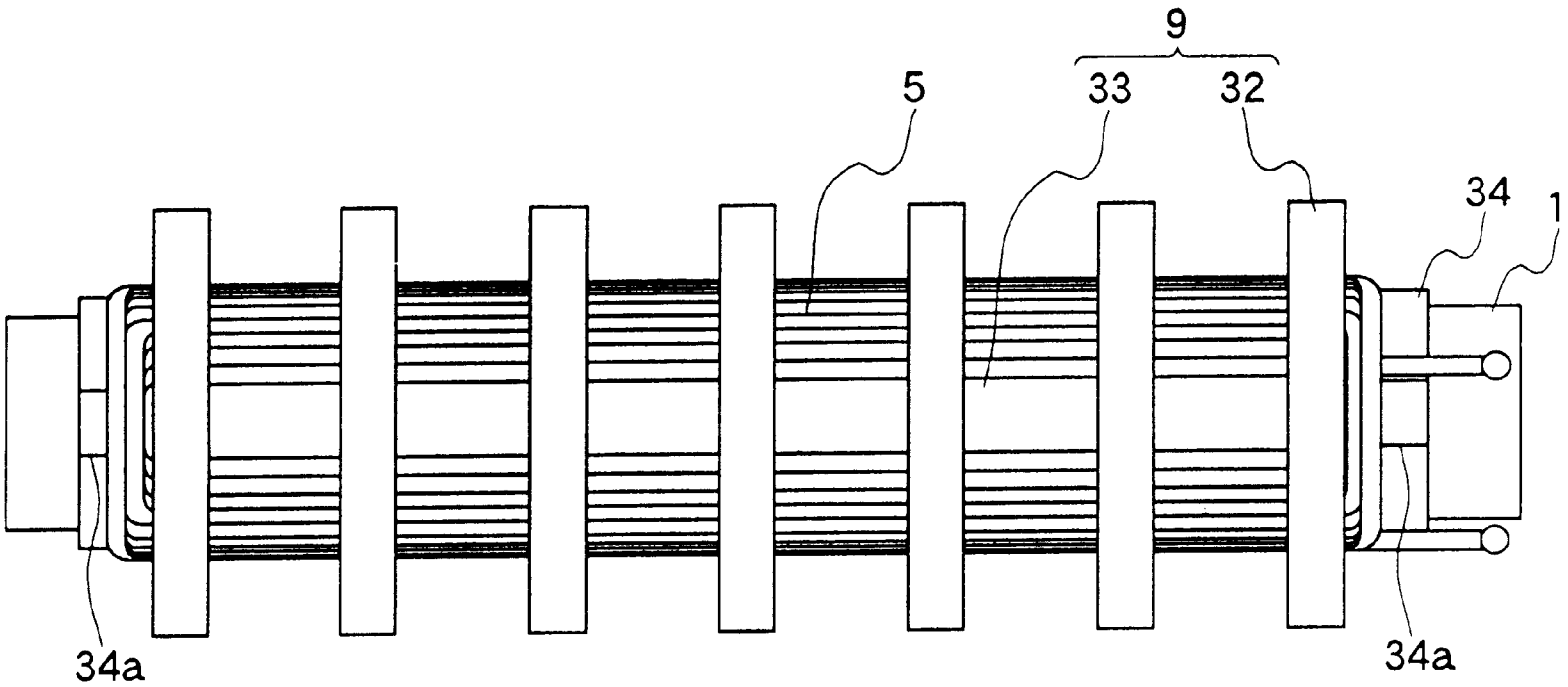
FIG. 11 is a projection plan view showing the heat-generating portion in FIG. 10A as viewed from the direction of the arrow G.
Figure 12:
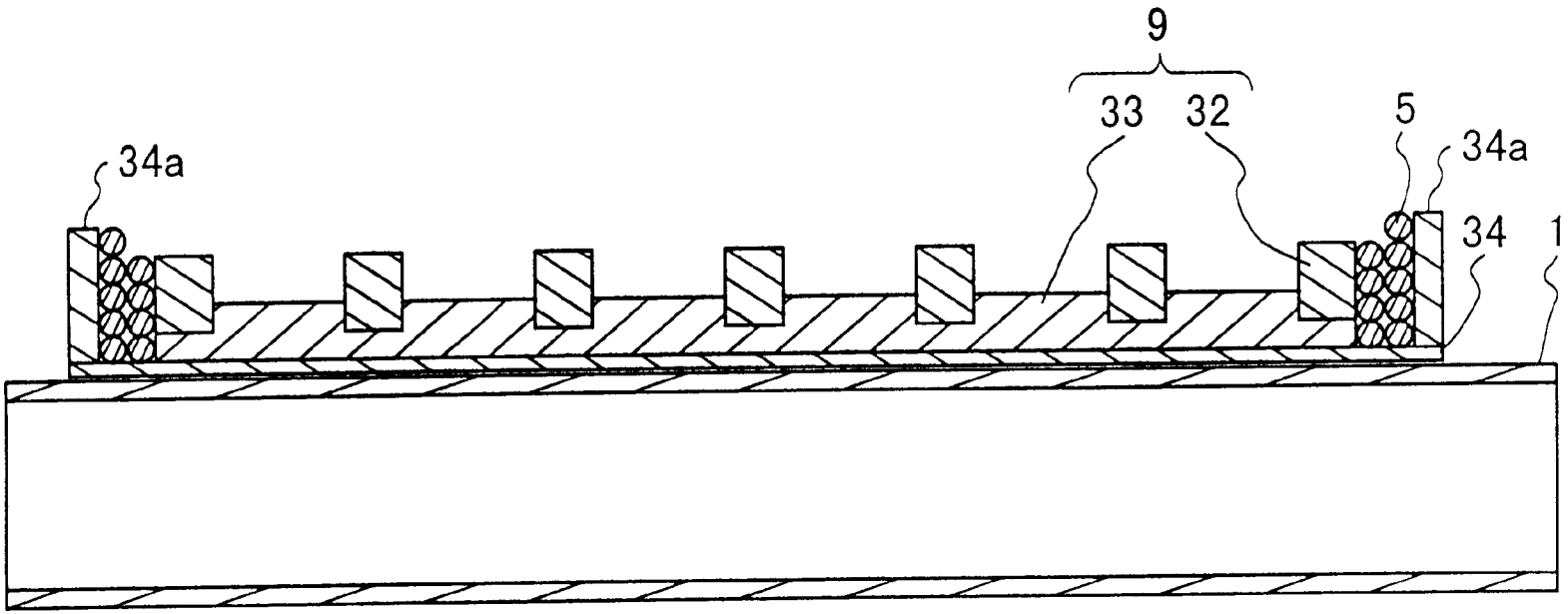
FIG. 12 is a cross-sectional view showing a heat-generating portion in a surface including a rotation axis of a heat-generating roller of a fixing device as an image heating device and the center of an exciting coil according to a fourth embodiment of the present invention.

FIG. 9 is a cross-sectional view showing an image forming apparatus using an image heating device as a fixing device according to a fourth embodiment of the present invention; FIG. 10A is a cross-sectional view showing a fixing device as an image heating device according to a fourth embodiment of the present invention; FIG. 11 is a projection plan view showing the heat-generating portion in FIG. 10A as viewed from the direction of the arrow G; and FIG. 12 is a cross-sectional view showing a heat-generating portion in a surface including a rotation axis of a heat-generating roller and the center of a exciting coil.

In FIG. 9, reference numeral 11 denotes an electrophotographic photoreceptor (hereinafter referred to as "photosensitive drum"). While this photosensitive drum 11 is rotationally driven at the predetermined peripheral speed in the arrow direction, its surface is charged homogeneously to a negative dark potential VO by a charger 12. Reference numeral 13 denotes a laser beam scanner. The laser beam scanner outputs a laser beam 14 modulated in accordance with a time-series electric digital pixel signal of image information input from a host device (not shown in the drawings) such as an image reading device or a computer etc. The surface of the charged photosensitive drum 11 is scanned and exposed by this laser beam 14. Thereby, in the exposed portion of the photosensitive drum 11, the absolute potential is decreased to the light potential VL, and thus an electrostatic latent image is formed. This latent image is developed with negatively charged toner using a developing device 15 and made manifest.

The developing device 15 is provided with a developing roller 16 that is driven to be rotated. The developing roller 16 is opposed to the photosensitive drum 1. On an outer peripheral surface of the developing roller 16, a thin layer of toner is formed. A developing bias voltage, whose absolute value is lower than the dark potential VO and higher than the light potential VL of the photoelectric drum 1, is applied to the developing roller 16. The toner on the developing roller 16 is thus transferred only to the portion of the photosensitive drum 11 with the light potential VL, whereby the electrostatic latent image is made manifest.

On the other hand, recording paper 8 is fed one by one from a paperfeed portion 17 to a nip portion formed between the photosensitive drum 11 and a transfer roller 19 via a resist roller pair 18 with suitable timing in synchronization with the rotation of the photosensitive drum 11. Then, the toner image on the photosensitive drum 11 is transferred sequentially to the recording paper 8 by the transfer roller 19 to which a transfer bias is applied. After the recording paper 8 has separated from the photosensitive drum 11, the surface of the photosensitive drum 11 is cleaned with a cleaning device 20, which removes residual material such as remaining toner so that the photosensitive drum 11 can be used repeatedly for subsequent image formation.

Reference numeral 21 denotes a paper fixing guide, which guides the recording paper 8 on which the toner image has been transferred to a fixing device 22. After the recording paper 8 carrying the transferred toner image has separated from the photosensitive drum 11, it is fed to the fixing device 22, thus fixing the transferred toner image onto the recording paper 8. Reference numeral 23 denotes a paper eject guide, which guides the recording paper 8 that has passed through the fixing device 22 to the outside of the image forming apparatus. These paper fixing guide 21 and paper eject guide 23 may be made of resin such as ABS, etc. These paper fixing guide 21 and paper eject guide 23 are also made of non-magnetic metallic material such as aluminum, etc. The recording paper 8, after the toner image has been fixed, is then discharged to a paper eject tray 24.

Reference numeral 25 denotes a bottom plate of the image forming apparatus main body, 26 denotes a top plate of the image forming apparatus main body, and 27 denotes a main body chassis. These members provide strength for the image forming apparatus main body in combination. These members are made of galvanized material, which comprises a steel that is a magnetic material as a base.

Reference numeral 28 denotes a cooling fan, which generates an air stream inside the apparatus. Reference numeral 29 denotes a coil cover that serves as a shielding member made of non-magnetic metallic material such as aluminum. This coil cover 29 is formed so as to cover the rear face core 9 of the exciting coil 5 (see FIG. 10A).

Next, a fixing device as an image heating device of this embodiment will be described in detail.

In FIG. 10A, a thin fixing belt 31 is an endless belt of 50 mm diameter and 100 $\mu$m thickness, which includes polyimide resin as a base. The surface of the fixing belt 31 is coated with a lubricant layer (not shown in the drawings) made of fluorocarbon resin of 20 $\mu$m thickness, for enhancing lubrication. For the base material, in addition to a material having a heat resistance, such as polyimide resin, fluorocarbon resin, or the like, an extremely thin metal made of electroforming nickel etc. may be used. Furthermore, for the lubricant layer, resin or rubber having an excellent lubrication such as PTFE, PFA, FEP, a silicone rubber, a fluorocarbon rubber, etc. may be used alone or in combination. If the fixing belt 31 is used to fix monochrome images, only lubrication has to be ensured. However, if the fixing belt 31 is used to fix color images, it is desirable that the fixing belt 31 is provided with elasticity. In this case, it is necessary to form a thicker rubber layer.

The exciting coil 5 as an exciting means is composed of a bundle of 60 copper wires of a 0.2 mm diameter having an insulated surface, which are extended along the rotation axis of the heat-generating roller 1 and circumferentially wound along the circumferential direction of the heat-generating roller 1. The cross sectional area of the bundled wire including the insulating coating is about 7 $mm^2$.

As shown in FIG. 10A to FIG. 12, the exciting coil 5 has a cross-section so as to cover the fixing belt 31 that is wound around the heat-generating roller 1. In this case, the exciting width of the exciting coil 5 in the direction in which the fixing belt 31 moves is not more than the range in which the fixing belt 31 is in contact with the heat-generating roller 1 (the range of winding). In the heat-generating roller 1, if a portion where the heat is not removed by the fixing belt 31 generates heat, the temperature of the heat-generating roller 1 easily rises beyond the withstanding temperature of the material of the fixing belt 31. However, according to the configuration of this embodiment, in the heat-generating roller 1, only the portion where the fixing belt 31 is in contact with the heat-generating roller 1 generates heat, it is possible to prevent the temperature of the heat-generating roller 1 from increasing abnormally. Furthermore, the bundled wires are superimposed only at the both end portions of the exciting coil 5 (both end portions in the direction of the rotation axis of the heat-generating axis 1) and circumferentially wound nine times in state in which they are arranged in close contact with each other along the circumferential direction of the heat-generating roller 1. The both end portion of the exciting coil 5 in the direction of the rotational axis of the heat-generating roller 1 are risen up in a state in which the bundled wires are superimposed in two rows. In other words, the exciting coil 5 is formed in a shape of saddle as a whole. Therefore, it is possible to heat the heat-generating roller 1 uniformly in a wider range in the direction of the rotation axis thereof. Moreover, since the bundled wire that are superimposed at the both end portions of the exciting coil 5 is apart from the heat-generating roller 1 by an increasing distance, it is possible to prevent the temperature of both end portions of the heat-generating roller 1 from increasing too high locally due to the concentration of an eddy current.

The rear face core 9 includes a C-shaped core 32 and a center core 33. The C-shaped core 32 has a width of 10 mm, and the seven C-shaped cores 32 are arranged with an interval of 25 mm in the direction of the rotation axis of the heat-generating roller 1. According to this configuration, it is possible to capture magnetic flux that leaks to the outside. Furthermore, the center core 33 is located in the center of the winding of the exciting coil 5 and forms a convex portion with respect to the C-shaped core 32. That is, the center core 33 makes an adjacent portion N to the heat-generating roller 1 in the opposing portion F of the rear face core 9 (see FIG. 13). The center core 33 has a cross-sectional area of 3 mm×10 mm.

In addition, the center core 33 may be divided into several portions in the direction of the rotation axis of the heat-generating roller 1 for facilitating the manufacturing process of ferrite. Furthermore, the center core 33 may be integrated into the C-shaped core 32. Furthermore, the center core 33 may be integrated into the C-shaped core 32 and divided into several portions in the direction of the rotation axis of the heat-generating roller 1.

Reference numeral 34 denotes a heat insulating member of 1 mm thickness made of resin having a high withstanding temperature, such as PEEK material or PPS etc. At both end portions of the heat insulating member 34, there are provided both ends holding portions 34*a* for holding risen portions at the both end portions of the exciting coil 5 in the direction of the rotation axis of the heat-generating roller 1. Thereby, it is possible to prevent the risen portions at the both end portions of the exciting coil 5 from falling down and to determine the outside position of the exciting coil 5.

Material of the rear face core 9 is the same as in the second embodiment. The shape of the cross section of the rear face core 9 including the C-shaped core 32 and the shape of the heat-generating roller 1 are also the same as in the above-mentioned second embodiment except the center core 33. Therefore, similarly to the above-mentioned second embodiment, the cross sectional area of the exciting coil 5 including the rear face core 9 is larger than the cross-sectional area of the surface perpendicular to the rotational axis inside the heat-generating roller 1.

The alternating current applied from the exciting circuit 6 (see FIG. 2) to the exciting coil 5 is the same as in the above-mentioned first embodiment. The alternating current applied to the exciting coil 5 is controlled by the temperature signal obtained by the temperature sensor provided on the surface of the fixing belt 31 so that the temperature of the fixing belt 31 is set to be 190° C., which is a predetermined fixing temperature.

As shown in FIG. 10A, the fixing belt 31 is suspended with a predetermined tensile force between the heat-generating roller 1 of 20 mm diameter and a fixing roller 35 of 20 mm diameter, with low thermal conductivity, whose surface is made of elastic foamed silicone rubber with low hardness (JISA 30 degrees) and is rotationally movable in the direction of the arrow B. Herein, on both ends of the heat-generating roller 1, rib (not shown in the drawings) are provided for preventing snaking of the fixing belt 31. Furthermore, a pressure roller 4 as a pressure means is pressed against the fixing roller 35 via the fixing belt 31, thereby forming a nip portion.

In this embodiment, A4 size recording paper (width: 210 mm) is used as a maximum width recording paper. The width of the fixing belt is set to be 230 mm, the length of the heat-generating roller 1 in the direction of the rotation axis is set to be 260 mm, the length between the outer-most edges of the rear face core 9 in the direction of the rotation axis of the heat-generating roller 1 is set to be 225 mm, the length of the circumferentially wound exciting coil 5 at the outer peripheral portion along the direction of the rotation axis of the heat-generating roller 1 is set to be 245 mm, and the length of the heat insulating member 34 along the direction of the rotation axis of the heat-generating roller 1 is set to be 250 mm.

In this embodiment, the exciting coil 5, the rear face core 9 and the heat-generating roller 1 are configured as mentioned above, and the exciting coil 5 heats the heat-generating roller 1 with electromagnetic induction. Hereinafter, the mechanism thereof will be described with reference to FIG. 13.

Figure 13:
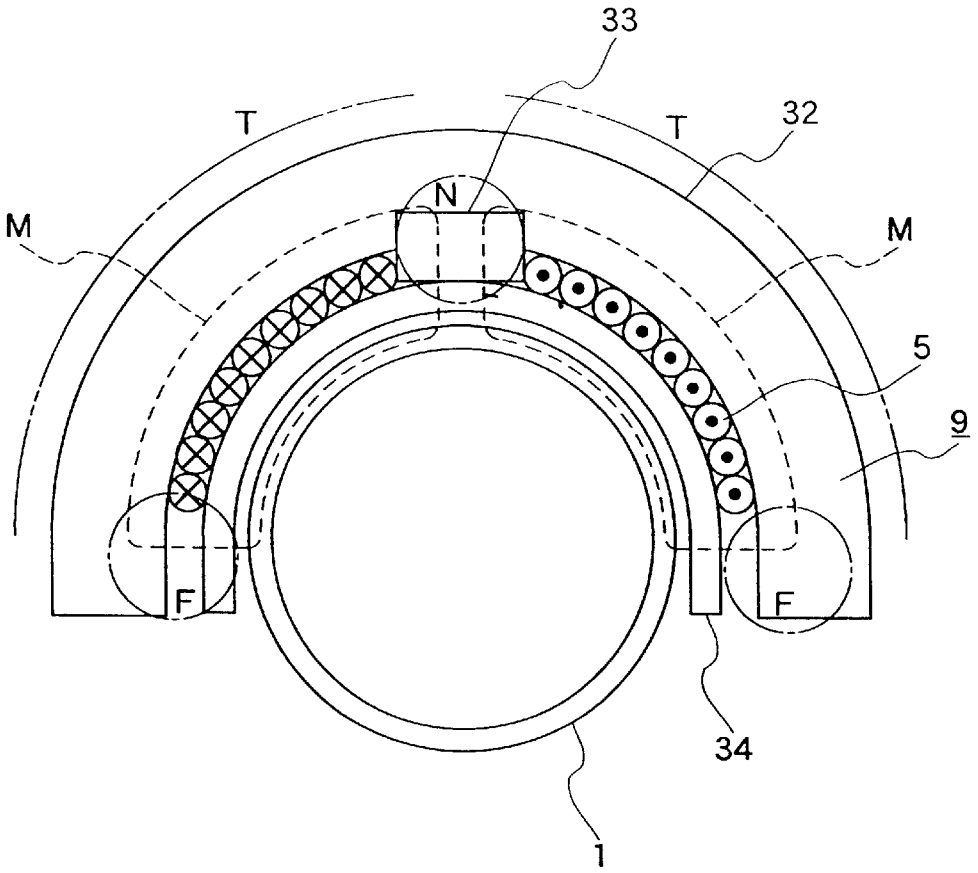
FIG. 13 is a cross-sectional view showing a heat-generating portion of a fixing device as an image heating device according to a fourth embodiment of the present invention.

As shown in FIG. 13, the magnetic flux generated by the coil current enters the heat-generating roller 1 from the opposing portion F of the rear face core 9. In this case, the magnetic flux generated by the coil current penetrates the heat-generating roller 1 in its circumferential direction as indicated by a broken line M in FIG. 13 due to the magnetism of the heat-generating roller 1. Then, this magnetic flux forms a large loop from the center core 33 that is the adjacent portion N to the heat-generating roller of the rear face core 9 via the magnetic permeable portion T, and repeats generation and annihilation. The induced current generated due to the changes in a state of the magnetic flux generates Joule heat as in the first embodiment.

In this embodiment, as shown in FIG. 11, a plurality of narrow width C-shaped cores 32 are arranged at a regular intervals in the direction of the rotation axis of the heat-generating roller 1. In this configuration, the magnetic flux flowing in the circumferential direction on the rear side of the exciting coil 5 is concentrated into the portion of the C-shaped core 32 and do not flow in the air between the neighboring C-shaped cores 32. Therefore, magnetic flux entering the heat-generating roller 1 tends to be concentrated on the portions in which the C-shaped cores 32 are present. Accordingly, heat generation of the heat-generating roller 1 tends to increase in the portion opposing to the C-shaped core 32. However, in this embodiment, since the center core 33 forming the adjacent portion N in the center of the winding of the exciting coil 5 is provided continuously in the direction of the rotation axis of the heat-generating roller 1, the magnetic flux entering the heat-generating roller 1 from the opposing portion F of the C-shaped core 32 also flows in the heat-generating roller 1 in the direction of the rotation axis, and thus the distribution thereof is made uniform. Therefore, the non-uniformity of the amount of heat generation of the heat-generating roller 1 can be relieved.

The movement in which the magnetic flux of the magnetic permeable portion T is led from the opposing portion F of the C-shaped core 32 to another opposing portion F is not related directly to the distribution of the magnetic flux entering the heat-generating roller 1. Therefore, the configuration in which the magnetic permeable portion T and the opposing portion F are separated is effective when optimizing the shape of the rear face core 9. The magnetic permeable portions T are not required to be uniform in the direction of the axis as long as the opposing portions F are as uniform as possible in the direction of axis.

Since the adjacent portion N to the heat-generating roller 1 is provided by making the center core 33 the convex portion with respect to the C-shaped core 32, the magnetic path can be formed of a larger amount of ferrite. Therefore, the air portion having a low magnetic permeability in which the magnetic flux generated by the coil current passes through is limited to the narrow gap portion between the heat-generating roller 1 and the rear face core 9. Accordingly, since the inductance of the exciting coil 5 is further increased, and larger amount of magnetic fluxes generated by the coil current can be led to the heat-generating roller 1, it is possible to obtain an excellent electromagnetic coupling between the heat-generating roller 1 and the exciting coil 5. Thereby, more electric power can be applied to the heat-generating roller 1 even with the same coil current. In particular, since the magnetic flux generated by the coil current passes through the center of the winding of the exciting coil 5 without fail, by locating the adjacent portion N that is the center cores 33 provided continuously in the direction of the rotation axis of the heat-generating roller 1 in the center of the winding of the exciting coil 5, the magnetic flux generated by the coil current can be led to the heat-generating roller 1 efficiently.

The cross-sectional area of the C-shaped core 32 in the circumferential direction of the magnetic permeable portion T is set so that the density of magnetic fluxes led from the exciting coil 5 is not beyond the maximum magnetic flux density of the material of the C-shaped core 32. This magnetic flux density is set to be about 80% of the saturation magnetic flux density of ferrite at maximum. The rate of the maximum magnetic flux density to the saturation magnetic flux density is set to be 100% or less, desirably in practical use, 50% to 85%. When this rate is too high, due to the unevenness of the environment or members, the maximum magnetic flux density may be beyond the saturation magnetic flux density. In such a case, the magnetic flux flows on the rear side of the rear face core 9 and heats the members behind the rear face core 9. On the contrary, when this rate is too small, expensive ferrite is used more than necessary, thus making the device expensive.

Furthermore, since the width of the C-shaped cores 32 is uniform and the plurality of C-shaped cores 32 are arranged with a large interval in the direction of the rotation axis of the heat-generating roller 1, heat is not stored in the rear face core 9 and the exciting coil 5. Furthermore, since there is nothing to prevent heat from radiating from the outer periphery of the rear face core 9 and exciting coil 5, it is possible to prevent the rapid reduction of the entire magnetic permeability caused by the reduction of saturation magnetic flux density of ferrite of the rear face core 9 due to the temperature rise by a heat storage. Furthermore, it is possible to prevent the wires from being short because the insulating coating of the wires are melted. Thereby, the temperature of the heat-generating roller 1 can be maintained at the predetermined temperature stably for a long time.

Furthermore, since the exciting coil 5 is formed in a way in which the bundled wires are superimposed at both end portions in the direction of the rotation axis of the heat-generating roller 1, the exciting coil 5 can be extended uniformly in a wider range in the direction of the rotation axis of the heat-generating roller 1. Thereby, it is possible to make the distribution of heat generation of the heat-generating roller 1 uniform. On the contrary, since it is possible to reduce the width of the both end portions of the exciting coil 5 in the direction of the rotation axis of the heat-generating roller 1 while securing the region having the uniform distribution of heat generation, the entire device can be miniaturized.

Furthermore, in this embodiment, the length of each part in the direction of the rotation axis of the heat-generating roller 1 is increased in the following order; the maximum width recording paper, the rear face core 9, the fixing belt 31, the outer peripheral portion of the exciting coil 5, the heat insulating member 34, and the heat-generating roller. That is, the length of the heat insulating member 34 is longer than the length of the exciting coil 5 and the length of the rear face core 9. Since the rear face core 9 is arranged in opposition to the heat-generating roller 1 and fixing belt 31 via the heat insulating member 34, even if the rear face core 9 is allowed to be closer to the heat-generating roller 1, it is possible to prevent the temperature of the rear face core 9 from increasing. Furthermore, it is possible to prevent a cooling air from being brought into contact with the fixing belt 31 and cooling the fixing belt 31.

Furthermore, since the width of the fixing belt 31 is longer than the length of the rear face core 9 in the direction of the rotation axis of the heat-generating roller 1, the portion of heat-generating roller 1 that is not in contact with the fixing belt 31 is not heated. Consequently, it is possible to prevent the temperature of this portion of heat-generating roller 1 from being increased too much.

Furthermore, by providing the coil cover 29, it is possible to prevent a small amount of magnetic flux leaked to the rear side of the rear face core 9 or the high frequency electromagnetic wave generated from the exciting coil 5 from transmitting to the inside and outside of the apparatus. As a result, it is possible to prevent electric circuits located at the inside and outside of the apparatus from wrongly operating due to electromagnetic noise.

Furthermore, since the space surrounded by the coil cover 29 and the heat insulating member 34 serves as an airway where the air from the cooling fan 28 flows, the exciting coil 5 and the rear face core 9 can be cooled without cooling the heat-generating roller 1 and the fixing belt 31.

Furthermore, the smallest space between the exciting coil 5 and the magnetic member such as the bottom plate 25 of the image forming apparatus main body, the top plate 26 of the image forming apparatus main body and the main body chassis 27 is set to be 20 mm. Thereby, it is possible to prevent the magnetic flux penetrating the inside of the rear face core 9 from releasing from the place other than the opposing portion F to the outside of the exciting coil 5 and entering the magnetic member such as the main body chassis 27 and the like. As a result, the electromagnetic energy provided to the exciting coil 5 can be applied to the heat-generating roller 1 efficiently without heating the members of the apparatus unnecessarily. Though the smallest space between the exciting coil 5 and the magnetic member such as the main body chassis 27 and the like is set to be 20 mm, if the space between the rear face core 9 and the magnetic member such as the main body chassis 27 and the like is not less than the space between the rear face core 9 and the heat-generating roller 1, or more desirably, not less than 1.5 times the space between the rear face core 9 and the heat-generating roller 1, it is possible to prevent the magnetic flux from leaking to the rear side of the exciting coil 5. In this embodiment, since the paper fixing guide 21 and the paper eject guide 23, which have to approach the fixing device 22, are made of resin, sufficient space between the rear face core 9 and the other magnetic member can be secured easily.

Furthermore, in this embodiment, the heat-generating roller 1 (heat-generating portion) is provided inside the fixing belt 31. On the other hand, the exciting coil 5 and the rear face core 9 are provided outside the fixing belt 31. Therefore, it is possible to prevent the temperature of the exciting coil 5 etc. from being increased due to the effect of the temperature of the heat-generating portion. Thus, the amount of heat generation can be maintained stably. In particular, since the exciting coil 5 and the rear face core 9 having a larger cross-sectional area than the cross-sectional area of the surface perpendicular to the rotation axis of the inside of the heat-generating roller 1 is used, it is possible to use the heat-generating roller 1 having a small thermal capacity, the exciting coil 5 having a large winding number, and the appropriate amount of ferrite (the rear face core 9) in combination. Therefore, it is possible to apply a larger amount of electric power to the heat-generating roller 1 with a predetermined coil current while suppressing the thermal capacity of the fixing device 22. As a result, by the use of an inexpensive exciting circuit 6 having low breakdown current and breakdown voltage (see FIG. 2), it is possible to realize the fixing device 22 with a short warm-up time. In this embodiment, it was possible to apply the electric power of 800 W to the heat-generating roller 1 with the alternating current from the exciting circuit 6; an effective voltage of 140V (voltage amplitude: 500V), and an effective current of 22A (peak current: 55A).

The exciting coil 5 arranged outside the heat-generating roller 1 heats the surface of the heat-generating roller 1, so that the fixing belt 31 is brought into contact with the portion of heat-generating roller 1 where the amount of heat radiation is largest. Therefore, the portion in which heat generation is maximum serves as a heat conducting portion to the fixing belt 31, which can conduct the generated heat to the fixing belt 31 without thermal conduction inside the heat-generating roller 1. In this way, since the thermal conducting distance is small, it is possible to carry out a control capable of rapid response with respect to the temperature fluctuation of the fixing belt 31.

A temperature sensor (not shown) is provided in the vicinity of the portion past the contact position in which the heat-generating roller 1 and the fixing belt 31 are in contact with each other. By controlling the temperature of this portion at constant, it is possible to maintain the temperature of the fixing belt 31 constant when the fixing belt 31 enters the nip portion between the fixing roller 35 and the pressure roller 4. As a result, even if a plurality of recording papers 8 are fixed continuously, the fixation can be performed stably.

Furthermore, since the exciting coil 5 and the rear face core 9 cover substantially the half of the circumference of the heat-generating roller 1, an entire region of the contact portion of the fixing belt 31 and the heat-generating roller 1 is heated. Therefore, much more heating energy transmitted from the exciting coil 5 to the heat-generating roller 1 with electromagnetic induction can be transmitted to the fixing belt 31.

Furthermore, in this embodiment, the material, thickness, etc. of the heat-generating roller 1 and the fixing belt 31 can be set independently. Therefore, as the material and thickness of the heat-generating roller 1, the optimum material and thickness for being heated with electromagnetic induction of the exciting coil 5 can be selected. Furthermore, as the material and thickness of the fixing belt 31, the optimum material and thickness for fixing can be selected.

In this embodiment, in order to shorten the warm-up time, the thermal capacity of the fixing belt 31 is set as small as possible and at the same time, the thickness and the outer diameter of the heat-generating roller 1 are set small to make its thermal capacity small. Therefore, the fixing belt 31 could be heated up to a predetermined temperature in about 15 seconds after the heating for fixing is started with an electric power of 800 W.

Moreover, in this embodiment, the C-shaped cores 32 are arranged with uniform interval in the direction of the rotation axis of the heat-generating roller 1. However, this interval is not necessarily uniform, and can be adjusted in accordance with the heat radiating conditions or presence or absence of the contacting member such as the temperature sensor, etc., which makes it possible to design freely the distribution of heat generation so that the temperature distribution is uniform.

Furthermore, in this embodiment, the rear face core 9 includes the plurality of C-shaped cores 32 made of ferrite having the same thickness arranged with a interval in the direction of the rotation axis of the heat-generating roller 1, and the center cores 33 made of ferrite. However, there is no limitation to this configuration alone. For example, a configuration in which a continuous rear face core 9 is arranged in the direction of the rotation axis of the heat-generating roller 1, and a plurality of holes are provided in the rear face core 9 may be used. Furthermore, a configuration in which a plurality of blocks made of ferrite are distributed independently on the rear side of the exciting coil 5 may be used.

Furthermore, in this embodiment, the base of the fixing belt 31 is made of resin. However, instead of resin, ferromagnetic metal such as nickel etc. may be used. In this case, since a part of the heat is generated in the fixing belt 31 with electromagnetic induction and the fixing belt 31 itself is heated, the heating energy can be transmitted to the fixing belt 31 more efficiently.

Furthermore, in this embodiment, the bottom plate 25 of the image forming apparatus main body, the top plate 26 of the image forming apparatus main body and the main body chassis 27 are made of magnetic material. However, instead of magnetic material, resin material may be used. In this case, since the members providing strength for the image forming apparatus main body do not affect a line of magnetic force, it is possible to arrange these members in the vicinity of the rear face core 9. As a result, miniaturization of the entire apparatus is possible.

Figure 14:
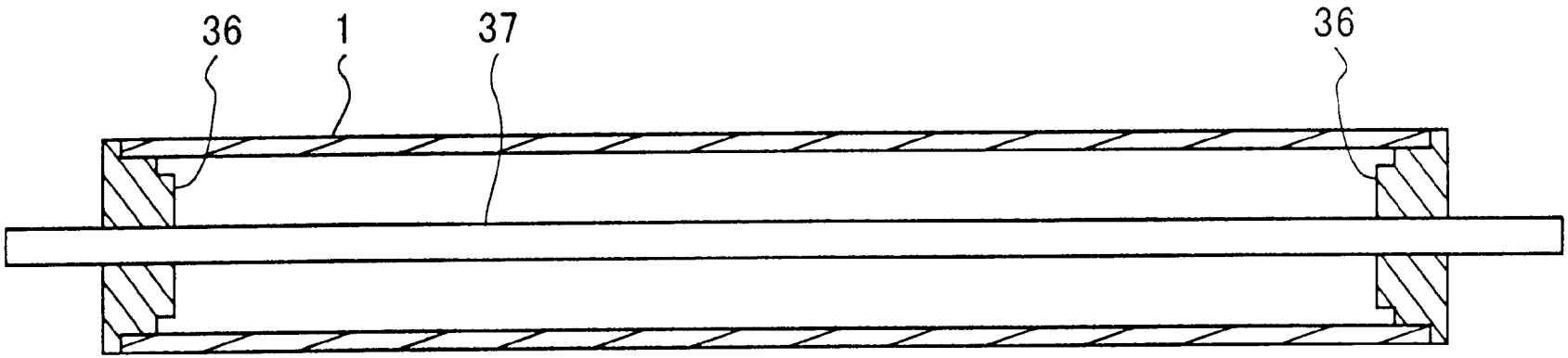
FIG. 14 is a cross-sectional view showing a heat-generating roller of a fixing device as an image heating device according to a fourth embodiment of the present invention.

Furthermore, in this embodiment, both ends of the heat-generating roller 1 are supported by the bearings 3. However, as shown in FIG. 14, the heat-generating roller 1 may be supported by flanges 36 and a central axis 37. Herein, the flange 36 is provided on the both ends of the heat-generating roller 1 and made of heat resistant resin having a small thermal conductivity, for example, Bakelite etc. The central axis 37 passes through both flanges 36. When employing this configuration, it is possible to prevent heat or magnetic flux from leaking out of the both ends of the heat-generating roller 1.

Furthermore, in this embodiment, the excitation width of the exciting coil 5 in the direction in which the fixing belt 31 moves is set to be not more than the range in which the fixing belt 31 is in contact with the heat-generating roller 1 (the range of winding). However, there is no limitation to this configuration, and it is also possible to employ other configurations. For example, as shown in FIG. 10B, the exciting width of the exciting coil 5 in the direction in which the fixing belt 31 moves may be extended from the range in which the fixing belt 31 is in contact with the heat-generating roller 1 (the range of winding; boundary line b) toward the side of the fixing roller 35. According to this configuration, as compared with the configuration shown in FIG. 10A, since a wider region of the heat-generating roller 1 (region indicated by a in FIG. 10B) can be heated, a sufficient amount of heat generation can be obtained even if the coil current is small. Furthermore, in this case, after the exciting coil 5 is formed by winding the bundled wire, the cross section of the circumferentially wound bundled wires is made to be substantially quadrangle to bring bundled wires in closer contact with each other by compressing the exciting coil 5. Thereby, since the occupied volume of the exciting coil 5 can be reduced, it is possible to increase the winding number of the exciting coil 5. As a result, since the current density of the coil current is increased, the density of the eddy current generated in the heat-generating roller 1 is also increased. Consequently, the amount of heat generation is increased. Therefore, it is possible to reduce the necessary coil current or to reduce the diameter of the heat-generating roller 1. Furthermore, since a space between the rear face core 9 and the exciting coil 5 can be increased, by promoting the heat radiation from the rear face core 9, it is possible to prevent the temperature rise of the rear face core 9. Furthermore, since the bundled wires are strongly in contact with each other, adhesion between the bundled wires becomes stronger, and the exciting coil 5 can keep the shape by itself. Therefore, the process for assembling the fixing device 22 can be simplified.

Fifth Embodiment

Figure 15:
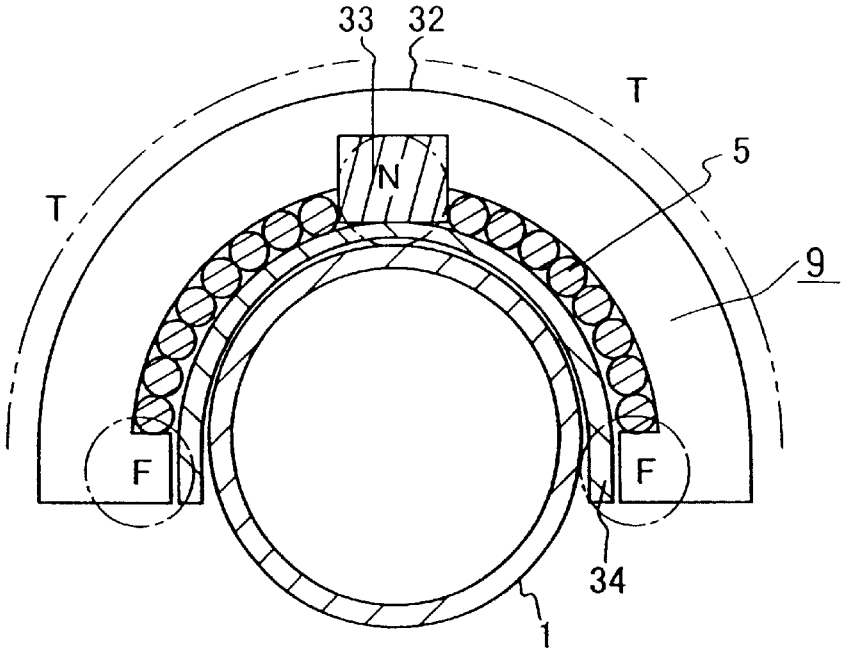
FIG. 15 is a cross-sectional view showing a heat-generating portion of a fixing device as an image heating device according to a fifth embodiment of the present invention.

FIG. 15 is a cross-sectional view showing a heat-generating portion of a fixing device as an image heating device according to a fifth embodiment of the present invention. In this embodiment, members having the same configuration and the same function as in the fourth embodiment are provided with the same numerals and the explanation therefor are omitted.

As shown in FIG. 15, in this embodiment, unlike the above-mentioned fourth embodiment, in the opposing portion F of the rear face core 9, the portion opposing to the heat-generating roller 1 is formed in a convex portion so as to be in close to the heat-generating roller 1.

Other configurations are the same as in the fourth embodiment.

According to the configuration of this embodiment, the magnetic path can be composed of ferrite almost completely. Therefore, an air portion having a low magnetic permeability in which the magnetic fluxes generated by the coil current passes through is limited to the narrow gap portion between the heat-generating roller 1 and the rear face core 9. Accordingly, the inductance of the exciting coil 5 is further increased, and almost all of the magnetic fluxes generated by the coil current can be led to the heat-generating roller 1. As a result, the electromagnetic coupling between the heat-generating roller 1 and the exciting coil 5 becomes excellent, thus increasing R of the equivalent circuit shown in FIG. 4. Therefore, more electric power can be applied to the heat-generating roller 1 even with the same coil current. In this embodiment, electric power of 800 W could be applied to the heat-generating roller 1 with the effective current of 20A (peak current: 50A).

Furthermore, since the rear face core 9 is opposed to the heat-generating roller 1 and a fixing belt (not shown in the drawings) via the heat insulating member 34, even if the rear face core 9 is allowed to be in close to the heat-generating roller 1, the temperature rise of the rear face core 9 can be prevented.

Sixth Embodiment

Figure 16:
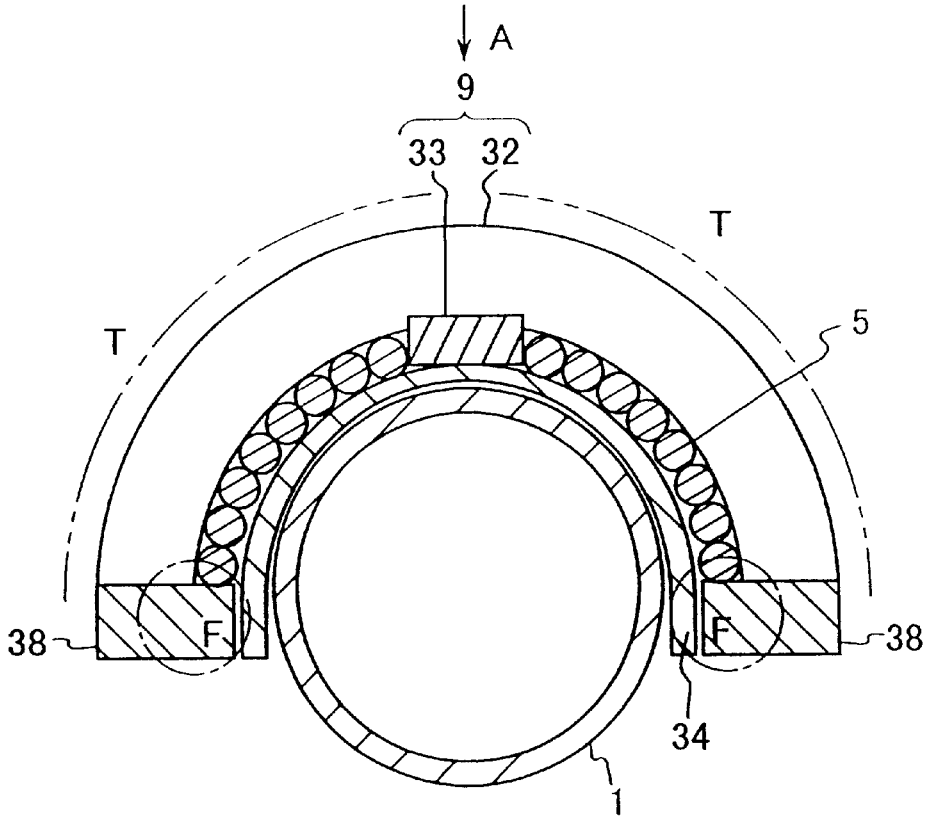
FIG. 16 is a cross-sectional view showing a heat-generating portion of a fixing device as an image heating device according to a sixth embodiment of the present invention.
Figure 17:
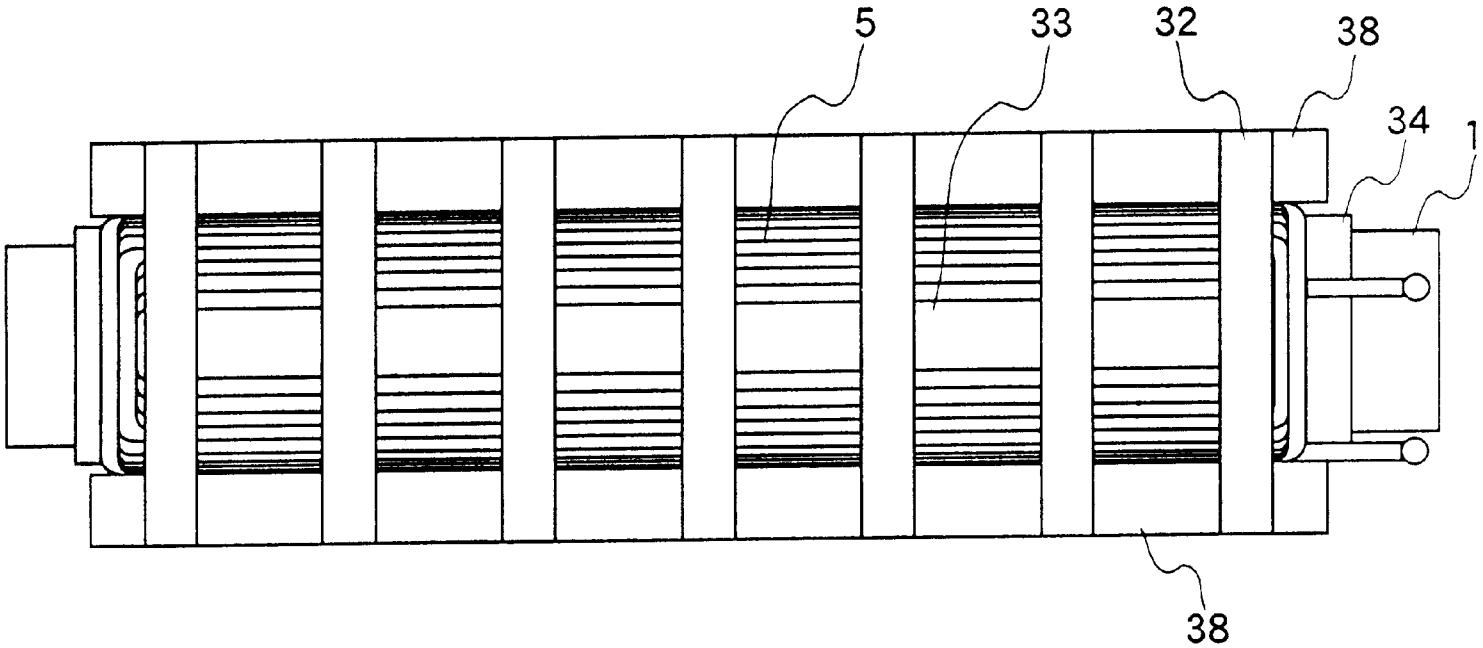
FIG. 17 is a projection plan view showing a heat-generating portion of a fixing device as an image heating device according a sixth embodiment of the present invention in FIG. 16 as viewed from the direction of the arrow A.

FIG. 16 is a cross-sectional view showing a heat-generating portion of a fixing device as an image heating device according to a sixth embodiment of the present invention; and FIG. 17 is a projection plan view showing a heat-generating portion of a fixing device as an image heating device shown in FIG. 16 as viewed from the direction of the arrow A. In this embodiment, members having the same configuration and the same function as in the fifth embodiment are provided with the same numerals and the explanation therefor are omitted.

As shown in FIGS. 16 and 17, in this embodiment, unlike the above-mentioned fifth embodiment, there are provided opposing cores 38 continuously arranged in the direction of the rotation axis of the heat-generating roller 1 as a opposing portion F of the rear face core 9.

Furthermore, A4 size recording paper (width: 210 mm) is used as a maximum width recording paper. The length of the heat-generating roller 1 in the direction of the rotation axis is set to be 240 mm, the length between the outer-most edges of the C-shaped cores 32 excluding the opposing cores 38 in the direction of the rotation axis of the heat-generating roller 1 is set to be 200 mm; the length of the exciting coil 5 at the inner peripheral portion along the direction of the rotation axis of the heat-generating roller 1 is set to be 210 mm; and the length of the opposing core 38 along the direction of the rotation axis of the heat-generating roller 1 is set to be 220 mm.

Other configurations are the same as in the fifth embodiment.

In this embodiment, the length of the magnetic permeable portion T of the exciting coil 5 along the direction of the rotation axis of the heat-generating roller 1 (the length of the exciting coil 5 at the inner circumferential portion along the direction of the rotation axis of the heat-generating roller 1) is set to be smaller than the width of the maximum size recording paper. In the meanwhile, the length of the opposing portion F of the rear face core 9 along the direction of the rotation axis of the heat-generating roller 1 (the length of the opposing portion 38 along the direction of the rotation axis of the heat-generating roller 1) is set to be larger than the maximum width recording paper. Thus, even if the rear face core 9 at the magnetic permeable portion T is provided with a space with uneven distribution, magnetic field reaching the heat-generating roller 1 from the opposing portion F can be made uniform in the direction of the rotation axis. Thereby, since the distribution of heat generation in the heat-generating roller 1 at the portion where the recording paper passes through can be made uniform with the rear face core 9 at the magnetic permeable portion T reduced, the temperature distribution at the fixing portion is uniform. Therefore, the fixing can be carried out stably. Furthermore, since the rear face core 9 at the magnetic permeable portion T can be reduced while the distribution of heat generation in the heat-generating roller 1 uniform, it is possible to achieve the miniaturization of the device and the reduction of the cost.

Figure 18:
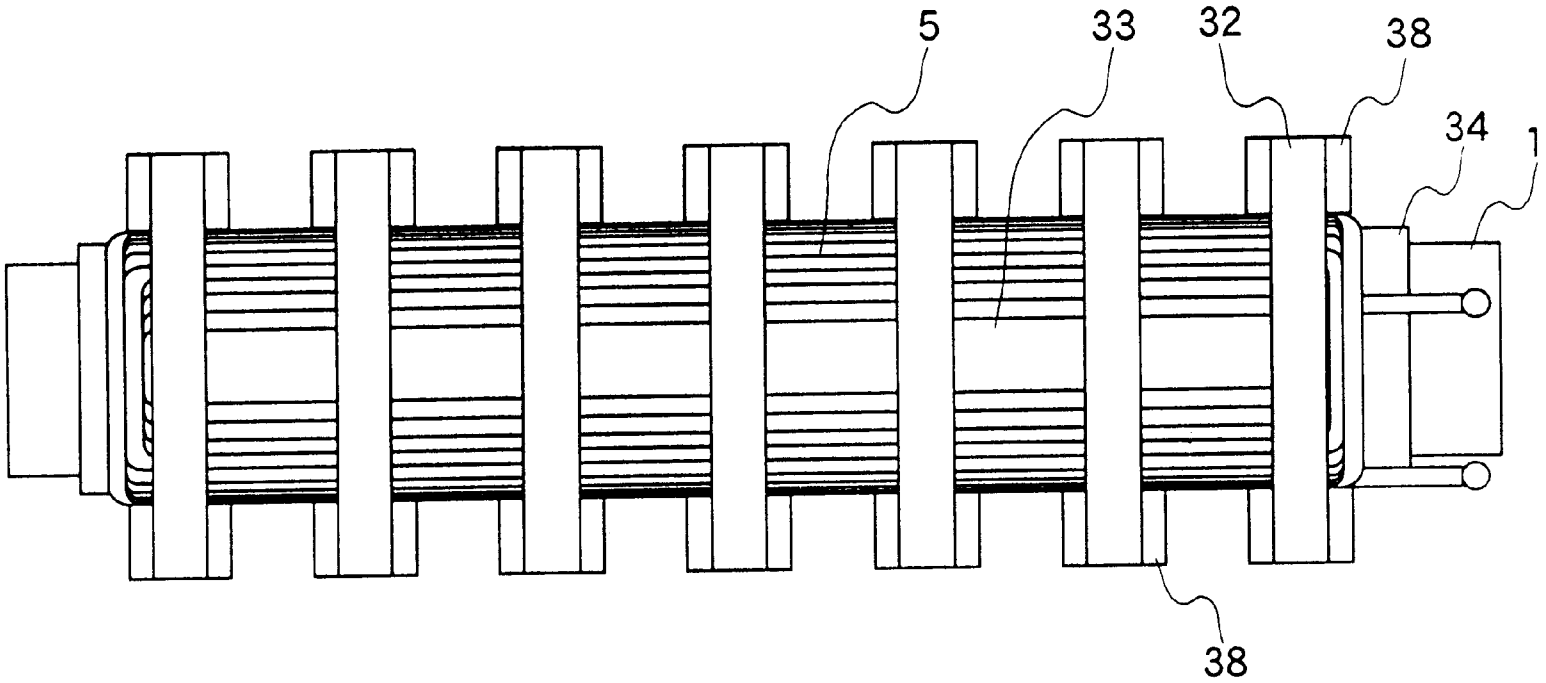
FIG. 18 is a projection plan view showing another example of a heat-generating portion of a fixing device as an image heating device according to a sixth embodiment of the present invention.

In this embodiment, although the opposing core 38 as a opposing portion F of the rear face core 9 is provided continuously in the direction of the rotation axis of the heat-generating roller 1, the present invention is not limited to this configuration alone. For example, as shown in FIG. 18, the opposing core 38 may be divided and the rear face core 9 may be configured so that the opposing portion F has a wider shape than the magnetic permeable portion T in the direction of the rotation axis of the heat-generating roller 1. According to this configuration, since the rear face cores 9 at the opposing portion F are reduced, the weight of the rear face cores 9 can be reduced. Furthermore, since it is possible to increase the surface area of the opposing portion F where the temperature easily rises, and cooling by heat radiation can be promoted.

Seventh Embodiment

Figure 19:
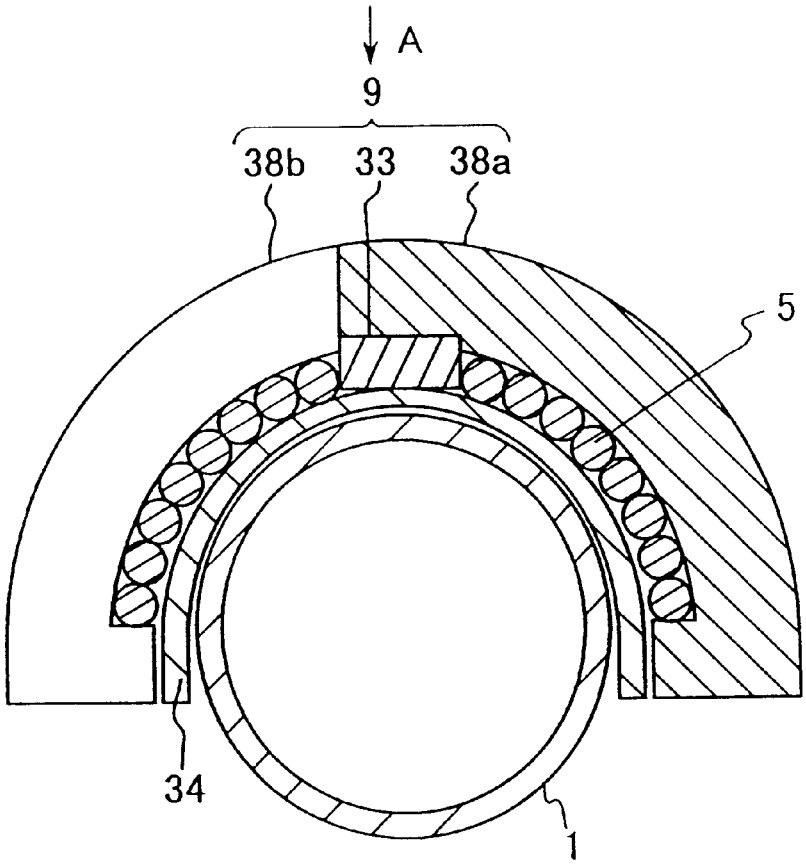
FIG. 19 is a cross-sectional view showing a heat-generating portion of a fixing device as an image heating device according to a seventh embodiment of the present invention.
Figure 20:
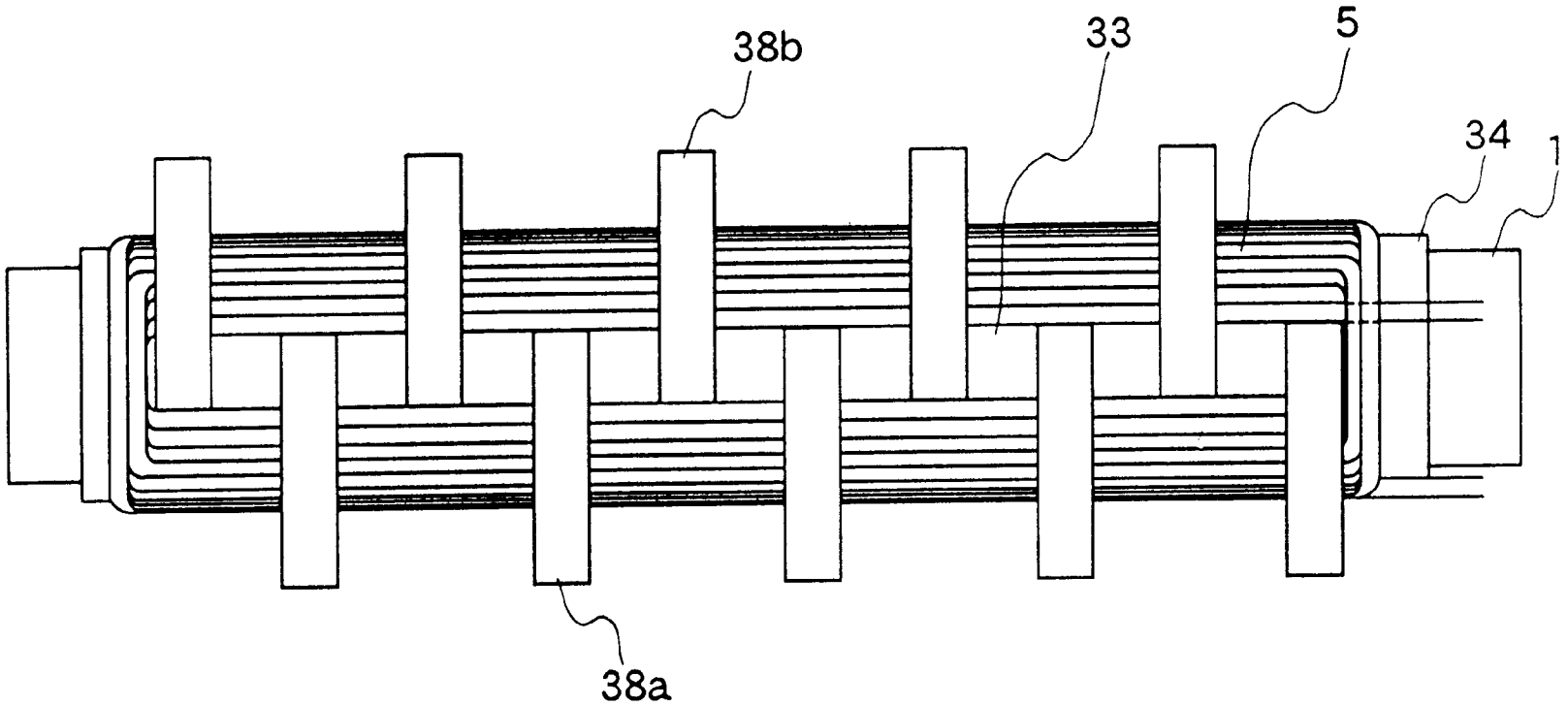
FIG. 20 is a projection plan view showing a heat-generating portion of a fixing device as an image heating device according a seventh embodiment of the present invention in FIG. 19 as viewed from the direction of the arrow A.

FIG. 19 is a cross-sectional view showing a heat-generating portion of a fixing device as an image heating device according to a seventh embodiment of the present invention; and FIG. 20 is a projection plan view showing a heat-generating portion of in FIG. 19 as viewed from the direction of the arrow A. In this embodiment, members having the same configuration and the same function as in the fifth embodiment are provided with the same numerals and the explanations therefor are omitted.

As shown in FIGS. 19 and 20, in this embodiment, unlike the above-mentioned fifth embodiment, there are provided C-shaped cores 38 so as to cover the range corresponding to a circular arc having an angle of about 90° around the rotation axis of the heat-generating roller 1. In this case, the C-shaped cores 38*a* and 38*b*, which extend in the different directions, are arranged in a staggered form in the direction of the rotation axis of the heat-generating roller 1. In other words, the opposing portions F of the rear face core 9 are arranged asymmetrically with respect to the center line of the exciting coil 5 in the direction of the rotation axis of the heat-generating roller 1.

In the above-mentioned fifth embodiment, the same circumferential portion on the heat-generating roller 1 is rotated while opposing to two opposing portions F of the C-shaped core 32. Consequently, there arises a large difference in the amount of heat generation between the portion opposing to the C-shaped core 32 of the heat-generating roller 1 and the other portion of the heat-generating roller 1, thus causing irregularity in temperature distribution. On the other hand, in this embodiment, since the same circumferential portion on the heat-generating roller 1 is rotated while opposing one opposing portions F of the C-shaped core 32, there arises no large difference in the amount of heat generation between the portion opposing to the C-shaped core 32 of the heat-generating roller 1 and the other portion of the heat-generating roller 1. Furthermore, when the heat-generating roller 1 is rotated, the space of the trace of the portion opposing to the opposing portion F of the rear face core 9 can be shortened on the surface of the heat-generating roller 1 while reducing the volume of the rear face core 9 to be used. In other words, when the length of the opposing portion F along the direction of the rotation axis of the heat-generating roller 1 is set to be 220 mm as in the above-mentioned sixth embodiment, since five C-shaped cores 38 are arranged on one row, the pitch becomes 44 mm. However, since the C-shaped cores 38*a* and 38*b* are arranged in the staggered form, when the heat-generating roller 1 is rotated, the apparent pitch of the portion opposing to the staggered form opposing portion F becomes half, i.e. 22 mm on the surface of the heat-generating roller 1. Thus, in this embodiment, since there arises no large difference in the amount of heat generation between the portion opposing to the C-shaped core 32 of the heat-generating roller 1 and the other portion of the heat-generating roller 1, and the space between opposing portions F on which the heat generation is concentrated becomes smaller, it is possible to make the distribution of heat generation uniform. As a result, it is possible to suppress the temperature irregularity of the heat-generating roller 1 and the fixing belt.

Furthermore, since the rear face cores 9 at the opposing portion F are reduced, the weight of the rear face cores 9 can be reduced. Furthermore, since the surface area of the rear face core 9 can be increased, cooling by heat radiation can be promoted. Thus, heat is not locally stored inside the rear face core 9. Thereby, it is possible to prevent the entire magnetic permeability from rapidly reducing due to the reduction of the saturation magnetic flux density of the rear face core 9 by temperature rise by the heat storage. Thereby, the temperature of the heat-generating roller 1 can be maintained stably at the predetermined temperature for a long time.

Eighth Embodiment

Figure 21:
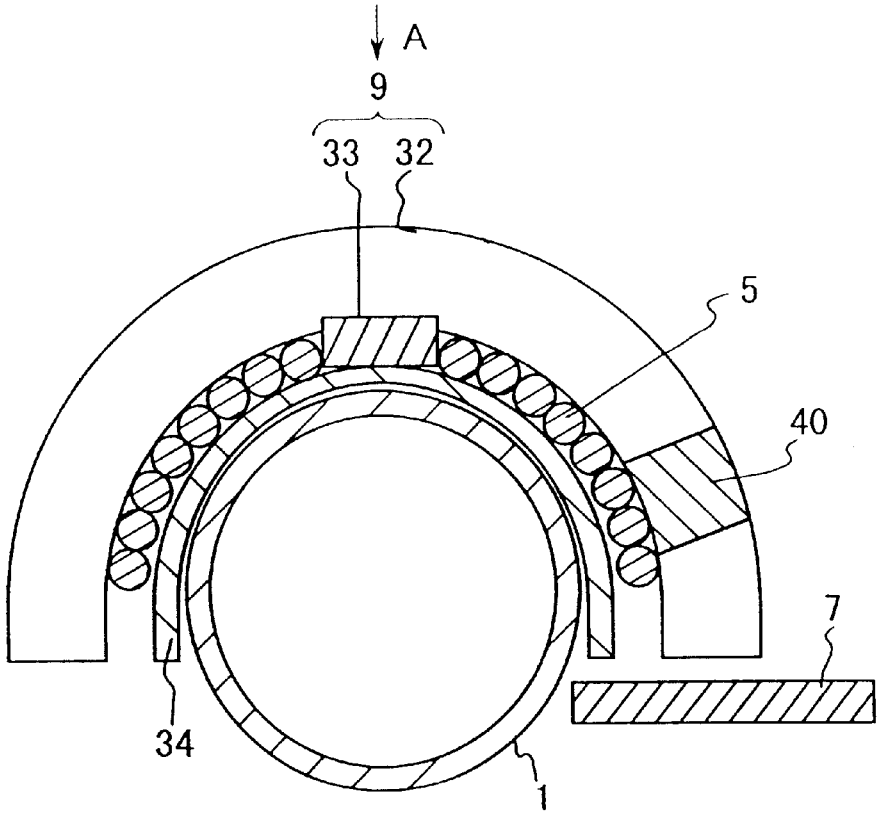
FIG. 21 is a cross-sectional view showing a heat-generating portion of a fixing device as an image heating device according to an eighth embodiment of the present invention.
Figure 22:
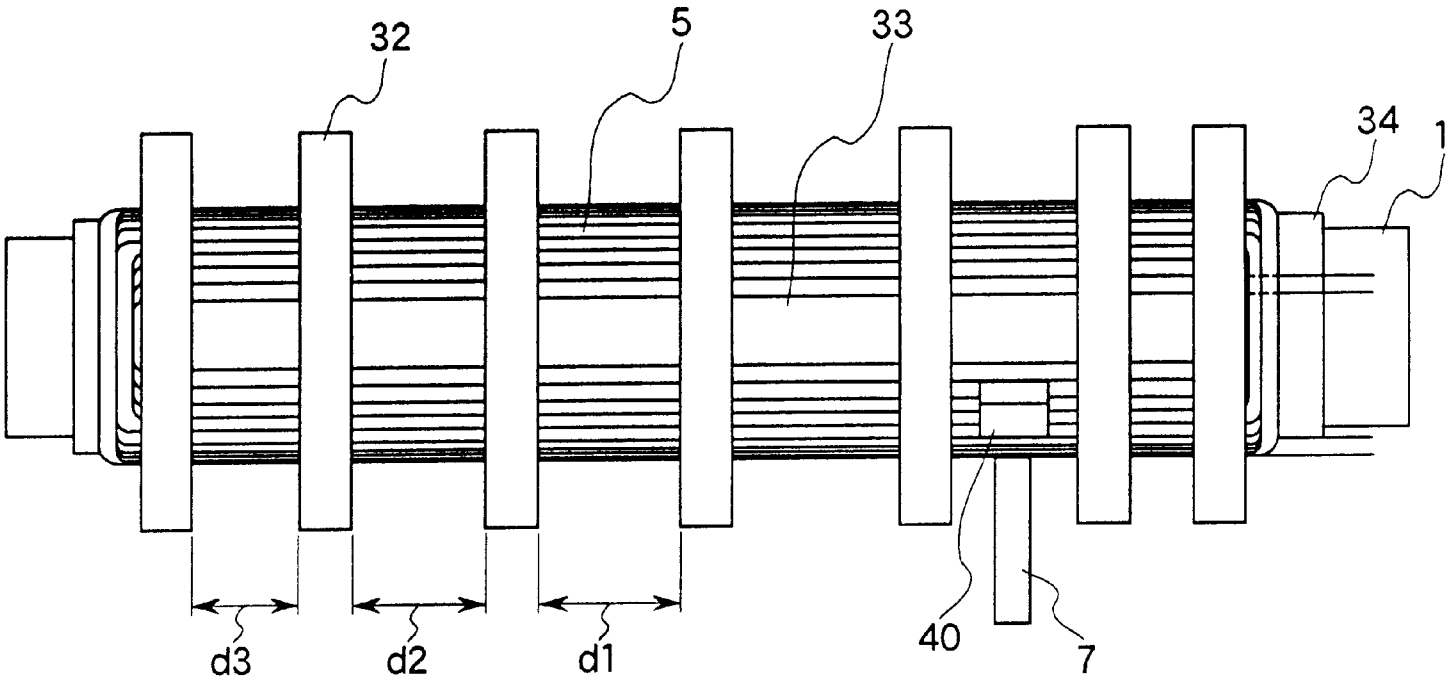
FIG. 22 is a projection plan view showing a heat-generating portion a fixing device as an image heating device according to an eighth embodiment of the present invention in FIG. 21 as viewed from the direction of the arrow A.

FIG. 21 is a cross-sectional view showing a heat-generating portion of a fixing device as an image heating device according to an eighth embodiment of the present invention; and FIG. 22 is a projection plan view showing a heat-generating portion in FIG. 21 as viewed from the direction of the arrow A. In this embodiment, members having the same configuration and the same function as in the fourth embodiment are provided with the same numerals and the explanations therefor are omitted.

As shown in FIGS. 21 and 22, this embodiment is different from the above-mentioned fourth embodiment in that the space between the neighboring C-shaped cores 32 is changed along the direction of the rotation axis of the heat-generating roller 1. In FIG. 22, d1=21 mm, d2=21 mm, and d3=18 mm are satisfied. Therefore, the relationship: d1=d2>d3 is satisfied. In other words, the space between the neighboring rear face cores 9 is narrow in the end portions of the heat-generating roller 1. Furthermore, a block 40 made of ferrite (5 mm×5 mm) is provided at the same position in the axis direction as the position where the temperature sensor 7 is provided. The temperature sensor 7 is used for measuring the temperature with contacting the surface of the fixing belt.

When the spaces of the neighboring rear face cores 9 are equalized, the temperature of the end portion of the heat-generating roller 1 and the fixing belt may be reduced. This irregularity in temperature in the direction of the rotation axis of the heat-generating roller 1 may lead to deficiencies in fixing.

In this embodiment, as mentioned above, since the spaces between the neighboring rear face cores 9 is narrower in the end portions than in the central portion of the heat-generating roller 1, the magnetic flux generated by the coil current becomes somewhat larger in the end portions than in the central portion of the heat-generating roller 1. Therefore, in the end portions of the heat-generating roller 1, the amount of heat generation becomes larger. On the other hand, in the end portions of the heat-generating roller 1, due to the heat conduction toward the bearing, etc., a larger amount of heat easily is dissipated. Consequently, as both of the operations are compensated, the temperature distribution of the heat-generating roller 1 and the fixing belt become uniform, thus preventing the deficiency of fixing.

Furthermore, since the temperature sensor 7 is in contact with the surface of the fixing belt, occasionally heat may be removed from the fixing belt by the temperature sensor 7. Therefore, only in the portion with which the temperature sensor 7 is in contact, the temperature of the fixing belt is easily decreased in the circumferential direction.

In this embodiment, as mentioned above, since the block 40 made of ferrite is provided at this portion, magnetic fluxes easily are concentrated on this portion as compared with the other portion. Therefore, a larger amount of heat generation easily is generated in this portion as compared with the other portion. Thereby, by compensating heat removed by the temperature sensor 7, the temperature distribution of the surface of the fixing belt can be made uniform, thus preventing the deficiency of fixing.

In this embodiment, by reducing the spaces between the neighboring rear face cores 9 in the end portions of the heat-generating roller 1, the uniform temperature distribution can be achieved. However, the present invention is not limited to the configuration alone. For example, the space between the neighboring rear face cores 9 may be made uniform, and the width of the rear face core 9 located at the end portion of the heat-generating roller 1 may be made larger than the width of the rear face core 9 located at the central portion of the heat-generating roller 1. Similarly, in this case, the uniform temperature distribution can be obtained. Alternately, for example, by making the space between neighboring rear face cores 9 uniform, and individually arranging a block made of ferrite in the vicinity of the end portion of the heat-generating roller 1, similarly, the uniform temperature distribution can be obtained.

Ninth Embodiment

Figure 23:
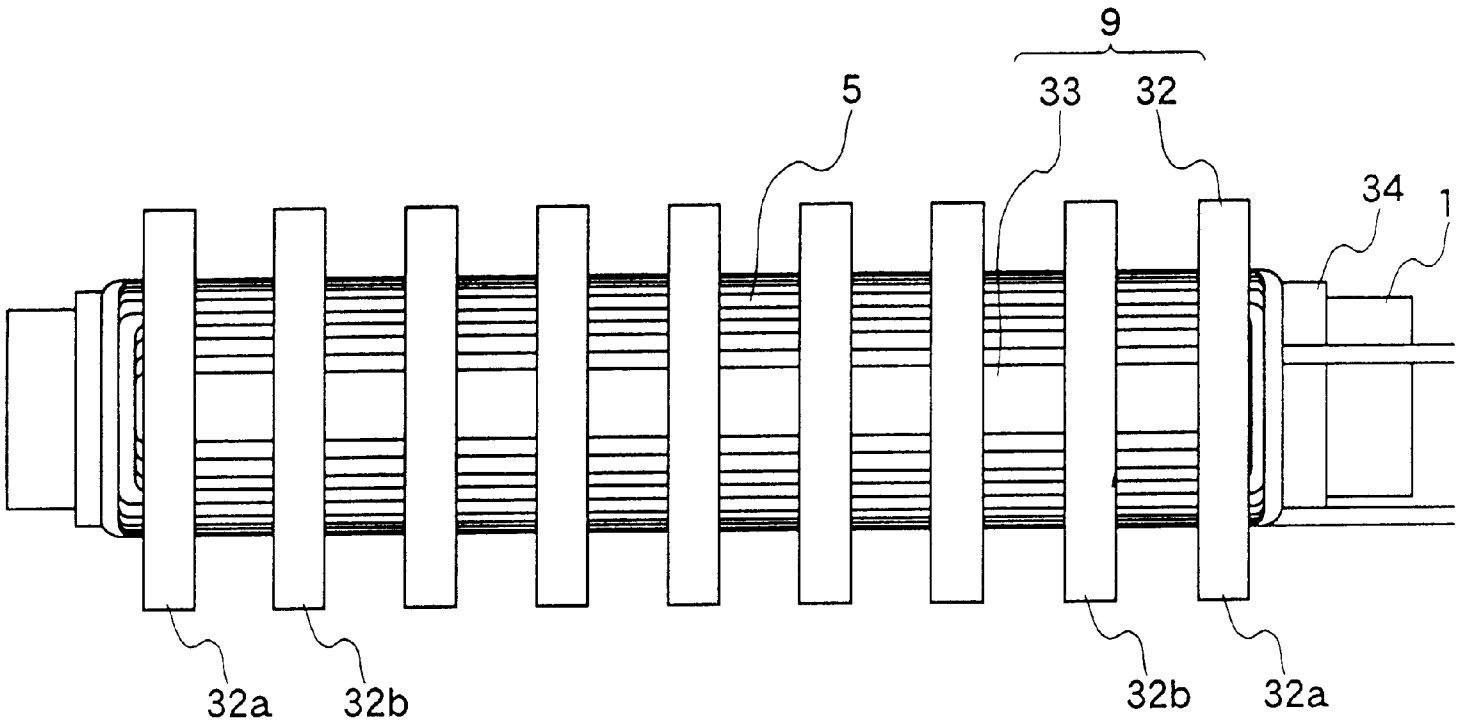
FIG. 23 is a projection plan view showing a heat-generating portion of a fixing device as an image heating device according to a ninth embodiment of the present invention.
Figure 24:
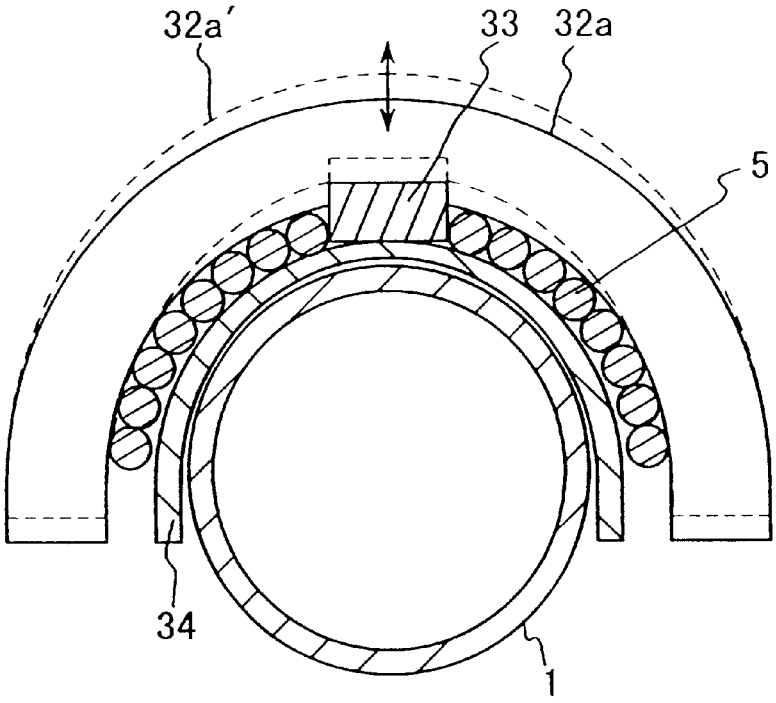
FIG. 24 is a cross-sectional view showing a heat-generating portion of a fixing device as an image heating device according to a ninth embodiment of the present invention.

FIG. 23 is a projection plan view showing a heat-generating portion of a fixing device as an image heating device according to a ninth embodiment of the present invention; and FIG. 24 is a cross-sectional view showing a heat-generating portion of a fixing device as an image heating device according to a ninth embodiment of the present invention. In this embodiment, members having the same configuration and the same function as in the fourth embodiment are provided with the same numerals and the explanations therefor are omitted.

As shown in FIGS. 23 and 24, in this embodiment, unlike the above-mentioned fourth embodiment, the C-shaped cores 32*a* and 32*b* of the rear face core 9 located in the vicinity of the end portion of the heat-generating roller 1 are movably held. Furthermore, in this embodiment, A3 size recording paper (width: 297 mm) is used as a maximum width recording paper. The C-shaped core 32*a* is located at the outside of the region in which the A4 size recording paper (width: 210 mm) passes through. When the recording paper having the size of about A4 size is used, as indicated by a broken line 32*a*' in FIG. 24, the C-shaped core 32*a* moves apart from the heat-generating roller 1 in the radial direction of the heat-generating roller 1. Furthermore, when smaller size recording paper is used, the C-shaped core 32*b* that is located at the inside of the C-shaped core 32*a* also is moved.

Other configurations are the same as in the fourth embodiment.

In this embodiment, the C-shaped cores 32 located at the outside of the region in which the recording paper passes through move apart from the heat-generating roller 1 in the radial direction of the heat-generating roller 1, the air portion having a low magnetic permeability in which the magnetic flux generated by the coil current passes through is increased. Therefore, the magnetic fluxes of this portion are reduced and the amount of heat generation of the heat-generating roller 1 in the opposing portion is reduced. Thereby, it is possible to prevent the temperature of the member such as a fixing belt, bearing and the like on the end portion from being increased beyond the withstanding temperature due to the excessive increase of the temperature of the region in which the recording paper do not pass through. Furthermore, even if a large size recording paper is used after small size recording papers are used continuously, since the temperature of the fixing portion is proper, the occurrence of hot offset can be prevented. Therefore, just after the small size recording papers are used, the large size recording paper can be used.

Figure 25:
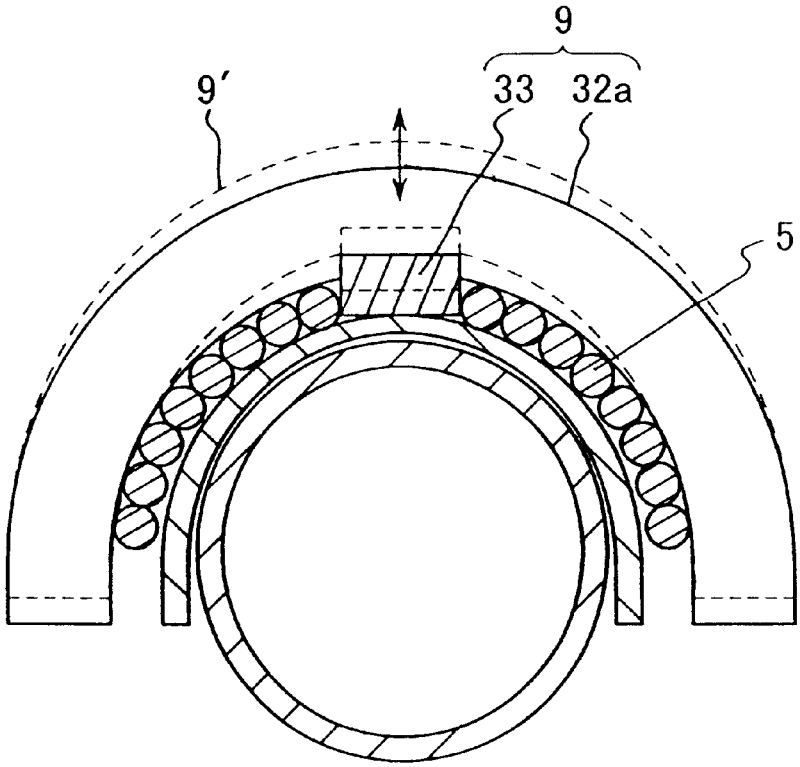
FIG. 25 is a cross-sectional view showing another example of a heat-generating portion of a fixing device as an image heating device according to a ninth embodiment of the present invention.

In this embodiment, although the case where only the C-shaped core 32 is movable was described as an example, the present invention is not limited to this configuration alone. For example, as shown in FIG. 25, even if the C-shaped core 32*a* and the center core 33 are integrated and move as indicated by a broken line 9', the same effect can be obtained.

In each of the above-mentioned embodiments, although the exciting coil 5 is arranged in contact with the rear face core 9, the present invention is not limited to this configuration alone. For example, even if the exciting coil 5 and the rear face core 9 are arranged with a gap of about 1 mm therebetween, the same effect can be obtained. By providing the gap between the exciting coil 5 and the rear face core 9, it is possible to prevent the temperature from rising at the portion where the exciting coil 5 is in contact with the rear face core 9.

Furthermore, in each of the above-mentioned embodiments, although the heat insulating member 34 is arranged in contact with the exciting coil 5, the present invention is not limited to this configuration alone. For example, the configuration in which the heat insulating member 34 is apart from the exciting coil 5 and the air can pass through therebetween may be used. In this case, the heat radiation from the exciting coil 5 can be promoted.

The configurations of the exciting coil 5, the rear face core 9 and the heat-generating roller 1 are not limited to the configuration in each of the above-mentioned embodiments. There is no practical problem as long as the inductance L is 10 $\mu$H or more and 50 $\mu$H or less, and the resistance component R is 0.5 Ω or more and 5 Ω or less in the equivalent circuit of FIG. 4.

Furthermore, in each of the above-mentioned embodiments, the case where the excitation is carried out from the outside of the heat-generating roller 1 (heat-generating member) by the use of the exciting coil 5 was described as an example. However, the excitation may be carried out from the inside of the heat-generating roller 1 (heat-generating member).

Tenth Embodiment

Figure 26:
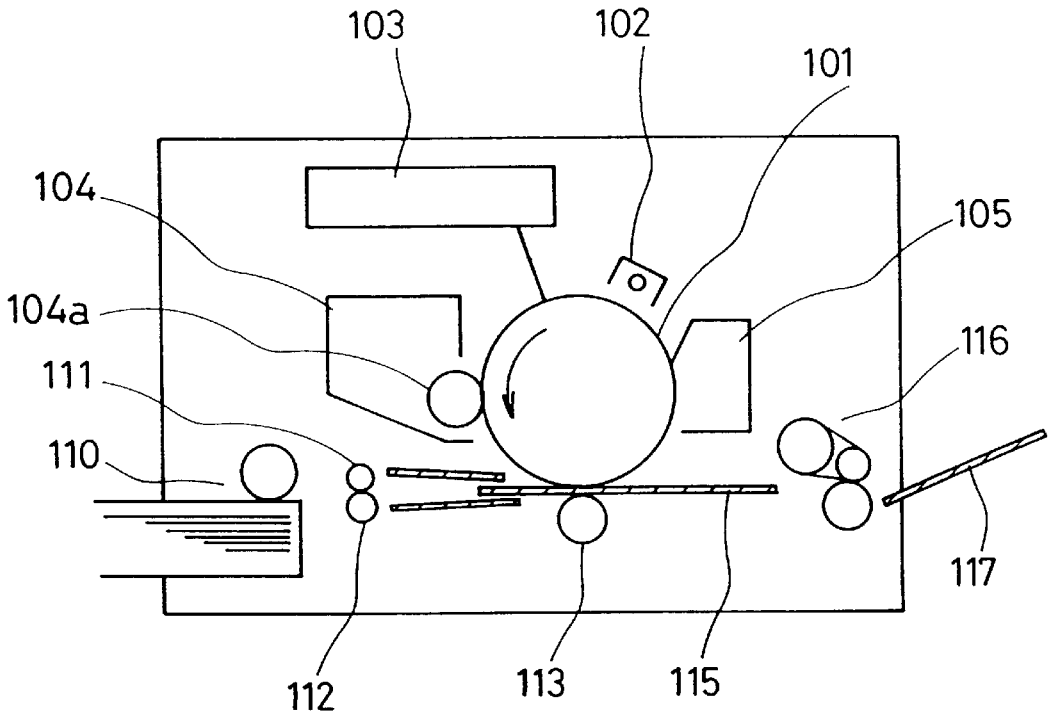
FIG. 26 is a cross-sectional view showing an image forming apparatus using an image heating device as a fixing device according to a tenth embodiment of the present invention.

FIG. 26 is a cross-sectional view showing an image forming apparatus using an image heating device as a fixing device according to a tenth embodiment of the present invention.

In FIG. 26, reference numeral 101 denotes an electrophotographic photoreceptor (hereinafter referred to as "photosensitive drum"). While the photosensitive drum 101 is rotationally driven in the arrow direction at a predetermined peripheral speed, and the surface thereof is uniformly charged to a predetermined negative dark potential VO by a charger 102.

Reference numeral 103 denotes a laser beam scanner, which outputs a laser beam that has been modulated in accordance with a time-series electric digital image signal of image information that is input from a host device (not shown in the drawings) such as an image reading device or a computer. The surface of the photosensitive drum 101, which uniformly has been charged as described above, is scanned and exposed by the laser beam. Thereby, the absolute potential of the exposed portion is decreased to the light potential VL, and an electrostatic latent image is formed. This electrostatic latent image is then developed with negatively charged toner using in a developing device 104 and made manifest.

The developing device 104 includes a developing roller 104*a*. The developing roller 104*a* is driven rotationally and arranged in opposition to the photosensitive drum 101. On an outer peripheral surface of the developing roller 104*a*, a thin layer of toner is formed. A developing bias voltage, whose absolute value is lower than the dark potential VO and higher than the light potential VL of the photoelectric drum 101, is applied to the developing roller 104*a*. The toner on the developing roller 104*a* is thus transferred only to the portion of the photosensitive drum 101 with the light potential VL, whereby the electrostatic latent image is made manifest to form a toner image.

On the other hand, recording paper 115 is fed one by one from a paperfeed portion 110 to a nip portion formed between the photosensitive drum 101 and a transfer roller 113 via a resist roller pair 111 and 112 with suitable timing in synchronization with the rotation of the photosensitive drum 101. Then, the toner image on the photosensitive drum 101 is transferred sequentially to the recording paper 115 by the transfer roller 113 to which a transfer bias is applied. After the recording paper 115 carrying the transferred toner image has separated from the photosensitive drum 101, it is fed into a fixing device 116, whereby the toner image that has been transferred to the recording paper 115 is fixed. The recording paper 115 on which the toner image is fixed is discharged to a paper eject tray 117.

After the recording paper 115 has separated from the photosensitive drum 101, the surface of the photosensitive drum 101 is cleaned with a cleaning device 105, which removes residual material such as remaining toner so that the photosensitive drum 101 can be used repeatedly for subsequent image formation.

Hereinafter, a fixing device as an image heating device according to this embodiment will be described more specifically.

Figure 27:
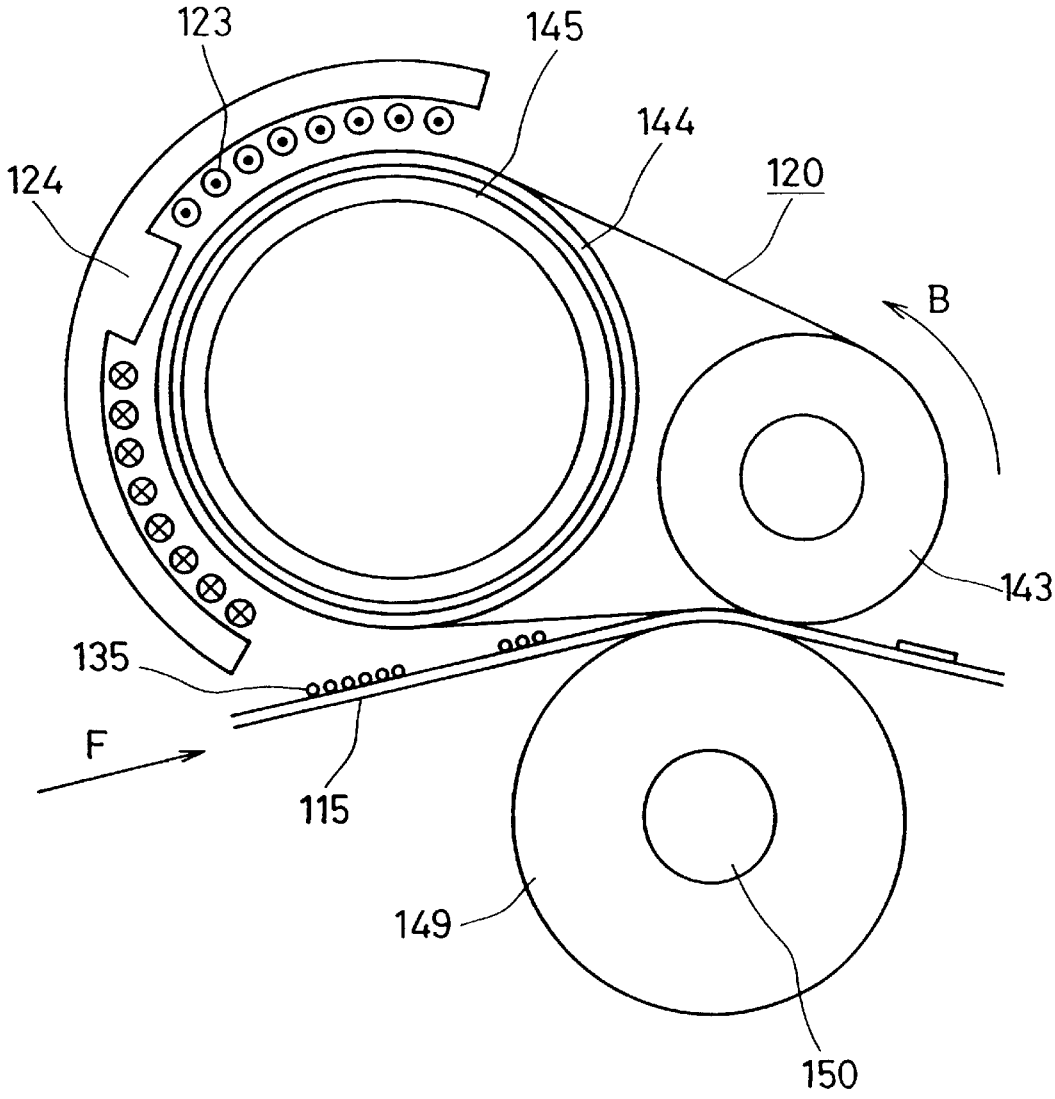
FIG. 27 is a cross-sectional view showing a fixing device as an image heating device according to a tenth embodiment of the present invention.
Figure 28:
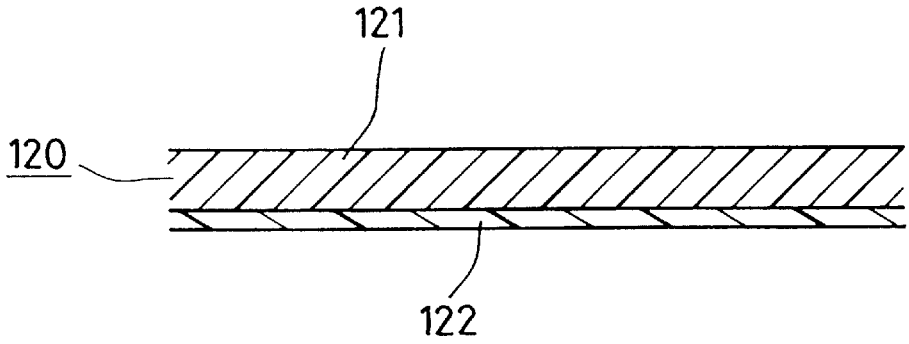
FIG. 28 is a cross-sectional view showing a fixing belt used for a fixing device as an image heating device according to a tenth embodiment of the present invention.
Figure 29:
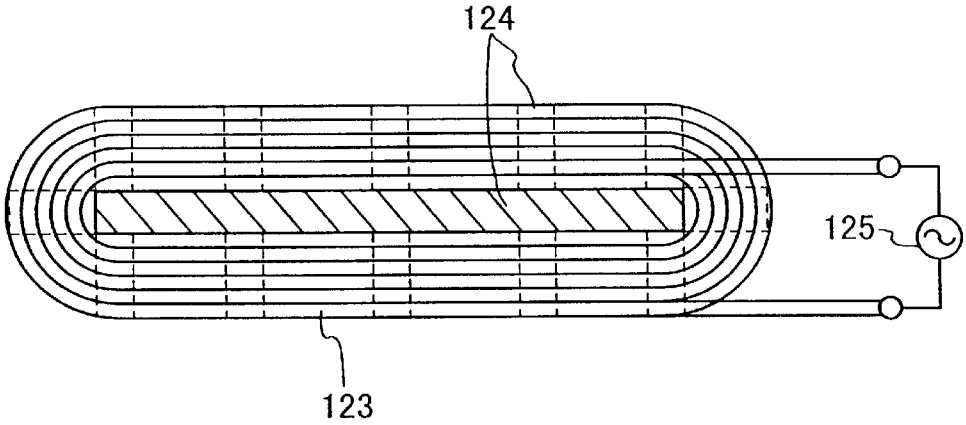
FIG. 29 is a front view showing an exciting coil and a core member used for a fixing device as an image heating device according to a tenth embodiment of the present invention.
Figure 30:
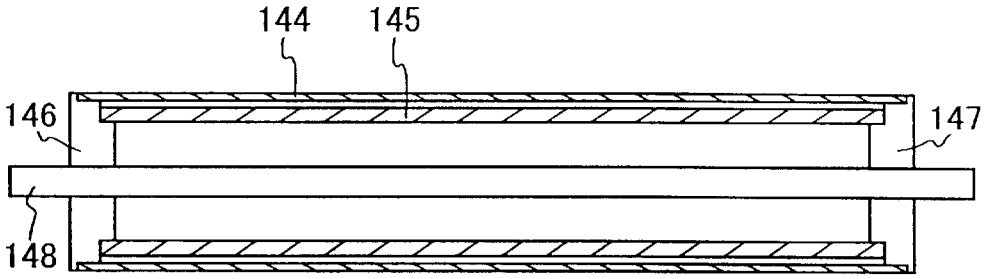
FIG. 30 is a cross-sectional view showing a heat-generating roller used for a fixing device as an image heating device according to a tenth embodiment of the present invention.

FIG. 27 is a cross-sectional view showing a fixing device as an image heating device according to a tenth embodiment of the present invention; FIG. 28 is a cross-sectional view showing a fixing belt used for a fixing device as an image heating device according to a tenth embodiment of the present invention; FIG. 29 is a front view showing an exciting coil and a core member used for a fixing device as an image heating device according to a tenth embodiment of the present invention; and FIG. 30 is a cross-sectional view showing a heat-generating roller used for a fixing device according to a tenth embodiment of the present invention.

In FIGS. 27 and 28, a fixing belt 120, which is made thin, is an endless belt of 50 mm diameter and 50 $\mu$m thickness, which comprises the polyimide resin as a base 121. The surface of the fixing belt 120 is coated with a lubricant layer 122 made of fluorocarbon resin of 5 $\mu$m thickness for enhancing lubrication. For the material of the base 121, in addition to a material having a heat resistance, such as polyimide resin, fluorocarbon resin, or the like, an extremely thin metal made of electroforming nickel etc. may be used. Furthermore, for the lubricant layer 122, a resin or rubber with good lubrication, such as PTFE, PFA, FEP, silicone rubber, or fluorocarbon rubber may be used alone or in combination. If the fixing belt 120 is used to fix monochrome images, it is sufficient that only lubrication is ensured. However, if the fixing belt 120 is used to fix color images, it is desirable that the fixing belt 120 has elasticity. In this case, a thicker rubber layer is required to be formed.

Reference numeral 123 denotes an exciting coil as a heat-generating means. The cross section of the exciting coil 123 is formed so as to cover the fixing belt 120.

As shown in FIGS. 27 and 29, a rear face core 124 made of ferrite is provided in the center of the exciting coil 123 as well as in a portion of the rear surface of the exciting coil 123. For the rear face core 124, a material having high magnetic permeability and high resistivity such as Permalloy etc. also can be used in addition to ferrite. Furthermore, the rear face core 124 is provided only in a portion of the rear surface of the exciting coil 123 and serves to prevent the magnetic flux from leaking out from the rear surface of the exiting coil 123. To the exciting coil 123, an alternating current of 30 kHz is applied from an exciting circuit 125. Hereinafter, the alternating current applied to the exciting coil 123 is also referred to as "an exciting current."

As shown in FIG. 27, the fixing belt 120 is suspended with a predetermined tensile force between the heat-generating member 144 and the fixing roller 143 of 20 mm diameter, with low thermal conductivity, whose surface is made of elastic foamed silicone rubber with low hardness (JISA 30 degrees) and is rotationally movable in the direction of the arrow B. The heat-generating roller 144 is formed of a magnetic material, an iron—nickel—chromium alloy having a thickness of 0.4 mm, and has a Curie point that is adjusted to be 220° C. by the amount of chromium that is contained in the material. A conductive roller 145 as a conductive member is provided inside the heat-generating roller 144 with a gap of 0.5 mm therebetween. The conductive roller 145 has a thickness of 0.8 mm and is made of aluminum.

As shown in FIGS. 27 and 30, both ends of the heat-generating roller 144 and conductive roller 145 are supported by flanges 146 and 147 made of heat resistant resin having a small thermal conductivity such as Bakelite etc. Furthermore, the conductive roller 145 is arranged adiabatically with respect to the heat-generating roller 144. Thereby, the heat generated at the heat-generating roller 144 is not easily conducted to the conductive roller 145. The heat-generating roller 144 and the conductive roller 145 are rotationally driven around an axis 148 as a center by a driving means (not shown in the drawings) provided in image forming apparatus main body.

In FIG. 27, a pressure roller 149 as a pressure means is made of silicone rubber with a hardness of JIS A65 degrees. The pressure roller 149 is pressed against the fixing roller 143 via the fixing belt 120, thereby forming a nip portion. Herein, the pressure roller 149 is provided at the somewhat upper stream side in the direction in which the recording paper 115 is transferred with respect to just under the fixing roller 143 in the perpendicular direction. Thereby, in accordance with the movement of the fixing belt 120, first, the recording paper 115 comes into contact with the pressure roller 149. The pressure roller 149 is supported rotatably around the metal axis 150 in accordance with the rotation of the fixing belt 120. For the pressure roller 149, a heat-resistant resin or rubber such as other fluorocarbon rubber other than the silicone rubber or a fluorocarbon resin also may be used. In order to enhance the abrasion resistance and lubrication of the pressure roller 149, it is desirable that the surface of the pressure roller 149 is coated with a resin or rubber such as PFA, PTFE, FEP or the like alone or in combination. Furthermore, in order to prevent the heat radiation, it is desirable that the pressure roller 149 is made of the material having a low thermal conductivity.

In this embodiment, by configuring the heat-generating roller 144 as mentioned above, the heat-generating roller 144 is provided with a temperature self control property. Hereinafter, the operation thereof will be described with reference to FIGS. 31 and 32.

Figure 31:
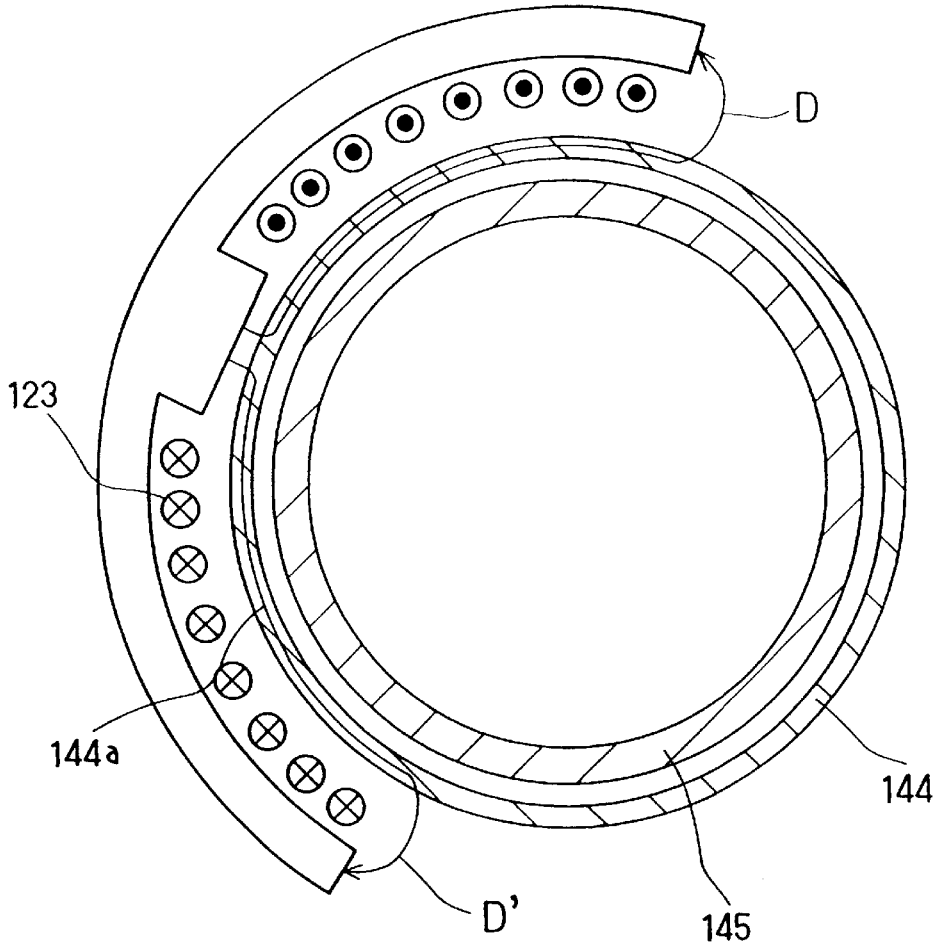
FIG. 31 is a view to explain the flow of the magnetic flux passing through the heat-generating roller used for a fixing device as an image heating device at a low temperature according to a tenth embodiment of the present invention.
Figure 32:
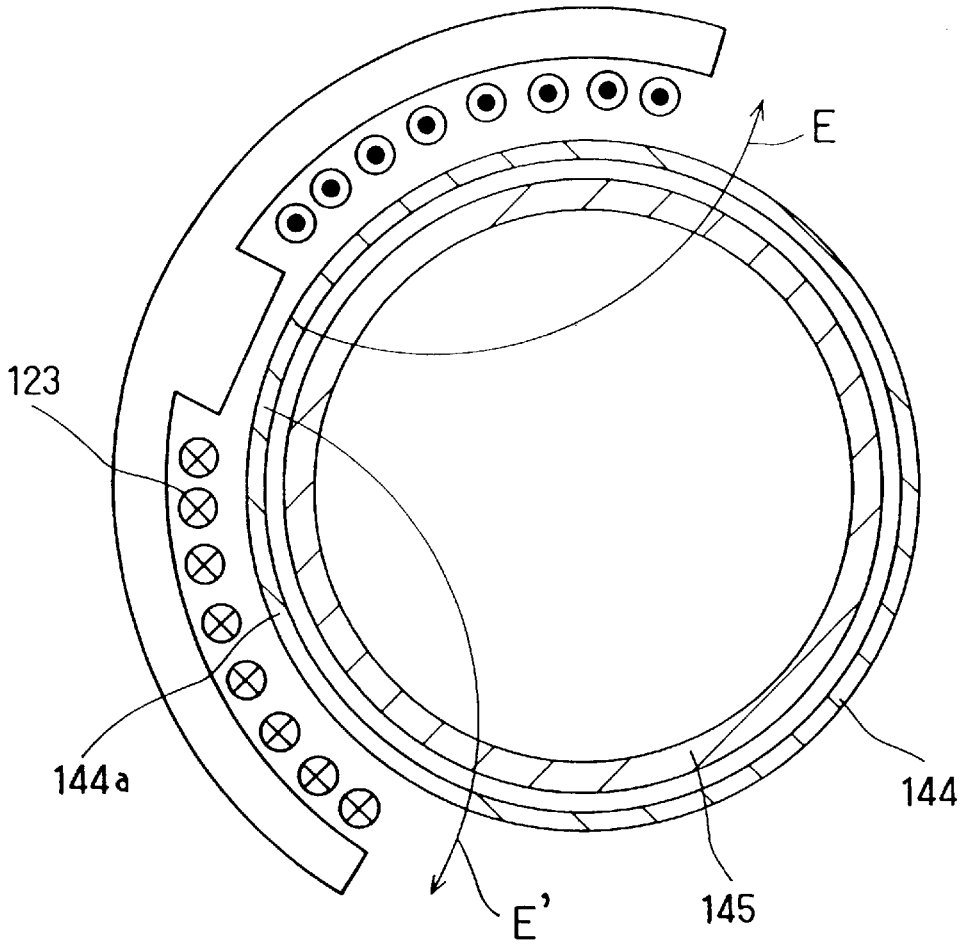
FIG. 32 is a view to explain the flow of the magnetic flux passing through a heat-generating roller used for a fixing device as an image heating device at a high temperature according to a tenth embodiment of the present invention.

In FIG. 31, when a temperature of the heat-generating portion 144*a* opposed to the exciting coil 123 of the heat-generating roller 144 is at the Curie point or less, most of the magnetic fluxes generated by the exciting current penetrates the heat-generating roller 144 as indicated by the arrows D and D' due to the magnetism of the heat-generating roller 144 and repeats generation and annihilation. The induced current generated by the change of the magnetic flux mainly flows through the surface of the heat-generating roller 144 due to the skin effect, thereby causing Joule heat at the portion where it flows. When the temperature of the heat-generating portion 144*a* of the heat-generating roller 144 reaches around the Curie point, the magnetism is lost. Consequently, as indicated by the arrows E and E' in FIG. 32, the magnetic flux diffuses toward the conductive roller 145 located inside the heat-generating roller 144. Thereby, the induced current overwhelmingly flows in the conductive roller 145 that has a low electric resistance. At this time, since the electric resistance of the conductive roller 145 is low, and by limiting the current to be constant, the occurrence of the heat generation substantially can be reduced. The calculated value of the depth of the portion where the electric current flows by the skin effect is about 0.3 mm when the frequency of exciting current is 30 kHz. If the thickness of the heat-generating roller 144 is equivalent to or larger than this skin depth, the induced current is generated inside the heat-generating roller 144 almost entirely when the temperature is low. If the frequency of the exciting current is increased, the skin depth decreases, and a thinner heat-generating roller 144 can be used accordingly. However, if the frequency of the exciting current is made too large, costs will rise and the noise reaching the outside becomes large.

In this embodiment, by configuring the heat-generating roller 144 as mentioned above, it was possible to realize a stable temperature control of about 190° C.

In this embodiment, the configuration in which the heat-generating roller 144 and the conductive roller 145 are formed in a two-layer structure is used. However, the present invention is not limited to this configuration alone. For example, the heat-generating roller formed of one layer of magnetic body having a thickness larger than the skin depth may be used. In this case, when the temperature of the heat-generating roller is below the Curie point, a portion where the induced current flows becomes thin, and the amount of heat generation is increased. On the other hand, when the temperature of the heat-generating roller exceeds the Curie point, the induced current flows almost all over the thickness of the magnetic body, and thus the electrical resistance decreases. Therefore, the amount of heat generation is decreased. Accordingly, also with this configuration, the temperature self control property can be obtained.

As mentioned above, when the thickness of the heat-generating roller 144 is equivalent to or larger than the skin depth corresponding to the frequency of the exciting current applied to the exciting coil 123, and the effect of the temperature self control can be enhanced.

Furthermore, in this embodiment, aluminum is used as a material for conductive roller 145. However, besides aluminum, other metal having a high conductivity such as copper or the like also may be used.

Furthermore, in this embodiment, for the material of the heat-generating roller 144, an iron—nickel—chromium alloy is used, but other alloys capable of setting the Curie temperature may be used. In this case, the same effect can be obtained.

The fixing device having a configuration mentioned above is attached to an image forming apparatus shown in FIG. 26 and a recording paper 115 on which a toner image has been transferred is inserted into the fixing device in the direction of the arrow F with the side carrying the toner image facing the fixing roller 143, as shown in FIG. 27, thereby fixing the toner image on the recording paper 115.

According to this embodiment, since the heat-generating roller 144 itself has temperature self control property, the temperature of the heat-generating portion 144*a* is not raised abnormally and the temperature control of substantially the same temperature as the fixing temperature can be carried out automatically. This effects the local difference in temperature in the depth direction (in the direction of the rotation axis of the heat-generating roller 144) of FIG. 27, which may lead to the local difference of the heat generation. Therefore, if the small size of recording paper is used continuously, the temperature of the portion where the recording paper does not pass through is not abnormally increased. Furthermore, when the larger size recording paper is used following the use of the small size recording paper, hot offset does not occur.

Furthermore, the material, thickness, etc. of the heat-generating roller 144 can be set independently from the material, thickness, etc. of the fixing belt 120. Therefore, it is possible to select the optimal material and thickness for providing the temperature self control property as the material and thickness of the heat-generating roller 144. Furthermore, since the thermal capacity of the fixing belt 120 also can be set independently from the thermal capacity of the heat-generating roller 144, the optimal value can be selected as the thermal capacity of the fixing belt 120.

Furthermore, the fixing roller 143 is formed of a foam, whose thermal conductivity is low. Therefore, a gap that is present inside prevents the heat stored in the fixing belt 120 from radiating due to the contact between the fixing belt 120 and the fixing roller 143. Thus, the thermal efficiency becomes excellent.

In this embodiment, in order to shorten the warm-up time, the thermal capacity of the fixing belt 120 is set as small as possible and at the same time, the thickness of the heat-generating roller 144 is set small to make its thermal capacity small. In order to speed up the rise time, as in this embodiment, if the thickness of the heat-generating roller 144 is set small to make its thermal capacity the same level as the thermal capacity of the fixing belt 120, amount of heat stored in the heat-generating roller 144 is extremely small. Therefore, even if the heat is stored in the heat-generating roller 144, its temperature decreased immediately. In other words, in the method of heating the heat-generating roller 144 at the portion other than the contact portion with the fixing belt 120, and thereby the fixing belt 120 is warmed up, the heat-generating roller 144 itself is required to be heated to considerably high temperature in order to provide a sufficient amount of heat to the fixing belt 120. Furthermore, the fixing belt 120 that is cooled down when passing through the nip portion occasionally may be cooled down to significantly different temperatures due to the temperatures of the pressure roller 149 or fixing roller 143, or the temperature condition of the recording paper 115. Therefore, in the above-mentioned method, the temperature of the heat-generating roller 144 can be set significantly different accordingly.

Thus, in this embodiment, since the heat generation is carried out in the portion where the heat-generating roller 144 is in contact with the fixing belt 120, and the necessary heat is conducted to the fixing belt 120 immediately, it is not necessary to increase the temperature of the heat-generating roller 144 more than necessary. Furthermore, in the portion just past the contact portion in which the heat-generating roller 144 and the fixing belt 120 are in contact with each other, heat is hardly generated. Therefore, by controlling the temperature of this portion at constant, it is possible to maintain the temperature of the fixing belt 120 constant when the fixing belt 120 enters the nip portion. As a result, stable fixing is possible regardless of the temperature conditions of the pressure roller 149, etc.

Furthermore, in this embodiment, since the fixing belt 120 heated by the heat-generating roller 144 is brought into contact with the recording paper 115 earlier than the fixing roller 143, it is possible to melt the toner 135 on the recording paper 115 in a state in which the necessary temperature is held. Furthermore, since the thermal capacity of the fixing belt 120 is small, when the fixing belt 120 starts to be brought into contact with the recording paper 115, the heat starts to be removed by the recording paper 115, and when the recording paper 115 is separated from the fixing belt 120 after passing through the nip portion, the temperature of the fixing belt 120 is reduced considerably. As a result, it is possible to prevent the occurrence of hot offset.

Furthermore, in this embodiment, since the heat-generating roller 144 (heat-generating portion) is provided inside the fixing belt 120, and in the meanwhile the exciting coil 123 and the rear face core 124 is provided outside the fixing belt 120, it is possible to prevent the temperature of the exciting coil 123 and the like from being increased due to the effect of the temperature of the heat-generating portion. Therefore, the amount of heat generation can be maintained stably.

Moreover, in this embodiment, the fixing belt 120 is made of resin. However, instead of resin, a metal may be used. In this case, a part of the heat is generated in the fixing belt 120 with the electromagnetic induction. However, if the thickness of the fixing belt 120 is extremely thin, the magnetic flux generated by the exciting current permeates the fixing belt 120 and reaches the heat-generating roller 144, which allows the heat-generating roller 144 to carry out the temperature self control similar to the above.

Furthermore, in this embodiment, the heat-generating roller 144 and the conductive roller 145 are arranged adiabatically. However, even if these rollers are arranged in close contact with each other, the heat-generating roller 144 similarly can be provided with the temperature self control property. In this case, the thermal capacity of the heat-generating roller 144 itself is somewhat increased, thus increasing the warm-up time accordingly.

Furthermore, this embodiment describes the case where the surface temperature of the fixing belt 31 becomes a predetermined fixing temperature due to the temperature self control of the heat-generating roller 144. However, the temperature self control property of the heat-generating roller 144 is not necessarily applied to this case alone. For example, this may be used for preventing the apparatus from being heated abnormally in order to secure the safety of the apparatus from damage by setting the temperature of the temperature self control at higher, while controlling the fixing temperature by detection with the usual thermistor etc.

Eleventh Embodiment

Figure 33:
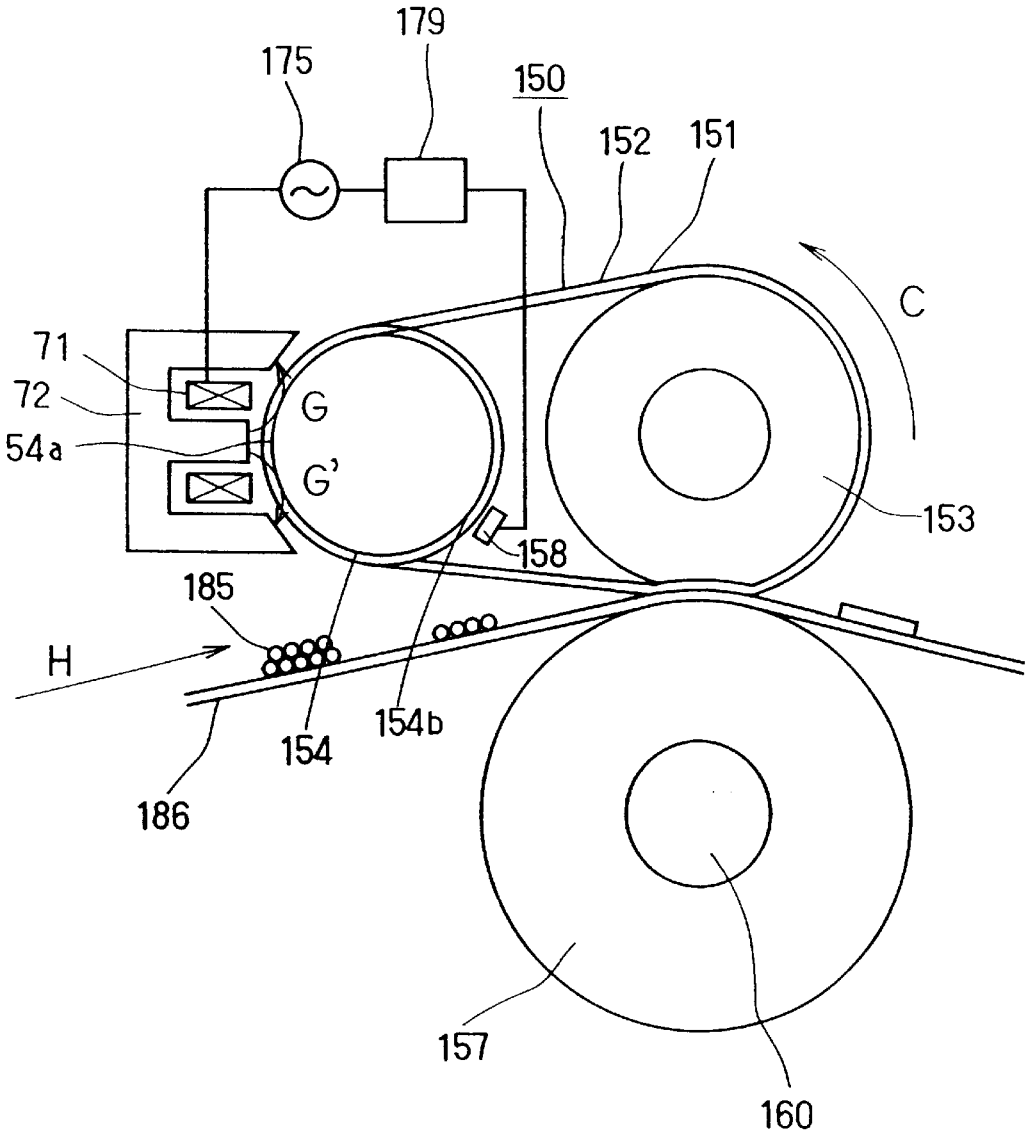
FIG. 33 is a cross-sectional view showing a fixing device as an image heating device for fixing a color image according to an eleventh embodiment of the present invention.
Figure 34:
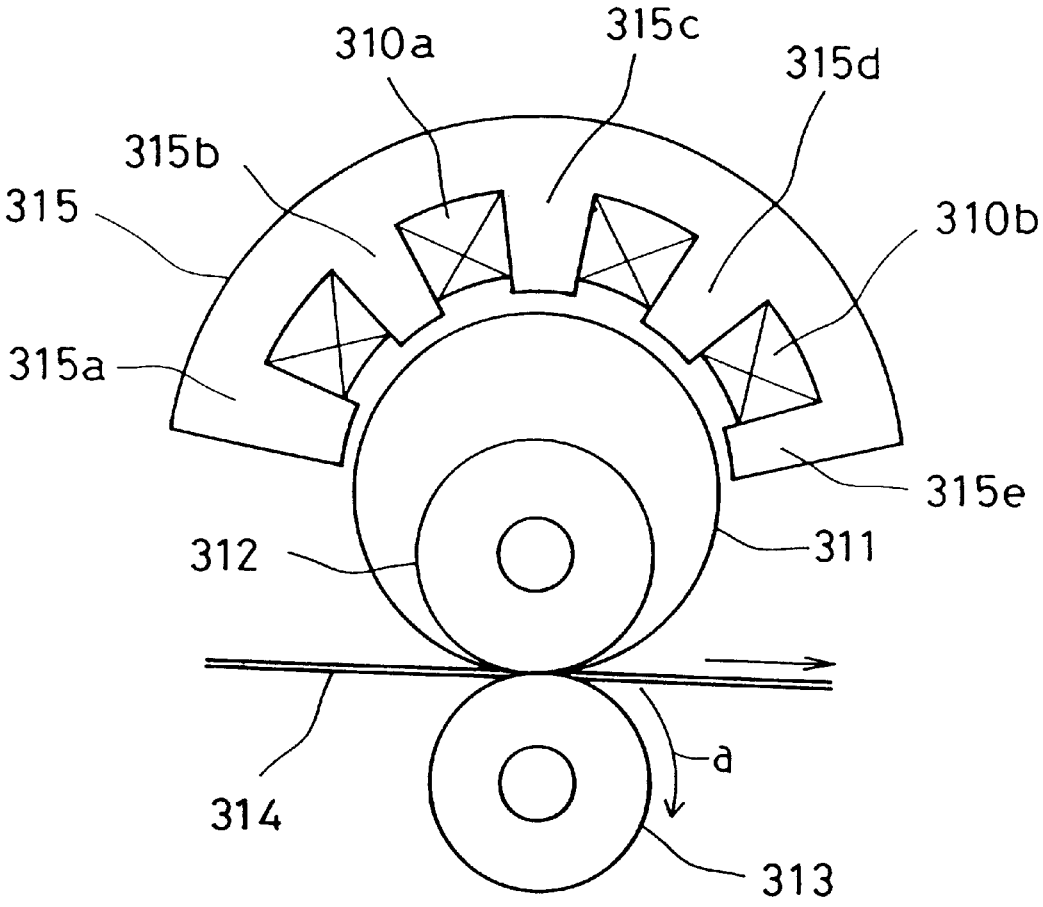
FIG. 34 PRIOR ART
FIG. 34 is a cross-sectional view showing a conventional image heating device.
Figure 35:
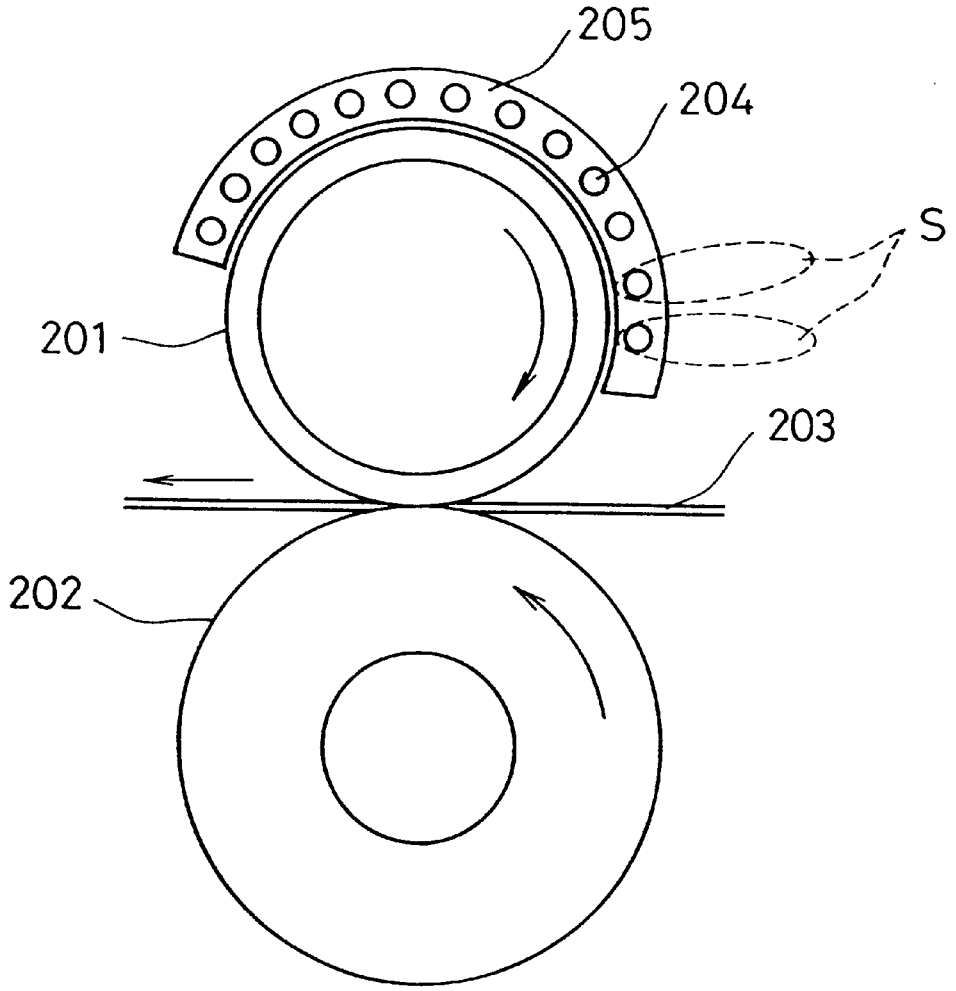
FIG. 35 PRIOR ART
FIG. 35 is a cross-sectional view showing another example of a conventional image heating device.
Figure 36:
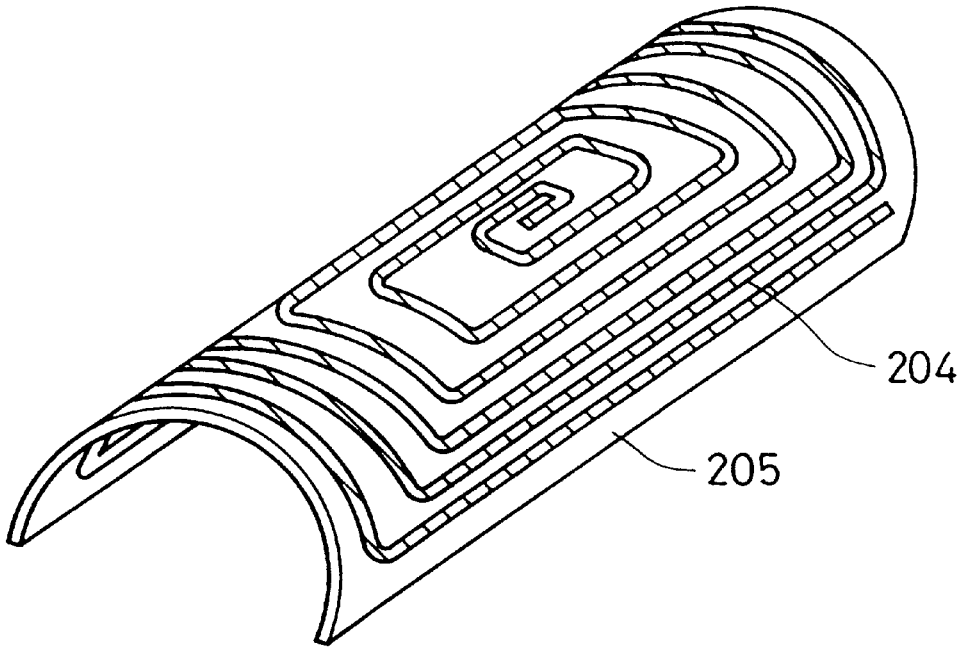
FIG. 36 PRIOR ART
FIG. 36 is a perspective view showing a heating coil used for another example of a conventional image heating device.
Figure 37:
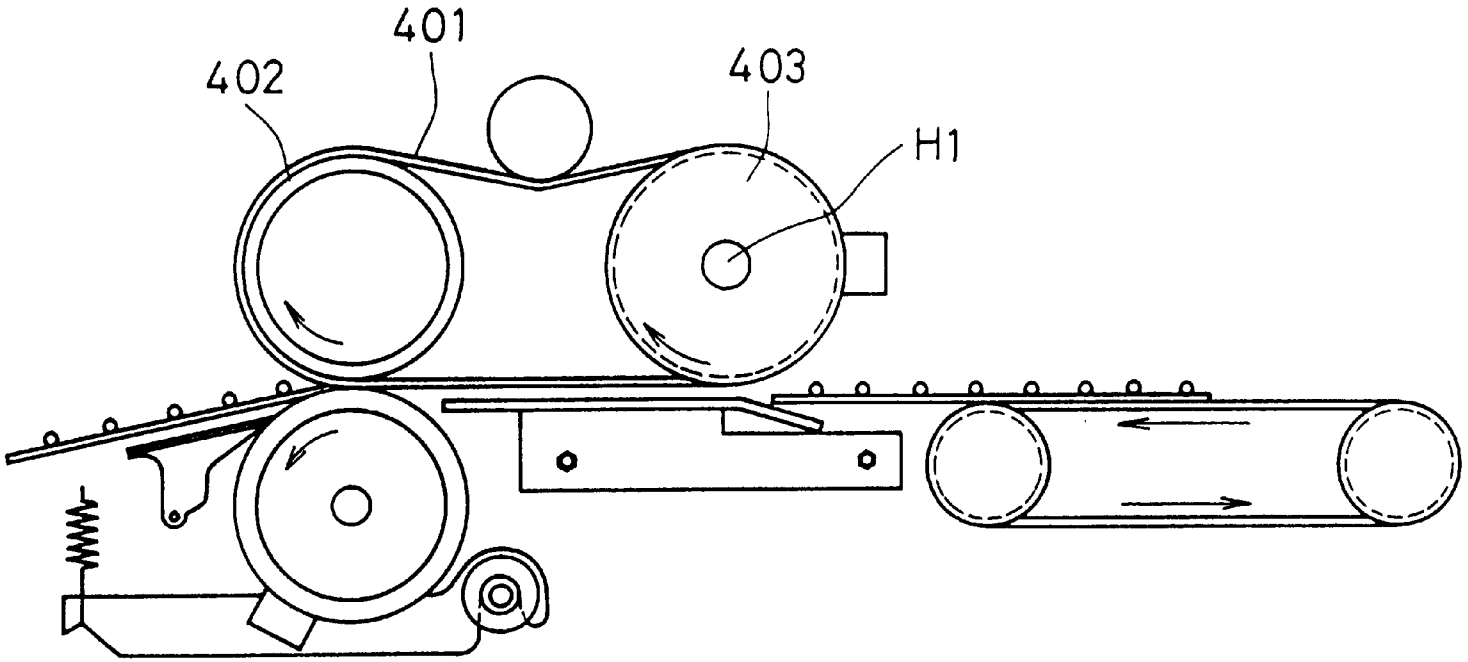
FIG. 37 PRIOR ART
FIG. 37 is a cross-sectional view showing a further example of a conventional image heating device.

Next, the fixing device for fixing color images as an image heating device according to an eleventh embodiment of the present invention will be described with reference to FIG. 33. In this embodiment, for portions having the same configuration and performing the same function as in the tenth embodiment, the detailed explanations therefor are omitted.

A fixing belt 150 according to this embodiment is an endless belt of 50 mm diameter and 80 $\mu$m thickness, which comprises a polyimide resin as a base 151. The surface of the fixing belt 150 is coated with a silicone rubber 152 of 150 $\mu$m thickness for fixing color images. Also in this embodiment, since heat generation is performed with the heat-generating roller 154, an extremely thin metal or film-shaped heat resistant resin such as fluorocarbon resin other than a metal can be used for the fixing belt 150, The fixing belt 150 is suspended with predetermined tensile force between the fixing roller 153 of 30 mm diameter, which is configured similarly to that of the tenth embodiment, and the heat-generating member 154 of 0.4 mm thickness, and is rotationally movable in the direction of the arrow C. The heat-generating roller 154 is made of magnetic stainless steel. The pressure roller 157 is made of silicone rubber with a hardness of JIS A60 degrees, and pressed against the fixing roller 153 via the fixing belt 150, thereby forming a nip portion. The pressure roller 157 is supported rotatably around the metal axis 160 following the rotation of the fixing belt 150.

Reference numeral 171 denotes an exciting coil; and 172 denotes a rear face core. The exciting coil 171 and the rear face core 172 are provided in opposition to the heat-generating roller 154 with a small gap therebetween via the fixing belt 150. The rear face core 172 is formed in an E-shaped cross section, and the exciting coil 171 is wound around the convex portion in the middle of the E-shaped cross section. Similar to the tenth embodiment, the exciting current having a frequency of 30 kHz is applied to the exciting coil 171 from an exciting circuit 175, thereby causing repeated generation and annihilation of the magnetic flux as indicated by arrows G and G'. As a result, the heat-generating roller 154 is magnetized from a heat generating portion 154*a*, at which the heat generating roller 154 and the fixing belt 150 are in contact with each other, as a center of magnetization, thereby causing an eddy current. Therefore, the heat-generating portion 154*a* of the heat-generating roller 154 is heated. At this time, the eddy current generated in the heat-generating roller 154 mainly passes through the portion shallower than the skin depth, which is determined depending on the magnetic permeability and specific resistance of the material used for the heat-generating roller 154 and the frequency of the exciting current applied to the heat-generating roller 154. From the property of the stainless steel material used for the heat-generating roller 154 and the frequency of the exciting current applied, the skin depth is calculated to be about 0.3 mm. Since the thickness of the heat-generating roller 154 is set to 0.4 mm, almost of the heat generation occurrs in the portion of the heat-generating roller 154 between its surface and the depth determined by the skin depth. Therefore, irregularity in the thickness of the heat-generating roller 154 does not cause irregularity in heat generation. Thus, uniform heat generation can be attained. Furthermore, since the heat-generating roller 154 generates heat mainly from the surface in contact with the fixing belt 150, and the heat from the heat-generating roller 154 can be conducted to the fixing belt 150 efficiently.

A temperature sensor 158 is provided so as to be in contact with the surface of the heat-generating roller 154 at a portion 154*b* just past the contact portion in which the heat-generating roller 154 and the fixing belt 150 are in contact with each other. The detected output from the temperature sensor 158 controls the output from an exciting circuit 175 via a controlling means 179. Thereby, the amount of the heat generated by the heat-generating roller 154 is controlled so that the temperature of the portion 154*b* just past the contact portion in which the heat-generating roller 154 and the fixing belt 150 are in contact with each other is kept constant at all times.

The fixing device with the above configuration was attached to a color image forming apparatus (not shown in the drawing). Recording paper 186, onto which a color image has been formed using a sharp-melting color toner 185 based on polyester, was inserted into the fixing device in the direction of the arrow H in FIG. 33, thereby fixing the toner image onto the recording paper 186.

In this embodiment, since the heat generation is carried out in the portion where the heat-generating roller 154 is in contact with the fixing belt 150, and the heat is conducted to the fixing belt 150 immediately, it is not necessary to increase the temperature of the heat-generating roller 154 more than necessary. Furthermore, by detecting the temperature of the portion 154*b* just past the contact portion in which the heat-generating roller 154 and the fixing belt 150 are in contact with each other, the amount of heat generation is controlled. Therefore, the temperature of the fixing belt 150 always can be maintained at the optimum temperature for fixing.

Furthermore, the fixing belt 150 that is cooled down when passing through the nip portion occasionally may be cooled down to a significantly different temperature depending upon the temperatures of the pressure roller 157 and the fixing roller 153, or the temperature condition of the recording paper 186. However, heat generation is carried out at the portion where the heat-generating roller 154 is in contact with the fixing belt 150, and the amount of heat generation is controlled so that the temperature of the portion 154*b* just past the contact portion in which the heat-generating roller 154 and the fixing belt 150 are in contact with each other is constant. Therefore, regardless of the temperature drop of the fixing belt 150, it is possible to control the amount of heat generation stably. Therefore, even if the thermal capacity of the heat-generating roller 154 is made to be extremely small, it is not necessary to change the temperature control of the heat-generating roller 154 in accordance with the drop of the temperature of the fixing belt 150, and it is possible to maintain the temperature of the fixing belt 150 constant when the fixing belt 150 enters the nip portion.

Furthermore, in this embodiment, since the thermal capacity of the fixing belt 150 is small, when the fixing belt 150 starts to be brought into contact with the recording paper 186, the heat starts to be removed by the recording paper 186, and when the recording paper 186 is separated from the fixing belt 150 after passing through the nip portion, the temperature of the fixing belt 150 is decreased considerably. As a result, even if the temperature of the fixing belt 150 when entering the nip portion is set to be considerably high, no hot offset occurs. In this embodiment, by detecting the temperature of the portion 154*b* just past the contact portion in which the heat-generating roller 154 and the fixing belt 150 are in contact with each other, the amount of heat generation can be controlled. Therefore, it is possible to finely control the temperature of the front portion of the nip portion. Accordingly, even in the case of using the sharp-melting color toner 185, it is possible to fix the color toner 185 without the occurrence of hot offset while melting the color toner 185 sufficiently.

Furthermore, in the portion just past the contact portion in which the heat-generating roller 154 and the fixing belt 150 are in contact with each other, heat is hardly generated. Therefore, by controlling the temperature of this portion at constant, it is possible to maintain the temperature of the fixing belt 150 constant when the fixing belt 150 enters the nip portion. As a result, stable fixing is possible regardless of the temperature conditions of the pressure roller 157, etc.

Furthermore, the fixing roller 153 is formed of a foam, whose thermal conductivity is low. Therefore, a gap that is present inside prevents the heat stored in the fixing belt 150 from radiating due to the contact between the fixing belt 150 and the fixing roller 153. Thus, the thermal efficiency becomes excellent. In this embodiment, since the hardness of the fixing roller 153 is set to be considerably lower than the hardness of the pressure roller 157, the fixing belt 150 is deformed along the outer circumference of the pressure roller 157 at the nip portion. Therefore, when the recording paper 186 passes through the nip portion and is ejected, the recording paper 186 is ejected in the direction in which the recording paper 186 is separated from the fixing belt 150. Thus, the peelability is extremely excellent.

Industrial Applicability

As mentioned above, according to the present invention, it is possible to realize an image heating device which is not necessary to supply a large amount of current to the exciting coil in obtaining the electric power necessary to allow the heat-generating member to generate heat. Therefore, the present invention can be applied to the fixing device used in an image forming apparatus, such as an electrophotographical apparatus, an electrostatic recording apparatus or the like, in which shortening of the warm-up time and energy saving or the like are taken into account.

What is claimed is:

1. An image heating device comprising:

a heat-generating member comprising a rotatable body having conductivity, and an exciting coil arranged in opposition to the outer peripheral surface of the heat-generating member and adapted for allowing the heat-generating member to generate heat with electromagnetic induction, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein a larger number of bundled wires are superimposed at both ends in a direction away from the heat-generating member than at the central portion in the direction of the rotation axis of the heat-generating member.

2. An image forming apparatus comprising:

an image forming means for forming an unfixed image onto a recording material and having the unfixed image carried thereon; and a fixing device for fixing the unfixed image onto the recording material, wherein an image heating device according to claim 1 is used as the fixing device.

3. An image heating device comprising:

a heat-generating member comprising a rotatable body having conductivity, and an exciting coil arranged in opposition to the peripheral surface of the heat-generating member and adapted for allowing the heat-generating member to generate heat with electromagnetic induction, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the exciting coil has an inductance of 10 $\mu$H or more and 50 $\mu$H or less and an electric resistance of 0.5 $\Omega$ or more and 5 $\Omega$ or less where an alternating current of a frequency of 25 kHz to 50 kHz is applied to the exciting coil in a state in which the exciting coil is opposed to the heat-generating member.

4. An image forming apparatus comprising:

an image forming means for forming an unfixed image onto a recording material and having the unfixed image carried thereon; and a fixing device for fixing the unfixed image onto the recording material, wherein an image heating device according to claim 3 is used as the fixing device.

5. An image heating device comprising:

a heat-generating member comprising a rotatable body having conductivity;

an exciting coil arranged in opposition to the outer peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the length of the core along the direction of the rotation axis of the heat-generating member is shorter than the length of the heat-generating member in the direction of the rotation axis thereof.

6. An image forming apparatus comprising:

an image forming means for forming an unfixed image onto a recording material and having the unfixed image carried thereon; and a fixing device for fixing the unfixed image onto the recording material, wherein an image heating device according to claim 5 is used as the fixing device.

7. An image heating device comprising:

a heat-generating member comprising a rotatable body having conductivity;

an exciting coil arranged in opposition to the outer peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the length of the exciting coil at the outer peripheral portion in the direction of the rotation axis of the heat-generating member is not shorter than the width of a recording material having the maximum width in all the recording materials to be used; and the length of the core in the direction of the rotation axis of the heat-generating member is not shorter than the width of the recording material having a maximum width of all the recording materials to be used.

8. An image forming apparatus comprising:

an image forming means for forming an unfixed image onto a recording material and having the unfixed image carried thereon; and a fixing device for fixing the unfixed image onto the recording material, wherein an image heating device according to claim 7 is used as the fixing device.

9. An image heating device comprising:

a heat-generating member comprising a rotatable body having conductivity;

an exciting coil arranged in opposition to the outer peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the distance between the end face of the core and the end face of the heat-generating member in the direction of the rotation axis of the heat-generating member is longer than the facing space between the core and the heat-generating member.

10. An image forming apparatus comprising:

an image forming means for forming an unfixed image onto a recording material and having the unfixed image carried thereon; and a fixing device for fixing the unfixed image onto the recording material, wherein an image heating device according to claim 9 is used as the fixing device.

11. An image heating device comprising:

a heat-generating member comprising a rotatable body having conductivity;

an exciting coil arranged in opposition to the outer peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the heat-generating member is supported by a support member made of magnetic material, and a space between the support member and the core is twice or more the facing space between the core and the heat-generating member.

12. An image forming apparatus comprising:

an image forming means for forming an unfixed image onto a recording material and having the unfixed image carried thereon; and a fixing device for fixing the unfixed image onto the recording material, wherein an image heating device according to claim 11 is used as the fixing device.

13. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, wherein the core has opposing portions opposed to the heat-generating member without sandwiching the exciting coil between the opposing portion and the heat-generating member, and magnetic permeable portions opposed to the heat-generating member via the exciting coil, and wherein the length between the outermost ends of the magnetic permeable portion along the direction of the rotation axis of the heat-generating member is not longer than the length between the outermost ends of the opposing portion along the direction of the rotation axis of the heat-generating member.

14. An image forming apparatus comprising:

an image forming means for forming an unfixed image onto a recording material and having the unfixed image carried thereon; and a fixing device for fixing the unfixed image onto the recording material, wherein an image heating device according to claim 13 is used as the fixing device.

15. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein at least a part of the core has gaps in the direction of the rotation axis of the heat-generating member.

16. The image heating device according to claim 15, wherein the core has opposing portions opposed to the heat-generating member without sandwiching the exciting coil between the opposing portion and the heat-generating member, and magnetic permeable portions opposed to the heat-generating member via the exciting coil, and the gaps in the magnetic permeable portion of the core are distributed nonuniformly in the direction of the rotation axis of the heat-generating member.

17. The image heating device according to claim 16, wherein the gap in the magnetic permeable portion of the core is smaller in the end portion than in the central portion in the direction of the rotation axis of the heat-generating member.

18. The image heating device according to claim 15, wherein the core has opposing portions opposed to the heat-generating member without sandwiching the exciting coil between the opposing portion and the heat-generating member, and magnetic permeable portions opposed to the heat-generating member via the exciting coil, and the opposing portions of the core are arranged asymmetrically with respect to a center line of the exciting coil in the direction of the rotation axis of the heat-generating member.

19. The image heating device according to claim 15, wherein the core has opposing portions opposed to the heat-generating member without sandwiching the exciting coil between the opposing portion and the heat-generating member, and magnetic permeable portions opposed to the heat-generating member via the exciting coil, and the gap in the opposing portion of the core is smaller than the gap in the magnetic permeable portion of the core in the direction of the rotation axis of the heat-generating member.

20. The image heating device according to claim 15, wherein the core has opposing portions opposed to the heat-generating member without sandwiching the exciting coil between the opposing portion and the heat-generating member, and magnetic permeable portions opposed to the heat-generating member via the exciting coil, and the opposing portions of the core are provided continuously in the direction of the rotation axis of the heat-generating member.

21. An image forming apparatus comprising:

an image forming means for forming an unfixed image onto a recording material and having the unfixed image carried thereon; and a fixing device for fixing the unfixed image onto the recording material, wherein an image heating device according to claim 15 is used as the fixing device.

22. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the heat-generating member is formed in the shape of pipe, and the cross-sectional area of the surface of the inside of the heat-generating member perpendicular to the rotation axis thereof is smaller than the maximum cross-sectional area of the core and exciting coil.

23. An image forming apparatus comprising:

an image forming means for forming an unfixed image onto a recording material and having the unfixed image carried thereon; and a fixing device for fixing the unfixed image onto the recording material, wherein an image heating device according to claim 22 is used as the fixing device.

24. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction; and a core made of magnetic material arranged outside the exciting coil, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein a part of the core is divided, thereby forming a movable portion and the movable portion is held movably with respect to the remaining portion of the core.

25. The image heating device according to claim 24, wherein the movable portion is arranged outside the region in which a recording material to be used passes through and is allowed to be movable with respect to the remaining portion of the core.

26. An image forming apparatus comprising:

an image forming means for forming an unfixed image onto a recording material and having the unfixed image carried thereon; and a fixing device for fixing the unfixed image onto the recording material, wherein an image heating device according to claim 24 is used as the fixing device.

27. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction;

a core made of magnetic material arranged on an outside face of the exciting coil; and a shielding member made of conductive material covering at least a part of an outside face of the core, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place.

28. An image forming apparatus comprising:

an image forming means for forming an unfixed image onto a recording material and having the unfixed image carried thereon; and a fixing device for fixing the unfixed image onto the recording material, wherein an image heating device according to claim 27 is used as the fixing device.

29. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction;

a core made of magnetic material arranged on a rear face of the exciting coil that is not opposed to the heat-generating member; and a cooling means for cooling the core from the side of the rear face by air flow, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place.

30. An image forming apparatus comprising:

an image forming means for forming an unfixed image onto a recording material and having the unfixed image carried thereon; and a fixing device for fixing the unfixed image onto the recording material, wherein an image heating device according to claim 29 is used as the fixing device.

31. An image heating device comprising:

a heat-generating member comprising a rotatable body having conductivity;

an exciting coil arranged in opposition to the outer peripheral surface of the heat-generating member and adapted for allowing the heat-generating member to generate heat with electromagnetic induction; and a heat insulating member for shielding a thermal conduction between the exciting coil and the heat-generating member, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place, and wherein the length of the heat insulating member along the direction of the rotation axis is shorter than the length of the heat-generating member along the direction of the rotation axis.

32. The image heating device according to claim 31, further comprising a core made of magnetic material arranged outside the exiting coil, wherein the length of the exciting coil along the direction of the rotation axis of the heat-generating member is shorter than the length of the heat insulating member along the direction of the rotation axis of the heat-generating member and is longer than the length of the core along the direction of the rotation axis of the heat-generating member.

33. An image forming apparatus comprising:

an image forming means for forming an unfixed image onto a recording material and having the unfixed image carried thereon; and a fixing device for fixing the unfixed image onto the recording material, wherein an image heating device according to claim 31 is used as the fixing device.

34. An image heating device comprising:

a heat-generating member comprising a rotatable body having conductivity;

an exciting coil arranged in opposition to the peripheral surface of the heat-generating member and adapted for allowing the heat-generating member to generate heat with electromagnetic induction; and a fixing roller and a fixing belt suspended between the fixing roller and the heat-generating member, wherein the exciting coil is composed of a bundle of wires having an insulated surface, which are extended in the direction of the rotation axis of the heat-generating member and circumferentially wound along the circumferential direction of the heat-generating member, and the bundled wires extending in the direction of the rotation axis of the heat-generating member are arranged in close contact with each other in at least one place.

35. The image heating device according to claim 34, further comprising a core made of magnetic material arranged outside the exiting coil, wherein the core has opposing portions opposed to the heat-generating member without sandwiching the exciting coil between the opposing portion and the heat-generating member, and magnetic permeable portions opposed to the heat-generating member via the exciting coil, and the length between the outermost ends of the opposing portion along the direction of the rotation axis of the heat-generating member is not longer than the width of the fixing belt.

36. An image forming apparatus comprising:

an image forming means for forming an unfixed image onto a recording material and having the unfixed image carried thereon; and a fixing device for fixing the unfixed image onto the recording material, wherein an image heating device according to claim 34 is used as the fixing device.

37. The image heating device according to claim 34, wherein at least a part of the fixing belt has conductivity, and the exciting coil is opposed to the heat-generating member through the fixing belt and allows the fixing belt and the heat-generating member to be heated by induction heating.

38. An image heating device comprising:

a heat-generating member comprising a rotatable body having conductivity, and an exciting coil arranged in opposition to the outer peripheral surface of the heat-generating member and adapted for allowing the heat-generating member to generate heat with electromagnetic induction;

wherein the exciting coil composed of a bundle of wires having an insulated surface, which are extended in the direction of the rotation axis of the heat-generating member and circumferentially wound along the circumferential direction of the heat-generating member, and a larger number of bundled wires are superimposed at both ends in a direction away from the heat-generating member than at the central portion in the direction of the rotation axis of the heat-generating member.

39. An image forming apparatus comprising:

an image forming means for forming an unfixed image onto a recording material and having the unfixed image carried thereon; and a fixing device for fixing the unfixed image onto the recording material, wherein an image heating device according to claim 38 is used as the fixing device.

40. An image heating device comprising:

a heat-generating member comprising a rotatable body having conductivity, and an exciting coil arranged in opposition to the peripheral surface of the heat-generating member and adapted for allowing the heat-generating member to generate heat with electromagnetic induction;

further comprising a core made of magnetic material arranged outside the exciting coil, and the length of the core along the direction of the rotation axis of the heat-generating member is not shorter than the width of a recording material having the maximum width of all the recording materials to be used.

41. An image forming apparatus comprising:

an image forming means for forming an unfixed image onto a recording material and having the unfixed image carried thereon; and a fixing device for fixing the unfixed image onto the recording material, wherein an image heating device according to claim 40 is used as the fixing device.

42. An image heating device comprising:

a heat-generating member comprising a rotatable body having conductivity; and an exciting coil arranged in opposition to the peripheral surface of the heat-generating member and adapted for allowing the heat-generating member to generate heat with electromagnetic induction;

further comprising a core made of magnetic material arranged in a state in which the exciting coil is sandwiched between the core and the heat-generating member, the core has opposing portions opposed to the heat-generating member without sandwiching the exciting coil between the opposing portion and the heat-generating member, and magnetic permeable portions opposed to the heat-generating member via the exciting coil, wherein at least a part of the opposing portion is arranged in closer contact with the heat-generating member than the magnetic permeable portion, thereby forming an adjacent portion, and at least a part of the core has gaps in the direction of the rotation axis of the heat-generating member.

43. An image forming apparatus comprising:

an image forming means for forming an unfixed image onto a recording material and having the unfixed image carried thereon; and a fixing device for fixing the unfixed image onto the recording material, wherein an image heating device according to claim 42 is used as the fixing device.

44. An image heating device comprising:

a heat-generating member comprising a rotatable body having conductivity; and an exciting coil arranged in opposition to the peripheral surface of the heat-generating member and adapted for allowing the heat-generating member to generate heat with electromagnetic induction;

further comprising a core made of magnetic material arranged in a state in which the exciting coil is sandwiched between the core and the heat-generating member, the core has opposing portions opposed to the heat-generating member without sandwiching the exciting coil between the opposing portion and the heat-generating member, and magnetic permeable portions opposed to the heat-generating member via the exciting coil, wherein the area of the portion where the opposing portion is opposed to the heat-generating member is larger than the cross sectional area of the magnetic permeable portion perpendicular to the circumferential direction of the heat-generation member.

45. An image forming apparatus comprising:

an image forming means for forming an unfixed image onto a recording material and having the unfixed image carried thereon; and a fixing device for fixing the unfixed image onto the recording material, wherein an image heating device according to claim 44 is used as the fixing device.

46. An image heating device comprising:

a heat-generating member comprising a rotatable body having conductivity; and an exciting coil arranged in opposition to the peripheral surface of the heat-generating member and adapted for allowing the heat-generating member to generate heat with electromagnetic induction;

further comprising a core made of magnetic material arranged in a state in which the exciting coil is sandwiched between the core and the heat-generating member, wherein a part of the core is divided, thereby forming a movable portion and the movable portion is held movably with respect to the remaining portion of the core.

47. An image forming apparatus comprising:

an image forming means for forming an unfixed image onto a recording material and having the unfixed image carried thereon; and a fixing device for fixing the unfixed image onto the recording material, wherein an image heating device according to claim 46 is used as the fixing device.

48. An image heating device comprising:

a fixing belt, a pressure means that is pressed against the fixing belt to form a nip portion on the right side of the fixing belt, a heat-generating roller having at least a part composed of a conductive member and movably suspending the fixing belt, and an exciting coil arranged in opposition to the peripheral surface of the heat-generating roller via the fixing belt and adapted for allowing the heat-generating roller to generate heat by exciting the portion where the heat-generating roller is in contact with the fixing belt.

49. The image heating device according to claim 48, wherein the width of excitation in the direction in which the fixing belt moves is substantially the same as or not more than the width of the portion where the fixing belt is in contact with the heat-generating roller.

50. The image heating device according to claim 48, further comprising a temperature detecting means for detecting the temperature, which is arranged in contact with the surface of the heat-generating roller at a portion other than a portion where the heat-generating roller is in contact with the fixing belt; and a control means for controlling an output from the exciting coil in accordance with an output from the temperature detecting means.

51. The image heating device according to claim 48, wherein an exciting current having a predetermined frequency is applied to the exciting coil, and the conductive member of the heat-generating roller has a thickness equal to or larger than the skin depth defined by the material thereof and the predetermined frequency.

52. An image forming apparatus comprising:

an image forming means for forming an unfixed image onto a recording material and having the unfixed image carried thereon; and a fixing device for fixing the unfixed image onto the recording material, wherein an image heating device according to claim 48 is used as the fixing device.

53. The image heating device according to claim 48, wherein at least a part of the fixing belt has conductivity and is caused to generate heat by induction heating, and the width of excitation in the direction in which the fixing belt moves is substantially the same as or not less than the width of the portion where the fixing belt is in contact with the heat-generating roller.

54. An image heating device comprising:

a fixing belt;

a pressure means that is pressed against the fixing belt to form a nip portion on the right side of the fixing belt, a heat-generating roller made of magnetic material whose Curie temperature is set to be a predetermined value and movably suspending the fixing belt;

a conductive member provided inside the heat-generating roller; and an exciting coil arranged in opposition to the peripheral surface of the heat-generating roller via the fixing belt and adapted for allowing the heat-generating roller to generate heat by exciting the portion where the heat-generating roller is in contact with the fixing belt.

55. The image heating device according to claim 54, wherein the conductive member is arranged adiabatically with respect to the heat-generating roller.

56. The image heating device according to claim 54, wherein an exciting current having a predetermined frequency is applied to the exciting coil, and the heat-generating roller has a thickness equal to or larger than the skin depth defined by the material thereof and the predetermined frequency.

57. An image forming apparatus comprising:

an image forming means for forming an unfixed image onto a recording material and having the unfixed image carried thereon; and a fixing device for fixing the unfixed image onto the recording material, wherein an image heating device according to claim 54 is used as the fixing device.

58. An image heating device comprising:

a heat-generating member comprising a rotatable body having conductivity, and an exciting coil arranged in opposition to the outer peripheral surface of the heat-generating member and adapted for allowing the heat-generating member to generate heat with electromagnetic induction;

further comprising a core made of magnetic material arranged outside the exciting coil, and the length of the core along the direction of the rotation axis of the heat-generating member is not shorter than the width of a recording material having the maximum width of all the recording materials to be used.

* * * * *